US007560216B2

(12) United States Patent
Sugiyama et al.

(10) Patent No.: US 7,560,216 B2
(45) Date of Patent: Jul. 14, 2009

(54) IMAGE-FIXING METHOD AND IMAGE-FIXING DEVICE, AND, IMAGE-FORMING METHOD AND IMAGE-FORMING APPARATUS

(75) Inventors: Tsunemi Sugiyama, Yokohama (JP); Yohichiroh Watanabe, Fuji (JP); Hiroshi Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 547 days.

(21) Appl. No.: 11/219,740

(22) Filed: Sep. 7, 2005

(65) Prior Publication Data

US 2006/0056888 A1 Mar. 16, 2006

(30) Foreign Application Priority Data

Sep. 7, 2004 (JP) ..... 2004-260169

(51) Int. Cl.
*G03G 15/20* (2006.01)

(52) U.S. Cl. ..... 430/123.41; 430/123.42; 430/123.5; 430/124.1; 430/124.3; 430/124.32

(58) Field of Classification Search ..... 430/123.41, 430/123.42, 123.5, 124.1, 124.3, 124.32
See application file for complete search history.

(56) References Cited

U.S. PATENT DOCUMENTS

| | | | | |
|---|---|---|---|---|
| 6,787,280 | B2 | 9/2004 | Yamashita et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 2002/0037467 | A1* | 3/2002 | Watanabe et al. | 430/110.1 |
| 2003/0016971 | A1* | 1/2003 | Kikuchi et al. | 399/323 |
| 2003/0027074 | A1* | 2/2003 | Emoto et al. | 430/124 |
| 2004/0115551 | A1 | 6/2004 | Sugiyama et al. | |

(Continued)

FOREIGN PATENT DOCUMENTS

| | | |
|---|---|---|
| JP | 2003-295664 | 10/2003 |

OTHER PUBLICATIONS

U.S. Appl. No. 11/029,453, filed Jan. 6, 2005, Shinji Ohtani, et al.

(Continued)

*Primary Examiner*—Hoa V Le
(74) *Attorney, Agent, or Firm*—Oblon, Spivak, McClelland, Maier & Neustadt, P.C.

(57) ABSTRACT

An image-fixing method contains: passing a recording medium bearing an image through a nip between two or more fixing members to fix the image onto the recording medium; and ejecting the recording medium along with the fixing member contacting with a non-image-bearing surface of the recording medium, wherein the fixing member contacting with an image-bearing surface of the recording medium has a lower surface hardness than that of the fixing member contacting with the non-image-bearing surface, the image is comprised of a toner containing toner particles, each toner particle contains wax having an aliphatic hydrocarbon chain, and polyester resin having an aromatic ring, a total amount of the wax in the toner particle is 1 to 20 mass %, determined by DSC, an amount of the wax located in the specific region of the toner particle is 0.05 to 0.40 that is an intensity ratio ($P_{2850}/P_{828}$) determined by FTIR-ATR, and the wax is partially or entirely encapsulated in the toner particle as dispersed particles.

14 Claims, 9 Drawing Sheets

U.S. PATENT DOCUMENTS

| | | | |
|---|---|---|---|
| 2004/0121256 | A1 | 6/2004 | Suzuki et al. |
| 2004/0131961 | A1 | 7/2004 | Watanabe et al. |
| 2004/0185365 | A1 | 9/2004 | Saito et al. |
| 2005/0003288 | A1 | 1/2005 | Sugiyama et al. |
| 2005/0079433 | A1 | 4/2005 | Watanabe et al. |
| 2006/0056888 | A1 | 3/2006 | Sugiyama et al. |

OTHER PUBLICATIONS

U.S. Appl. No. 11/513,175, filed Aug. 31, 2006, Ohki, et al.
U.S. Appl. No. 11/519,893, filed Sep. 13, 2006, Inoue, et al.
U.S. Appl. No. 11/868,618, filed Oct. 8, 2007, Sugiyama, et al.
U.S. Appl. No. 11/851,475, filed Sep. 7, 2007, Watanabe, et al.

* cited by examiner

PRIOR ART

IMAGE-FIXING METHOD AND IMAGE-FIXING DEVICE, AND, IMAGE-FORMING METHOD AND IMAGE-FORMING APPARATUS

BACKGROUND OF THE INVENTION

1. Field of the Invention

The present invention relates to image-fixing method and apparatus, image-forming method and apparatus, and toners applicable therefore, all of which are suitably used in an electrophotography, a latent electrostatic recording method, a latent electrostatic printing method, and the like.

2. Description of the Related Art

Conventionally, a heating-roller fixing system has been widely applied as an image-fixing method in multifunctional photocopiers, printers and the like, because of a simple mechanical structure thereof and easy handling.

In the heating-roller fixing system, however, there were drawbacks such that it is necessary to wait until a heating roller reaches at a certain temperature, a thermal capacity of the heating roller has to be large since it is necessary to maintain the temperature of the heating roller at a desirable level in order to inhibit fixing defects and offset phenomena resulted from passages of recording mediums and fluctuation in the temperature of the heating roller due to external factors.

There are also recent trends of the multifunctional photocopiers and printers such that black & white printing has been rapidly taken over by full color printing, and a market for the full color printing is increased.

In the full color printing, a full color toner forms a color by superimposing two or more colors of toners or mixing these colors.

In order to obtain vivid color images with good color reproduction, is it necessary that each color of toners is sufficiently fused and mixed with each other. More vivid color of images can be realized by imparting glossiness.

In order to obtain images without unevenness of glossiness or dot image, it is necessary to employ an elastic layer on a surface of a fixing member as the elastic layer can change its shape depending on a surface configuration of the recording medium at the time of fixing the toner. If the thickness of the elastic layer becomes thicker, however, there are drawbacks such as enlarged thermal capacity, worsen energy-saving, and the like.

Moreover, glossiness of images is related to a smoothness of a surface subjected to fixing. For example, compression from upper side of the fixing surface has been known and employed as means for obtaining smoothness of the surface. In the aforementioned heat-roller fixing system, especially of color printing, a roller having a thick elastic layer is commonly used, and high pressure is applied. The multifunctional full-color photocopier generally utilizes low viscose color toners at a large amount. In such photocopier, the problems arise such that offset occurs or the recording medium wraps around the fixing roller at the time of ejecting due to curvature of the fixing roller. Therefore, it is necessary to apply releasing oil to the roller and to equip an oil tank in the photocopier.

It has been studied to solve the aforementioned drawbacks, and proposed a belt-fixing system and a method which does not apply releasing oil (oil-less system) or a method which applies a small amount of releasing oil. One of the advantages of the belt-fixing system is that a nip is formed by using a thin elastic body which is disposed heating or pressurizing side of the belt. Namely, an elastic member of small thermal capacity can be employed as a belt, and thus this system realizes both a formation of high quality image and energy-saving at the time of fixing.

As a belt-fixing device employing the oil-less system, Japanese Patent Application Laid-Open (JP-A) No. 2003-295664 discloses a fixing device wherein a hardness of a heating roller is adjusted to be higher than a hardness of a pressurizing roller, and the difference of the hardness is defined in terms of Asker C. This fixing device prevents recording mediums from wrapping around the heating roller or pressurizing roller. In the case that full-color image is formed with a large amount of a full-color toner, however, the problems remain such that toner is attached to the fixing belt and offset occurs since oil is not applied for the fixing belt.

Accordingly, it is the current situation that there have not yet been provided an image-fixing method capable of forming high quality images with excellent glossiness while preventing the recording medium from wrapping around the fixing members, and offset occurrence. It is also the situation that there have not yet been provided an image-fixing device, image-forming method, image-forming apparatus, and toner which are suitably applicable for such image-fixing method.

It is therefore an object of the present invention is to provide an image-fixing method which prevents recording mediums from wrapping around fixing members, desirable preventing an occurrence of off-set, providing images with excellent glossiness and high quality. Another object of the present invention is to provide an image-fixing device suitably applicable for the image-fixing method of the present invention, and an image-forming method and an image-forming apparatus utilizing the image-fixing method of the present invention. It is another object of the present invention is to provide a toner suitably applicable for the aforementioned the present invention.

SUMMARY OF THE INVENTION

The inventors of the present invention has diligently studied to accomplish the aforementioned objects and found that the present invention can prevents recording mediums from wrapping around fixing members, desirably preventing an occurrence of off-set, and can provide images with excellent glossiness and high quality. Namely, the objects can be achieved by: passing a recording medium bearing a toner image thereon through a nip formed between two or more fixing members so as to fix the toner image onto the recording medium; and ejecting the recording medium to beside of one of the two or more fixing members which contacts with a non-image-bearing surface of the recording medium. The aforementioned toner image has a maximum toner deposition amount of 0.4 mg/cm$^2$ to 1.5 mg/m$^2$ at least at a part thereof. In the present invention, the toner forming the toner image comprises toner particles, each toner particle comprises a wax has an aliphatic hydrocarbon chain in the polymeric structure thereof, and a polyester resin containing an aromatic ring in the polymeric structure thereof, a total amount of the wax in the toner particle is 1% by mass to 20% by mass, the total amount of the wax is determined as a value mass-converted from an endothermic value in accordance with DSC, an amount of the wax located in a region of the toner particle including from the surface to 0.3 μm depth from the surface (referred to a surface region hereinafter) is 0.05 to 0.40, the amount of the wax located in the surface region is determined as an intensity ratio ($P_{2850}/P_{828}$) of a peak 2850 cm$^{-1}$ derived from the wax to a peak 828 cm$^{-1}$ derived from the polyester resin, in accordance with FTIR-ATR, a ratio of the amount of the wax in the surface region to the total amount of the wax in the toner particle (wax content) is 0.1 or more and less than 1.0, in which the amount of the wax in the surface region is determined as a value which is mass-converted from an intensity ratio ($P_{2850}/P_{828}$) of a peak 2850 $cm^{-1}$ derived from the wax to a peak 828 $cm^{-1}$ derived from the polyester resin, in accordance with FTIR-ATR and the total amount of the wax is determined as a value which is mass-converted from an endothermic value of the wax in accordance with DSC, and at least a part of the wax is encapsulated in the toner particle in the form of dispersed particles. Moreover, one of the two or more fixing members which contacts with an image-bearing surface of the recording medium has a lower surface hardness than a surface hardness of the fixing member which contacts with the non-image-bearing surface of the recording medium.

The image-fixing method of the present invention comprises: passing a recording medium bearing a toner image through a nip formed between two or more fixing members so as to fix the toner image onto the recording medium; and ejecting the recording medium to beside of one of the two or more fixing members which contacts with a non-image-bearing surface of the recording medium, wherein one of the two or more fixing members which contacts with an image-bearing surface of the recording medium has a lower surface hardness than a surface hardness of the fixing member which contacts with the non-image-bearing surface of the recording medium, wherein the toner image has a maximum toner deposition amount of 0.4 $mg/cm^2$ to 1.5 $mg/cm^2$ at least at a part thereof, and wherein the toner image is comprised of a toner, the toner comprises toner particles, each toner particle comprises a wax having an aliphatic hydrocarbon chain in the polymeric structure thereof, and a polyester resin containing an aromatic ring in the polymeric structure thereof, a total amount of the wax in the toner particle is 1% by mass to 20% by mass, the total amount of the wax is determined as a value which is mass-converted from an endothermic value of the wax in accordance with DSC, an amount of the wax located in the surface region of the toner particle is 0.05 to 0.40, the amount of the wax located in the surface region is determined as an intensity ratio ($P_{2850}/P_{828}$) of a peak 2850 $cm^{-1}$ derived from the wax to a peak 828 $cm^{-1}$ derived from the polyester resin in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

In the image-fixing method of the present invention, the recording medium bearing the toner image having a maximum toner deposition amount of 0.4 $mg/cm^2$ to 1.5 $mg/cm^2$ at least at a part thereof is passed through the nip formed by disposing the two or more fixing members abut onto each other. The toner image is fixed onto the recording medium in this step. At the time of fixing, the wax oozes from the toner particles and exhibits relesability, since the toner used for the invention comprises a wax in each toner particle, the total amount of the wax in the toner particles is 1% by mass to 20% by mass, which is determined as a value mass-converted from an endothermic value of the wax in accordance with DSC, an amount of the wax located in the surface region of the toner particle is 0.05 to 0.40, which is determined as an intensity ratio ($P_{2850}/P_{828}$) of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

The recording medium is sequentially ejected after being passed through the nip. In the present invention, one of the two or more fixing members which contacts with the image-bearing surface of the recording medium has a lower surface hardness than a surface hardness of the fixing member which contacts with the non-image-bearing surface of the recording medium, and the recording medium is ejected to beside of the fixing member which contacts with the non-image-bearing surface. As a result of such configurations, the recording medium is efficiently prevented from wrapping around the fixing members, any occurrence of off-set is effectively prevented, and the image with excellent glossiness and high quality can be obtained.

The image-fixing device of the present invention comprises two or more fixing members, wherein the two or more fixing members are disposed so as to form a nip therebetween which allows a recording medium bearing a toner image to pass through, thereby fixing the toner image on the recording medium, and so as to eject the recording medium to beside of one of the two or more fixing members which contacts with a non-image-bearing surface of the recording medium, wherein one of the two or more fixing members which contacts with an image-bearing surface of the recording medium has a lower surface hardness than a surface hardness of the fixing member which is configured to contact with the non-image-bearing surface of the recording medium, wherein the toner image has a maximum toner deposition amount of 0.4 $mg/cm^2$ to 1.5 $mg/cm^2$ at least at a part thereof, and wherein the toner image is comprised of a toner, the toner comprises toner particles, each toner particle comprises a wax having an aliphatic hydrocarbon chain in the polymeric structure thereof, and a polyester resin containing an aromatic ring in the polymeric structure thereof, a total amount of the wax in the toner particle is 1% by mass to 20% by mass, the total amount of the wax is determined as a value which is mass-converted from an endothermic value of the wax in accordance with DSC, an amount of the wax located in the surface region of the toner particle is 0.05 to 0.40, which is an intensity ratio ($P_{2850}/P_{828}$) of a peak 2850 $cm^{-1}$ derived from the wax to a peak 828 $cm^{-1}$ derived from the polyester resin in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

In the image-fixing device of the present invention, the recording medium bearing the toner image having a maximum toner deposition amount of 0.4 $mg/cm^2$ to 1.5 $mg/cm^2$ at least at a part thereof is passed through the nip formed by disposing the two or more fixing members abut onto each other. The toner image is fixed onto the recording medium in this step. At the time of fixing, the wax oozes from the toner particles, thereby exhibiting a releasing ability, since the toner used for the present invention comprises a wax in each toner particles, a total amount of the wax in the toner particles is 1% by mass to 20% by mass, the total amount of the wax is determined as a value which is mass-converted from an endothermic value of the wax in accordance with DSC, an amount of the wax located in the surface region of the toner particle is 0.05 to 0.40, which is determined as an intensity ratio ($P_{2850}/P_{828}$) of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

The recording medium is sequentially ejected after being passed through the nip. In the present invention, one of the two or more fixing members which contacts with the image-bearing surface of the recording medium has a lower surface hardness than a surface hardness of the fixing member which contacts with the non-image-bearing surface of the recording medium, and the recording medium is ejected to beside of the fixing member which contacts with the non-image-bearing surface. As a result of such configurations, the recording medium is efficiently prevented from wrapping around the fixing members, any occurrence of off-set is effectively prevented, and the image with excellent glossiness and high quality can be obtained.

The image-forming method of the present invention comprising: developing a latent electrostatic image formed on a latent electrostatic image bearing member with a toner so as to form a toner image having a maximum toner deposition amount of 0.4 $mg/cm^2$ to 1.5 $mg/cm^2$ at least at a part thereof; transferring the toner image onto a recording medium; passing the recording medium bearing the toner image thereon through a nip formed between two or more fixing members so as to fix the toner image onto the recording medium, and ejecting the recording medium to beside of the two or more fixing members which contacts with a non-image-bearing surface of the recording medium, wherein one of the two or more fixing members which contacts with an image-bearing surface of the recording medium has a lower surface hardness than a surface hardness of the fixing member which contacts with the non-image-bearing surface of the recording medium, and wherein the toner comprises toner particles, each toner particle comprises a wax having an aliphatic hydrocarbon chain in the polymeric structure thereof, and a polyester resin containing an aromatic ring in the polymeric structure thereof, a total amount of the wax in the toner particle is 1% by mass to 20% by mass, the total amount of the wax is determined as a value which is mass-converted from an endothermic value of the wax in accordance with DSC, an amount of the wax located in the surface region of the toner particle is 0.05 to 0.40, which is determined as an intensity ratio ($P_{2850}/P_{828}$) of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

In the image-forming method of the present invention, the recording medium bearing the toner image having a maximum toner deposition amount of 0.4 $mg/cm^2$ to 1.5 $mg/cm^2$ at least at a part thereof is passed through the nip formed by disposing the two or more fixing members abut onto each other. The toner image is fixed onto the recording medium in this step. At the time of fixing, the wax oozes from the toner particles, thereby exhibiting a releasing ability, since the toner used for the present invention comprises a wax in each toner particles, a total amount of the wax in the toner particles is 1% by mass to 20% by mass, the total amount of the wax is determined as a value which is mass-converted from an endothermic value in accordance with DSC, an amount of the wax located in the surface region of the toner particle is 0.05 to 0.40, which is an intensity ratio ($P_{2850}/P_{828}$) of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

The recording medium is sequentially ejected after being passed through the nip. In the present invention, one of the two or more fixing members which contacts with the image-bearing surface of the recording medium has a lower surface hardness than a surface hardness of the fixing member which contacts with the non-image-bearing surface of the recording medium, and the recording medium is ejected to beside of the fixing member which contacts with the non-image-bearing surface. As a result of such configurations, the recording medium is efficiently prevented from wrapping around the fixing members, any occurrence of off-set is effectively prevented, and the image with excellent glossiness and high quality can be obtained.

The image-forming apparatus of the present invention comprises: a toner-image forming unit which configured to develop a latent electrostatic image formed on a latent electrostatic image bearing member with a toner so as to form a toner image having a maximum toner deposition amount of 0.4 $mg/cm^2$ to 1.5 $mg/cm^2$ at least at a part thereof; a transferring unit which is configured to transfer the toner image to a recording medium; and two or more fixing members which are disposed so as to form a nip therebetween which allows the recording medium bearing the toner image to pass through, thereby fixing the toner image on the recording medium, wherein the two or more fixing members are disposed so as to eject the recording medium to beside of one of the two or more fixing members which is configured to contact with a non-image-bearing surface of the recording medium, wherein one of the two or more fixing members which contacts with an image-bearing surface of the recording medium has a lower surface hardness than a surface hardness of the fixing member which contacts with the non-image-bearing surface of the recording medium, and wherein the toner comprises toner particles, each toner particle comprises a wax having an aliphatic hydrocarbon chain in the polymeric structure thereof, and a polyester resin containing an aromatic ring in the polymeric structure thereof, a total amount of the wax in the toner particle is 1% by mass to 20% by mass, the total amount of the wax is determined as a value which is mass-converted from an endothermic value of the wax in accordance with DSC, an amount of the wax located in the surface region of the toner particle is 0.05 to 0.40, which is determined as an intensity ratio ($P_{2850}/P_{828}$) of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

In the image-forming apparatus of the present invention, the recording medium bearing the toner image having a maximum toner deposition amount of 0.4 $mg/cm^2$ to 1.5 $mg/cm^2$ at least at a part thereof is passed through the nip formed by disposing the two or more fixing members abut onto each other. The toner image is fixed onto the recording medium in this step. At the time of fixing, the wax oozes from the toner particles, thereby exhibiting releasing ability, since the toner used for the present invention comprises a wax in each toner particle, a total amount of the wax in the toner particles is 1% by mass to 20% by mass, the total amount of the wax is determined as a value which mass-converted from an endothermic value in accordance with DSC, an amount of the wax located in the surface region of the toner particle is 0.05 to 0.40, which is an intensity ratio ($P_{2850}/P_{828}$) of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

The recording medium is sequentially ejected after being passed through the nip. In the present invention, one of the two or more fixing members which contacts with the image-bearing surface of the recording medium has a lower surface hardness than a surface hardness of the fixing member which contacts with the non-image-bearing surface of the recording medium, and the recording medium is ejected to beside of the fixing member which contacts with the non-image-bearing surface. As a result of such configurations, the recording medium is efficiently prevented from wrapping around the fixing members, any occurrence of off-set is effectively prevented, and the image with excellent glossiness and high quality can be obtained.

The toner of the present invention comprises toner particles, each toner particle comprising: a wax having an aliphatic hydrocarbon chain in a polymeric structure thereof; and a polyester resin containing an aromatic ring in a polymeric structure thereof, wherein a total amount of the wax in the toner particle is 1% by mass to 20% by mass, the total amount of the wax is determined as a value which is mass-converted from an endothermic value of the wax in accordance with DSC, an amount of the wax located in a region of the toner particle including from the surface to 0.3 μm depth from the surface is 0.05 to 0.40, the amount of the wax located in the region is determined as an intensity ratio $P_{2850}/P_{828}$ of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles, and wherein the toner forms a toner image having a maximum toner deposition amount of 0.4 $mg/cm^2$ to 1.5 $mg/cm^2$, the toner image disposed on a recording medium is processed in an image-fixing device, which comprises two or more fixing members disposed so as to form a nip therebetween which allows the recording medium bearing the toner image to pass through, thereby fixing the toner image on the recording medium, and so as to eject the recording medium to beside of one of the two or more fixing members which contacts with a non-image-bearing surface of the recording medium, and one of the two or more fixing members which contacts with an image-bearing surface of the recording medium has a lower surface hardness than a surface hardness of the fixing member which is configured to contact with the non-image-bearing surface of the recording medium.

In the toner of the present invention, as the wax oozes from the toner particles, thereby exhibiting a releasing ability. Accordingly, the present invention realizes that any occurrence of off-set can be effectively presented, and images with excellent glossiness and high quality can be obtained.

Accordingly, the toner of the present invention is applicable for the image-fixing device of the present invention.

The toner of the present invention comprises toner particles, each toner particle comprising: a wax having an aliphatic hydrocarbon chain in a polymeric structure thereof; and a polyester resin containing an aromatic ring in a polymeric structure thereof, wherein a total amount of the wax in the toner particle is 1% by mass to 20% by mass, the total amount of the wax is determined as a value which is mass-converted from an endothermic value of the wax in accordance with DSC, an amount of the wax located in a region of the toner particle including from the surface to 0.3 μm depth from the surface is 0.05 to 0.40, the amount of the wax located in the region is determined as an intensity ratio $P_{2850}/P_{828}$ of a peak 2850 $cm^{-1}$ derived from the wax to a peak 828 $cm^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles, and wherein the toner forms a toner image having a maximum toner deposition amount of 0.4 mg/cm$^2$ to 1.5 mg/cm$^2$ in an image-forming apparatus, which comprises an image-forming unit which configured to develop a latent electrostatic image formed on a latent electrostatic image bearing member with the toner so as to form the toner image, and two or more fixing members disposed so as to form a nip therebetween which allows the recording medium bearing the toner image to pass through, thereby fixing the toner image on the recording medium, and so as to eject the recording medium to beside of one of the two or more fixing members which contacts with a non-image-bearing surface of the recording medium, and one of the two or more fixing members which contacts with an image-bearing surface of the recording medium has a lower surface hardness than a surface hardness of the fixing member which is configured to contact with the non-image-bearing surface of the recording medium.

In the toner of the present invention, as the wax oozes from the toner particles, thereby exhibiting a releasing ability. Accordingly, the present invention realizes that any occurrence of off-set can be effectively presented, and images with excellent glossiness and high quality can be obtained.

Accordingly, the toner of the present invention is suitably applicable for the image-forming apparatus of the present invention.

Figure 1:
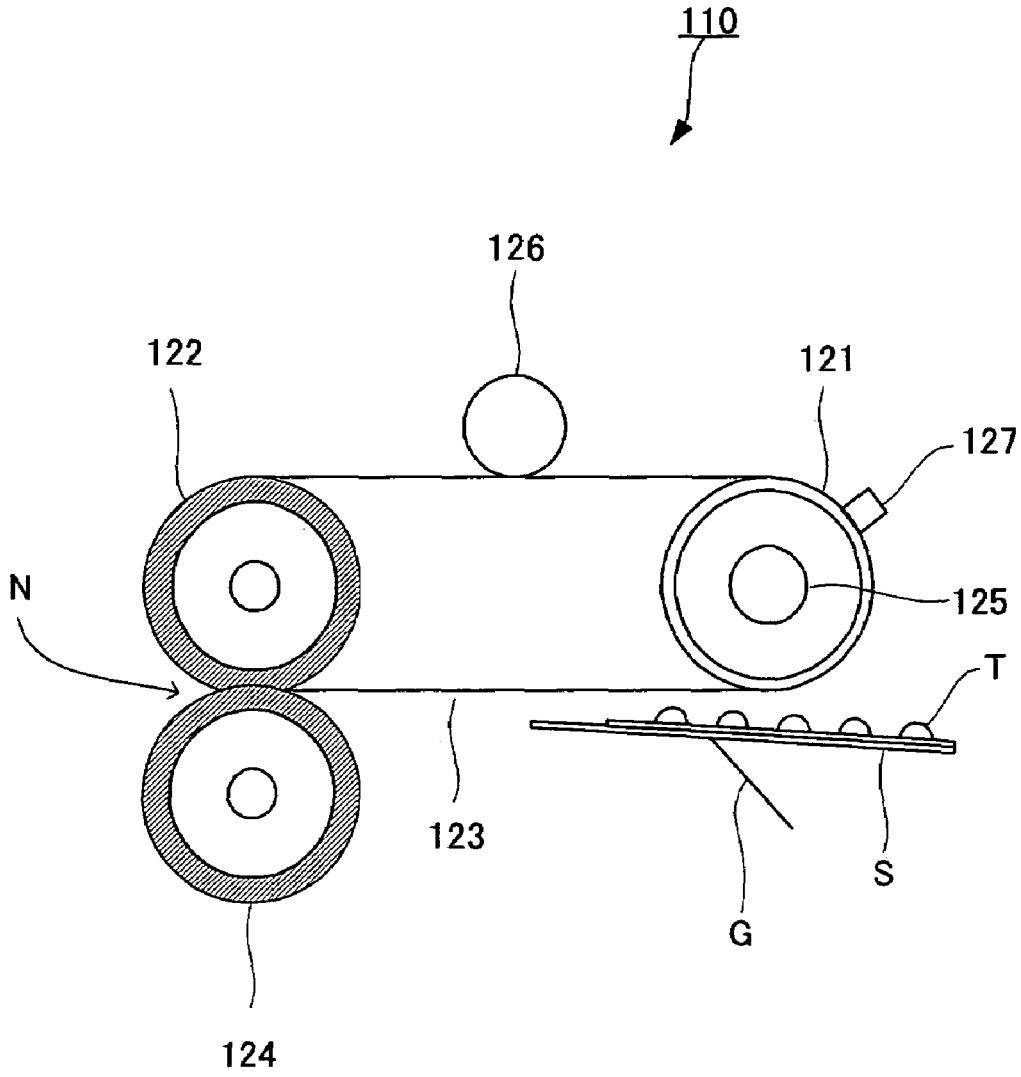
FIG. 1 is a schematic diagram showing an exemplary construction of the image-fixing device (belt-fixing device) according to the present invention.

DESCRIPTION OF THE PREFERRED EMBODIMENTS (Image-Fixing Method and Image-Fixing Device)

The image-fixing method of the present invention comprises a fixing step of passing a recording medium bearing a toner image through a nip formed between two or more fixing members so as to fix the toner image onto the recording medium. The image-fixing method of the present invention comprises other steps which are suitably selected in accordance with a purpose, if necessary.

The image-fixing device of the present invention comprises two or more fixing members disposed adjacent to each other so as to form a nip therebetween, in which the nip is configured to pass a recording medium through. The image-fixing device of the present invention comprises other members which are suitably selected in accordance with a purpose, if necessary.

The toner for use in the present invention comprises toner particles, each of which comprises a wax having an aliphatic hydrocarbon chain in the polymeric structure thereof, and a polyester resin containing an aromatic ring in the polymeric structure thereof, wherein a total amount of the wax in the toner particle is 1% by mass to 20% by mass, the total amount of the wax is determined as a value which is mass-converted from an endothermic value in accordance with differential scanning calorimetry (DSC), an amount of the wax located in a region of the toner particle including from the surface to 0.3 μm depth from the surface (such region is referred to "surface region" in the specification) is 0.05 to 0.40, the amount of the wax located in the surface region is determined as an intensity ratio ($P_{2850}/P_{828}$) of a peak 2850 cm$^{-1}$ derived from the wax to a peak 828 cm$^{-1}$ derived from the polyester resin, in accordance with Fourier transform infrared spectroscopy by attenuated total reflectance (FTIR-ATR). A ratio of the amount of the wax located in the aforementioned surface region of the toner particle to the total amount of the wax in the toner particle is 0.1 or more and less than 1.0. This ratio is calculated by determining the amount of the wax in the surface region as a value which is mass-converted from the intensity ratio ($P_{2850}/P_{828}$) of a peak 2850 cm$^{-1}$ derived from the wax to a peak 828 cm$^{-1}$ derived from the polyester resin, in accordance with FTIR-ATR, and the total amount of the wax as a value which is mass-converted from an endothermic value of the wax in accordance with DSC. Moreover, at least a part of the wax is encapsulated in the toner particle in the form of dispersed particles.

In the present invention, among the two or more the fixing member, the fixing member which contacts with an image-bearing surface of the recording medium has lower surface hardness than a surface hardness of the fixing member which contacts with a non-image-bearing surface of the recording medium, and the fixing members are configured so as to eject the recording medium to aside of the fixing member which contacts with the non-image-bearing surface of the recording medium, rather than aside of the fixing member which contacts with the image-bearing surface of the recording medium.

The image-fixing method of the present invention can be preferably performed in assistance with the image-fixing device of the present invention. Note that the image-fixing device of the present invention is simultaneously used when the image-fixing method of the present invention is performed. Accordingly, the details of the image-fixing device are also explained in the descriptions of the image-fixing method hereinafter.

<Fixing Step>

The aforementioned fixing step comprises, passing a recording medium bearing a toner image through a nip formed between two or more fixing members so as to fix the toner image onto the recording medium.

In the case that an image is formed in full color, the fixing step is performed each time when each color toner is transferred onto a recording medium, or, the fixing step is performed once after all color toners are transferred and laminated onto a recording medium.

The toner image has a maximum toner deposition amount of 0.4 mg/cm$^2$ to 1.5 mg/m$^2$, and preferably 0.8 mg/cm$^2$ to 1.5 mg/m$^2$, at least at part thereof. The image-fixing method of the present invention realizes desirable releasing ability and high quality image formation even when the fixing is performed to a full-color toner image which has a large toner deposition amount resulted from superimposing color toner images.

[Fixing Member]

The aforementioned fixing members are configured that, within the two or more fixing members, a surface hardness of the fixing member which contacts with an image-bearing surface of the recording medium is lower than a surface hardness of the fixing member which contacts with a non-image-bearing surface of the recording medium (hereinafter such fixing members are referred to an image-contact fixing member and a non-image-contact fixing member, respectively). When the surface hardness of the image-contact fixing member is lower than that of the non-image-contact fixing member, sufficient fixing properties can be achieved. The fixing properties can also be attained even when a recording medium has uneven surface textures. In addition, the fixing members are disposed so that a nip formed therebetween has a convex shape towards the image-contact fixing member.

After the recording medium is passed through the nip, it is important that the recording medium is ejected to beside of the non-image-contact fixing member, rather than beside of the image-contact fixing member. Since the convex shape is formed towards the image-contact fixing member in the region of the nip, the recording medium is passed through the nip along with the convex shape, and sequentially is ejected to the side of the non-image-contact fixing member (to the direction away from the image-contact fixing member), thereby preventing the recording medium from wrapping around the fixing members.

In the nip, it is defined that: an edge of the nip where the recording medium is introduced is an introducing nip edge; an edge of the nip where the recording medium is ejected is an ejecting nip edge; and an intermediate area of the nip located in between the introducing nip edge and the ejecting nip edge is a center of the nip. It is preferable that the center of the nip is located towards the image-contact fixing member compared with the introducing nip edge and the ejecting nip edge. When the center of the nip is in the aforementioned location, the convex shape is formed towards the image-contact fixing member, thereby preventing the recording medium from wrapping around the fixing members.

The fixing members are not particularly limited, and can be appropriately selected in accordance with a purpose, provided that the fixing members are capable of forming a nip when disposed adjacent to each other. Examples of the fixing members are a combination of an endless belt and a roller, a combination of two rollers, and the like. The combination of an endless belt and a roller which has a small thermal capacity, is preferable for the fixing members from the view points of that a time required for warming-up can be reduced, energy-saving can be achieved, and a fixing region can be largely maintained.

The fixing member is, for example, a conventional heat-pressure fixing member which is in combination of a heating member and pressurizing member, and the like.

The image-contact fixing member is preferably a combination of an endless belt and a roller which is disposed inner side of the endless belt with respect to the recording medium, such as a combination of a heating roller, a pressurizing roller, and an endless belt.

The non-image-contact fixing member is preferably roller(s), such as a combination of a heating roller and a pressurizing roller.

The surface hardness of the fixing members are not particularly limited, and can be appropriately adjusted in accordance with a purpose, provided that the surface hardness of the image-contact fixing member is lower than that of the non-image-contact fixing member. Note that, in the case that the image-contact fixing member is a combination of an endless belt and a roller which is disposed inner side of the endless belt with respect to the recording medium, the surface hardness of the image-contact fixing member is a surface hardness of the endless belt measured at the condition in the combination with the roller.

The surface hardness of the image-contact fixing member is 30 degrees to 90 degrees, preferably 35 degrees to 70 degrees, and more preferably 40 degrees to 60 degrees in terms of Asker C.

In the case that the surface hardness is less than 30 degrees in terms of Asker C, a sufficient pressure cannot be applied at the time of fixing so that the toner cannot be efficiently fixed onto the recording medium, and elasticity and physical strength thereof becomes low so that life-time of the fixing member itself becomes short. In the case that the surface hardness is more than 90 degrees in terms of Asker C, for example when the image-contact fixing member is a combination of an endless belt and a roller, a surface of the endless belt is liable to be damaged, so that life-time of the endless belt becomes short.

The surface hardness of the non-image-contact fixing member is 40 degrees to 99 degrees, preferably 45 degrees to 80 degrees, and more preferably 50 degrees to 70 degrees in terms of Asker C.

In the case that the surface hardness is less than 40 degrees in terms of Asker C, a sufficient pressure cannot be applied at the time of fixing so that the toner cannot be efficiently fixed onto the recording medium. In the case that the surface hardness is more than 99 degrees in terms of Asker C, as mentioned above, a surface of the endless belt is liable to be damaged, so that life-time of the endless belt becomes short.

When an endless belt is selected as the fixing member, the endless belt is preferably formed of a material having a small thermal capacity, and for example an endless belt having an offset-inhibiting layer on a substrate, in which the materials to form the substrate are, for example, nickel, polyimide, and the like, and the materials to form the offset-inhibiting layer are, for example, silicone rubber, fluororesin, and the like.

When a roller is selected as the fixing member, the roller is preferably formed of non-elastic member. The non-elastic member is not particularly limited and can be appropriately selected in accordance with a purpose. Suitable examples thereof are high thermal conductors such as aluminum, iron, stainless steel, brass, and the like. The roller is preferably coated with an offset-inhibiting layer. The materials of off-set inhibiting layer are not particularly limited and can be appropriately selected in accordance with a purpose. Suitable examples thereof are RTV, silicone rubber, tetrafluoroethylene perfluoroaklylvinylether (PFA), polytetrafluoroethylene (PTFE), and the like.

The fixing members may have a heating unit therein and function as a heating member. However, it is more preferable that a surface of at least one of the fixing member is partially or entirely heated by a heating unit. Such heating unit is not particularly limited and can be appropriately selected in accordance with a purpose. Suitable examples of the hearing unit are an electromagnetic-induction heating unit and the like. With assistance of the electromagnetic-induction heating unit, the fixing member such as an endless belt can be rapidly heated at the time of applying electromagnetic induction, and thermal efficiency thereof can be improved.

The electromagnetic-induction heating unit is not particularly limited and can be appropriately selected in accordance with a purpose. Suitable examples thereof are an electromagnetic-induction heating unit which comprises an induction coil disposed adjacent to the fixing member such as a heating roller, a shielding layer in or on which the induction coil is disposed, and an insulating layer disposed on the opposite face of the shielding layer to the face of the shielding layer where the induction coil is disposed. In this embodiment, the aforementioned heat roller is a magnetic body, and preferably a heat pipe.

The induction coil is preferably disposed so as to cover at least a half cylinder part of the heating roller, which is an opposite side of a contact region of the heating member and the fixing member such as a pressurizing roller, an endless belt, and the like.

[Toner]

The aforementioned toner comprises toner particles, each toner particle comprises a wax having an aliphatic hydrocarbon chain in the polymeric structure thereof, and a polyester resin containing an aromatic ring in the polymeric structure therein, a total amount of the wax in the toner particle is 1% by mass to 20% by mass, the total amount of the wax is determined as a value which is mass-converted from an endothermic value of the wax in accordance with DSC, and an amount of the wax located in a region of the toner particle including from the surface to 0.3 μm depth from the surface, i.e., the surface region of the toner particle is 0.05 to 0.40, which is determined as an intensity ratio ($P_{2850}/P_{828}$) of a peak 2850 $cm^{-1}$ derived from the wax to a peak 828 $cm^{-1}$ derived from the polyester resin, in accordance with FTIR-ATR.

A ratio of the amount of the wax in the surface region of the toner particle to the total amount of the wax in the toner particle is 0.1 or more and less than 1.0. The amount of the wax in the surface region of the toner particle is determined as a value which is mass-converted from an intensity ratio ($P_{2850}/P_{828}$) of a peak 2850 $cm^{-1}$ derived from the wax to a peak 828 $cm^{-1}$ derived from the polyester resin, in accordance with FTIR-ATR. In addition, the total amount of the wax is determined as a value which is mass-converted from an endothermic value of the wax in accordance with DSC.

At least a part of the wax is encapsulated in the toner particle in the form of dispersed particles.

The toner particle further comprises a colorant, a charge controlling agent and the like, if necessary.

The toner is not particularly limited and can be selected in accordance with a purpose. The toner is, for example, a toner containing a binder resin, which is formed by a conventional suspension-polymerization method, emulsion-aggregation method, dissolution-suspension method, and the like. It is preferred that the toner is a toner formed by a process comprising the steps of: dissolving and/or dispersing, in an organic solvent, an active hydrogen group-containing compound and a polymer capable of reacting with the active hydrogen group-containing compound so as to form a toner solution; dispersing the toner solution in an aqueous medium so as to form a dispersion; and allowing the active hydrogen group-containing compound and the polymer to react so as to form an adhesive base material in the form of particles; and removing the organic solvent.

-Wax-

The total amount of the wax in the toner particle is 1% by mass to 20% by mass, and preferably 3% by mass to 15% by mass, which is determined as a value mass-converted from an endothermic value of the wax in accordance with DSC. In the case that the total amount of the wax is less than 1% by mass, the releasing ability becomes insufficient so that offset is liable to occur. In the case that the total amount of the wax is more than 20% by mass, the wax is liable to fall off from a surface of the toner particles after being stirred for a long-period of time in a developing unit, and is liable to attach to a surface of carrier particles and various members of the developing unit, so that a charge amount of a developer becomes low, thereby causing image defects.

The total amount of the wax is measured in accordance with differential scanning calorimetry (DSC), for example, by using a DSC 60 (manufactured by Shimadzu Corporation). A specific method thereof is explained hereinafter. About 5 mg of a toner sample is charged in a sample container formed of aluminum; the sample contained is placed on a holder unit; the holder unit is set in an electric oven. The temperature therein is increased from an ambient temperature to 150° C. at 10° C./min.; the temperature is kept at 150° C. for 10 minutes; the sample toner is then cooled down to an ambient temperature and left to stand for 10 minutes. The sample toner is then heated up to 150° C. at 10° C./min under $N_2$ atmosphere; a DSC spectrum of the sample toner is measured by a differential scanning calorimeter; endothermic value of the wax in the toner sample is calculated from the DSC spectrum. Thereafter, the total amount of the wax is calculated from the obtained endothermic values in accordance with the following Formula (1):

$$\text{Wax Content (\% by mass)} = (\text{endothermic value of wax in toner sample (J/g)})/(\text{endothermic value of wax itself (J/g)}) \times 100 \qquad \text{Formula (1)}$$

The above-explained measuring method realizes an efficient determination of the total amount of the wax in a toner particle even when a whole amount of wax added to a toner material is not contained in toner particles, such as the case that some of the wax oozes out during a toner production process.

The amount of the wax located in a region of the toner particle including from the surface to 0.3 μm depth from the surface, i.e., a surface region of the toner particle, is 0.05 to 0.40, and preferably 0.07 to 0.30, which is determined as an intensity ratio ($P_{2850}/P_{828}$) of a peak 2850 $cm^{-1}$ derived from the wax to a peak 828 $cm^{-1}$ derived from the polyester resin, in accordance with Fourier transform infrared spectroscopy by attenuated total reflectance (FTIR-ATR).

In the case that the intensity ratio ($P_{2850}/P_{828}$) is less than 0.05, an amount of the wax located in the surface region of the toner particle is small, which means the toner particles attached to a cleaning member after cleaning have a small amount of wax on the surface of the toner particles, thereby causing outflow (fusion) of the toner particles from the cleaning member to the fixing members, and offset. In the case that the intensity ratio ($P_{2850}/P_{828}$) is more than 0.40, the wax is liable to fall off from a surface of the toner particles after being stirred for a long time in a developing unit, and is liable to attach to a surface of carrier particles and various members of the developing unit, so that a charge amount of a developer becomes low, thereby causing image defects.

The wax located in the region of the toner particle including from the surface to 0.3 μm depth from the surface, i.e., the surface region of the toner particle, efficiently exhibits a releasing ability of the toner, and oozes from the surface of the toner particle by applied heat or pressure at the time of fixing.

The wax located in a surface region of the toner particle is measured as a relative amount of the wax located in the region of the toner particle including from the surface to 0.3 μm depth from the surface in accordance with Fourier transform infrared spectroscopy by attenuated total reflectance (FTIR-ATR). Specific method is explained hereinafter.

As a sample, 3 g of the toner is formed into a pellet (diameter: 40 mm, thickness: about 2 mm) by pressing with a weight of 6 t for one minute using an automatic briquetting press device, Type M, No. 50 BRP-E (manufactured by MAEKAWA TESTING MACHINE MFG. CO, LTD). The surface of this toner pellet is subjected to a measurement in accordance with FTIR-ART. As a FTIR-ART microscopic device, there is prepared that Spectrum One (manufactured by PERKIN ELMER) equipped with a MultiScope FTIR unit. A measurement is carried out by a micro attributed total reflectance of germanium (Ge) crystal having a diameter of 100 μm. The conditions for the measurement are as follow: instance angle of infrared ray is 41.5°; resolution is 4 $cm^{-1}$; and estimation is of twenty times. An intensity ratio ($P_{2850}/P_{828}$) of a peak 2850 $cm^{-1}$ derived from the wax to a peak 828 $cm^{-1}$ derived from the polyester resin is determined as a relative amount of the wax located in a surface region of the toner particle. The amount of the wax is taken as an average value of four measurements performed at mutually different portions.

A ratio (wax in the surface region of the toner particle/total amount wax in the toner particle) of the amount of the wax located in the region of the toner particle including the surface to 0.3 μm depth from the surface, which is mass-converted from the intensity ratio ($P_{2850}/P_{828}$) to the total amount of the wax in the toner particle which is mass-converted from the endothermic value of the wax measured in accordance with DSC, is 0.1 or more and less than 1.0, and preferably 0.5 to 0.9.

In the case that the ratio of the wax located in the surface region of the toner particle to the total amount of the wax in the toner particle is in the range of 0.1 or more and less than 1.0, a suitable amount of the wax is located on the surface region of the toner particle, and the larger amount of the wax is located inner side of the toner particle than the surface region. Therefore, the toner exhibits an excellent releasing ability even at the time of fixing full-color image having large toner deposition amount.

The method of mess-converting the intensity ratio ($P_{2850}/P_{828}$) in order to the amount of the wax located in the surface region of the toner particle is as follow.

With the polyester resin is respectively mixed 1% by mass, 3% by mass, 5% by mass, 8% by mass, and 10% by mass of the wax. Each of the mixtures is uniformly dispersed by means of an agate mortar to thereby yield pellets. The pellets are subjected to the measurements of intensity ratio ($P_{2850}/P_{828}$) of the peak derived from the wax (2850 $cm^{-1}$) to the peak derived from the polyester resin (828 $cm^{-1}$). The calibration curve is formed from the results, and the amount of the wax located in the surface region is calculated from the calibration curve.

The wax is partially or entirely encapsulated in the toner particle in the form of dispersed particles. The dispersing condition of the wax in the toner particle affects a releasing ability of the toner at the time of fixing. By a configuration such that the wax is partially or entirely encapsulated in the toner particle and the wax is present in the toner as finely dispersed particles, the wax is liable to ooze from the toner particle at the time of fixing, prevents the toner from fusing onto the fixing members in an oil-applied fixing device which has a decreased oil applying effect, and is capable of obtaining an excellent releasing ability at the time of fixing.

It is preferred that the dispersed particles are uniformly dispersed in the toner particle in view of a stable releasing ability.

A method for uniformly dispersing the dispersed particles in the toner particle is, for example, to perform a mixing while applying a shearing force in the toner production process.

The dispersing condition of the wax in the toner particle, i.e., whether or not the wax is at least partially encapsulated in the toner particle in the form of dispersed particles, can be determined by observing a thin slice of the toner by means of a transmission electron microscope (TEM). Specifically, the toner is embedded in an epoxy resin; the resin is thinly sliced; the thin slice is dyed with ruthenium tetraoxide; and the section of the toner particles are observed at a magnification of 10,000 times by means of TEM. In the case that an existence of the wax in the toner particle is confirmed at a magnification of 10,000 in the obtained enlarge picture (TEM picture), it is determined that the wax is located in the toner particle in the form of fine particles. In the case that an existence of the wax in the toner particle is not confirmed at a magnification of 10,000 in the TEM picture, on the other hand, the wax may be finely dispersed in the toner particle, but the wax does not sufficiently ooze from the toner particle at the time of fixing.

The wax is not particularly limited, and can be appropriately selected in accordance with a purpose, provided that the wax has an aliphatic hydrocarbon chain in the polymeric structure thereof. The aliphatic hydrocarbon chain is not particularly limited and can be appropriately selected in accordance with a purpose. Suitably examples are a hydrocarbon chain containing ethylene therein, and the like.

Examples of the wax are a carbonyl group-containing wax, polyolefin wax, long-chain hydrocarbon, and the like. Each of these can be employed alone or in combination of two or more. Of these examples, the carbonyl group-containing wax is preferable.

Examples of the carbonyl group-containing wax are polyalkanoic ester, polyalkanol ester, polyalkanoic acid amide, polyalkyl amide, dialkyl ketone, and the like. Examples of the polyalkanoic ester are carnauba wax, montan wax, trimethylolpropane tribehenate, pentaerythritol tetrabehenate, pentaerythritol diacetate dibehenate, glycerin tribehenate, octadecan-1,18-diol distearate, and the like. Examples of the polyalkanol ester are trimellitic tristearate, distearyl maleate, and the like. Examples of the polyalkanoic acid amide are behenyl amide and the like. Examples of the polyalkyl amide are trimellitic acid tristearyl amide, and the like. Examples of the dialkyl ketone are distearyl ketone, and the like. Of these carbonyl group-containing wax, the polyalkanoic ester is particularly preferable.

Examples of the polyolefin wax are polyethylene wax, polypropylene wax, and the like.

Examples of the long-chain hydrocarbon are paraffin wax, Sasol Wax, and the like.

A melting point of the wax is not particularly limited, and can be appropriately selected in accordance with a purpose. It is 40° C. to 160° C., preferably 50° C. to 120° C., and more preferably 60° C. to 90° C.

In the case that the melting point is less than 40° C., it adversely affects heat-resistance preservation of the wax. In the case that the melting point is more than 160° C., it is liable to cause cold offset at a relatively low temperature at the time of fixing.

A melt viscosity of the wax is preferably 5 cps to 1,000 cps, and more preferably 10 cps to 100 cps by a measurement at a temperature of 20° C. higher than the melting point of the wax.

In the case that the melt viscosity is less than 5 cps, a releasing ability is liable to be insufficient. In the case that the melt viscosity is more than 1,000 cps, on the other hand, it may not improve hot-offset resistance, and low-temperature fixing property.

To control the wax content in the surface section of the toner (the aforementioned intensity ratio ($P_{2850}/P_{828}$) and a mass ratio of the wax located in the surface section and the total amount of the wax), any method may be applied. However, it is preferred that the wax is contained together with "vinyl-modified polymer" described below to control the wax content. On the purpose of controlling the amount of the wax, it is important to control the mixing mass ratio of the vinyl-modified polymer Y and the wax W. The mixing mass ratio Y/W is preferably 0.4 to 3.0.

In the case that the mixing mass ratio is less than 0.4, the wax is excessively located on the surface or in the surface section of the toner and thus filming or carrier spent may occur. Therefore, it is insufficient in the resistance when such toner is used as a developer.

In the case that the mixing mass ratio is more than 3.0, all or most of the wax is located in the inner section of the toner in the formed dispersed particles, but such dispersed particles have very small particle diameters so that the sufficient releasing effects cannot be exhibited at the time of fixing.

-Vinyl-Modified Polymer-

The vinyl-modified polyester is a wax which is modified with a vinyl monomer having an average ester-group concentration of 8% by mass to 30% by mass at least at a part thereof. Specifically, the vinyl-modified polyester is formed of a principle chain of a wax component, and side chains (graft chains) of vinyl polymer. The vinyl polymer as a side chain contains a vinyl monomer component comprising an ester group, and the average ester-group concentration is 8% by mass to 30% by mass in the side chain.

The wax component of the vinyl-modified polyester has a melting point of 80° C. to 170° C., and preferably 90° C. to 160° C. The number average molecular mass (Mn) of the wax component is 500 to 2,000, and preferably 1,000 to 15,000. The mass average molecular mass (Mw) of the wax component is 800 to 100,000, and preferably 1,500 to 60,000. The ratio Mw/Mn is 1.1 to 7.0, and preferably 1.3 to 4.0.

The average ester group concentration of the side chain is 8% by mass to 30% by mass, and preferably 10% by mass to 25% by mass.

The vinyl-modified polymer has a number average molecular mass (Mn) of 1,500 to 100,000, and preferably 2,800 to 20,000. The mass average molecular mass (Mw) of the vinyl-modified polymer is 60,000 to 100,000, and preferably 70,000 to 50,000. The ratio Mw/Mn is 1.1 to 40.0, and preferably 3.0 to 30.0. Moreover, the vinyl-modified polymer has a glass transition temperature of 40° C. to 90° C., preferably 50° C. to 70° C., and a melting point of 80° C. to 150° C., preferably 90° C. to 130° C.

-Polyester Resin Containing Aromatic Ring-

The aforementioned polyester resin containing an aromatic ring is not particularly limited and can be appropriately selected in accordance with a purpose, provided that the polyester resin contains at least one aromatic resin in the polymeric structure thereof. A suitable example of such polyester resin is an adhesive base material.

The adhesive base material exhibits adhesion to a recording medium such as a paper, and comprises an adhesive polymer resulted from a reaction, in an aqueous medium, of the active hydrogen group-containing compound and a polymer capable of reacting the active hydrogen group-containing compound. The adhesive base material may further comprise a binder resin appropriately selected from the conventional binder resins.

A mass average molecular mass of the adhesive base material is not particularly limited and can be appropriately adjusted in accordance with a purpose. It is 1,000 or more, preferably 2,000 to 10,000,000, and more preferably 3,000 to 1,000,000.

In the case that the mass average molecular mass of the adhesive base material is less than 1,000, it is liable to adversely affect on offset resistance.

A glass transition temperature (Tg) of the adhesive base material is not particularly limited and can be appropriately adjusted in accordance with a purpose. It is 30° C. to 70° C., and preferably 40° C. to 65° C. Since the adhesive base material is contained in the toner together with the polyester resin which is crosslinked, and elongation reacted, the toner has a desirable heat resistance preservation even having the lower glass transition temperature than that of the conventional polyester toners.

In the case that the glass transition temperature of the adhesive base material is less than 30° C., it is liable to adversely affect on a heat resistance preservation of the toner. In the case that the glass transition temperature of the adhesive base material is more than 70° C., low-temperature fixing properties of the toner is liable to be insufficient.

The glass transition temperature is measured, for example, by means of TG-DSC/TAS-100 system (manufactured by Rigaku Corp.). A specific method is explained hereinafter.

About 10 mg of a toner sample is charged in a sample container formed of aluminum; the sample container is placed on a holder unit; the holder unit is set in an electric oven. The temperature therein is increased from an ambient temperature to 150° C. at 10° C./min.; the temperature is kept at 150° C. for 10 minutes; the sample toner is then cooled down to an ambient temperature and left to stand for 10 minutes. The sample toner is then heated up to 150° C. at 10° C./min under $N_2$ atmosphere; a DSC spectrum of the sample toner is measured by a differential scanning calorimeter. The glass transition temperature is calculated, by means of TG-DSC/TAS-100 system, based on a contact point of a tangent line of the endothermic curve nearby a glass transition temperature and a base line.

Storage modulus of the adhesive base material is not particularly limited and can be appropriately adjusted in accordance with a purpose. For example, the temperature (TG') for achieving 10,000 dyne/cm$^2$ at frequency of 20 Hz is 100° C. or more, and preferably 100° C. to 200° C.

In the case that the temperature (TG') is less than 100° C., it is liable to adversely affect on offset resistance of the toner.

A viscosity of the adhesive base material is not particularly limited and can be appropriately adjusted in accordance with a purpose. For example, the temperature (Tη) for achieving 1,000 poise (100 $Nm^{-2}$) at frequency of 20 Hz is 180° C. or less, and preferably 90° C. to 160° C.

In the case that the temperature (Tη) is more than 180° C., it is liable to adversely affect on low-temperature fixing properties of the toner.

From the view point of achieving both offset resistance and low-temperature fixing properties, therefore, it is preferable that the temperature (TG') is higher than the temperature (Tη. Namely, a difference from the temperature (TG') to the temperature (Tη), i.e., (TG'−Tη), is preferably 0° C. or more, more preferably 10° C. or more, and further preferably 20° C. or more. The larger the difference is more preferred.

From the view point of achieving both low-temperature fixing properties and heat resistance preservation, the aforementioned difference (TG'−Tη) is 0° C. to 100° C., preferably 10° C. to 90° C., and more preferably 20° C. to 80° C.

Specific examples of the adhesive base material are particularly limited and can be appropriately selected in accordance with a purpose. Suitable examples thereof are a polyester resin, and the like.

The polyester resin is not particularly limited and can be selected in accordance with a purpose. Suitable examples thereof are urea-modified polyester and the like.

The urea modified polyester which is obtained by a reaction between (B) amines as the active hydrogen group-containing compound, and (A) a polyester prepolymer having an isocyanate group as the polymer capable of reacting with the active hydrogen group-containing compound.

In addition, the urea modified polyester may include a urethane bond as well as a urea bond. A molar ratio of the urea bond content to the urethane bond content is preferably 100/0 to 10/90, more preferably 80/20 to 20/80, and further more preferably 60/40 to 30/70. In the case that a molar ratio of the urea bond is less than 10%, it is liable to adversely affects on hot-offset resistance.

Specific examples of the urea-modified polyester are preferably the following (1)-(10):

(1) A mixture of (i) polycondensation product of bisphenol A ethyleneoxide dimole adduct and isophthalic acid, and (ii) urea-modified polyester prepolymer which is obtained by reacting isophorone disocyanate with a polycondensation product of bisphenol A ethyleneoxide dimole adduct and isophtalic acid so as to form polyester prepolymer, and modifying the polyester prepolymer with isophorone diamine;

(2) A mixture of (iii) a polycondensation product of bisphenol A ethyleneoxide dimole adduct and terephthalic acid, and (ii) urea-modified polyester prepolymer which is obtained by reacting isophorone disocyanate with a polycondensation product of bisphenol A ethyleneoxide dimole adduct and terephthalic acid so as to form polyester prepolymer, and modifying the polyester prepolymer with isophorone diamine;

(3) A mixture of (iv) polycondensation product of a bisphenol A ethyleneoxide dimole adduct, a bisphenol A propyleneoxide dimole adduct and terephthalic acid, and (v) urea-modified polyester prepolymer which is obtained by reacting isophorone disocyanate with a polycondensation product of a bisphenol A ethyleneoxide dimole adduct, a bisphenol A propyleneoxide dimole adduct and terephthalic acid so as to form polyester prepolymer, and modifying the polyester prepolymer with isophorone diamine;

(4) A mixture of (vi) polycondensation product of a bisphenol A propyleneoxide dimole adduct and terephthalic acid, and (v) urea-modified polyester prepolymer which is obtained by reacting isophorone disocyanate with a polycondensation product of a bisphenol A ethyleneoxide dimole adduct, a bisphenol A propyleneoxide dimole adduct and terephthalic acid so as to form polyester prepolymer, and modifying the polyester prepolymer with isophorone diamine;

(5) A mixture of (iii) polycondensation product of a bisphenol A ethyleneoxide dimole adduct and terephthalic acid, and (vi) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with hexamethylene diamine;

(6) A mixture of (iv) polycondensation product of a bisphenol A ethyleneoxide dimole adduct, a bisphenol A propyleneoxide dimole adduct and terephthalic acid, and (vi) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with hexamethylene diamine;

(7) A mixture of (iii) polycondensation product of a bisphenol A ethyleneoxide dimole adduct and terephthalic acid, and (vii) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with ethylene diamine;

(8) A mixture of (i) polycondensation product of a bisphenol A ethyleneoxide dimole adduct and isophthalic acid, and (viii) urea-modified polyester prepolymer which is obtained by reacting diphenylmethane disocyanate with a polycondensation product of a bisphenol A ethyleneoxide dimole adduct and isophthalic acid so as to form polyester prepolymer, and modifying the polyester prepolymer with hexamethylene diamine;

(9) A mixture of (iv) polycondensation product of a bisphenol A ethyleneoxide dimole adduct, a bisphenol A propyleneoxide dimole adduct and terephthalic acid, and (ix) urea-modified polyester prepolymer which is obtained by reacting diphenylmethane disocyanate with a polycondensation product of a bisphenol A ethyleneoxide dimole adduct/bisphenol A propyleneoxide dimole adduct and terephthalic acid/dodecenylsuccinic anhydride so as to form polyester prepolymer, and modifying the polyester prepolymer with hexamethane diamine;

(10) A mixture of (i) polycondensation product of a bisphenol A ethyleneoxide dimole adduct and isophthalic acid, and (x) urea-modified polyester prepolymer which is obtained by reacting toluene disocyanate with a polycondensation product of a bisphenol A ethyleneoxide dimole adduct and isophthalic acid so as to form polyester prepolymer, and modifying the polyester prepolymer with hexamethane diamine.

-Active Hydrogen Group-Containing Compound-

The active hydrogen group-containing compound functions as an elongation initiator or crosslinking agent at the time of elongation reactions or crosslinking reactions of the active hydrogen group-containing compound and the polymer capable of reacting with the compound in an aqueous medium.

The active hydrogen group-containing compound is not particularly limited, provided that it contains an active hydrogen group, and can be appropriately selected in accordance with a purpose. In the case that the polymer capable of reacting with the active hydrogen group-containing compound is (A) a polyester prepolymer containing an isocyanate group, the active hydrogen group-containing compound is preferably selected from (B) amines in view of capability of high molecular mass polymerization resulted from elongation reaction, crosslinking reaction, and the like.

Within the active hydrogen group-containing compound, the active hydrogen group is not particularly limited, and can be appropriately selected in accordance with a purpose. Examples of the active hydrogen group are hydroxyl groups such as an alcoholic hydroxyl group, a phenolic hydroxyl group, and the like, amino groups, carboxyl groups, mercapto groups, and the like, which can be used singly, or in combination of two or more thereof. Of these, the alcoholic hydroxyl group is particularly preferable.

The (B) amines are not particularly limited, and can be appropriately selected in accordance with a purpose. Examples of (B) amines are (B1) a divalent amine compound, (B2) a trivalent or more polyvalent amine compound, (B3) an aminoalcohol, (B4) an amino mercaptan, (B5) an amino acid, and (B6) a compound in which the amino group of B1 to B5 is blocked. Theses can be used singly, or in combination of two or more. Of these amines, the (B1) divalent amine compound, and a mixture of (B1) divalent amine compound and (B2) trivalent or more polyvalent amine compound are particularly preferable.

Examples of the (B1) divalent amine compound are: an aromatic diamine such as phenylene diamine, diethyl toluene diamine, 4,4'-diamino diphenyl methane; an alicyclic diamine such as 4,4'-diamino-3,3'-dimethyl dicyclohexyl methane, diamine cyclohexane, and isophorone diamine; and an aliphatic diamine such as ethylene diamine, tetramethylene diamine, and hexamethylene diamine.

Examples of the (B2) trivalent or more polyvalent amine compound are diethylene triamine, triethylene tetramine, and the like.

Examples of the (B3) aminoalcohol are ethanol amine, hydroxyethylaniline, and the like.

Examples of the (B4) amino mercaptan are aminoethyl mercaptan, aminopropyl mercaptan, and the like.

Examples of the (B5) amino acid are aminopropionic acid, aminocaproic acid, and the like.

Examples of the (B6) compound in which the amino group of B1 to B5 is blocked are: a ketimine compound obtained from the above-noted amines of B1 to B5 and ketones such as acetone, methyl ethyl ketone, and mehyl isobuthyl ketone; oxazolidine compound; and the like.

In order to stop cross-linking and/or elongation reactions of the active hydrogen group-containing compound and the polymer capable of reacting with the active hydrogen group-containing compound, a reaction stopper may be used as required to control the relative molecular mass of the adhesive base material to be obtained. Examples of the reaction stopper are: a monoamine such as diethyl amine, dibutyl amine, buthyl amine, and lauryl amine; a compound in which the above-noted elements are blocked such as a ketimine compound; and the like.

A mixing ratio of (B) amines and (A) a polyester prepolymer having isocyanate group, defined as an equivalent ratio [NCO]/[NHx] of isocyanate group [NCO] in (A) a polyester prepolymer having isocyanate group to amine group [NHx] in (B) amines, is 1/3 to 3/1, preferably 1/2 to 2/1, and more preferably 1/1.5 to 1.5/1. When [NCO]/[NHx] is less than 1/3, the low-temperature fixing properties are degraded. When [NCO]/[NHx] is more than 3/1, on the other hand, the relative molecular mass of the urea-modified polyester becomes low, thereby degrading hot-offset resistance.

-Polymer Capable of Reacting with Active Hydrogen Group-Containing Compound-

The polymer capable of reacting with the active hydrogen group-containing compound, which may be simply referred to "a prepolymer", is not particularly limited, provided that it has a moiety capable of reacting with the active hydrogen group-containing compound, and can be appropriately selected in accordance with a purpose. Examples of the prepolymer are a polyol resin, a polyacrylic resin, a polyester resin, an epoxy resin, a modified resin thereof, and the like. Theses can be selected singly, or in combination of two or more. Of these examples, the polyester resin is particularly preferable in view of high flowability at the time of melting, and transparency.

The moiety capable of reacting with the active hydrogen group-containing compound is not particularly limited, and can be appropriately selected from the known substituents. Examples of such moiety are an isocyanate group, an epoxy group, a carboxyl group, an acid chloride group, and the like. These may be selected singly or in combination of two or more. Of these examples, the isocyanate group is particularly preferable.

The prepolymer is particularly preferably a polyester resin containing a group capable of generating urea bonding (RMPE) in view of controllability of the relative molecular mass of high molecular substance, oil-less and low-temperature fixing properties of a dry toner, especially suitable releasing and fixing properties without a releasing oil applicator for a heating member for fixing.

Example of the group capable of generating urea bonding are isocyanate group, and the like. In the case that the group capable of generating urea bonding in the polyester resin (RMPE) is the isocyanate group, the polyester resin (RMPE) is particularly preferably (A) a polyester prepolymer having an isocyanate group.

The (A) polyester prepolymer having an isocyanate group is not particularly limited, and can be selected in accordance with a purpose. Examples of the (A) polyester prepolymer having an isocyanate group are a polycondensation polyester of polyol (PO) and a polycarboxylic acid (PC), a reactant of the active hydrogen group-containing group and polyisocyanate (PIC), and the like.

The polyol (PO) is not particularly limited, and can be appropriately selected in accordance with a purpose.

Examples of the polyol (PO) are diol (DIO), trivalent or more polyhydric alcohol (TO), and a mixture of diol (DIO) and trivalent or more polyhydric alcohol (TO), and the like. These can be selected singly, or in combination of two or more. Of these examples, the diol (DIO) per se, or a mixture of the diol (DIO) and a little amount of the trivalent or more polyhydric alcohol (TIO) are preferably.

Examples of the diol (DIO) are alkylene glycol, alkylene ether glycol, alicyclic diol, alkylene oxide adduct of alicyclic diol, bisphenol, alkylene oxide adduct of bisphenol, and the like.

Examples of the alkylene glycol are alkylene glycol having 2 to 12 carbon atoms such as ethylene glycol, 1,2-propylene glycol, 1,3-propylene glycol, bytane-1,4-diol, hexane-1,6-diol and the like.

Examples of the alkylene ether glycol are diethylene glycol, triethylene glycol, dipropylene glycol, polyethylene glycol, polypropylene glycol, polytetramethylene ether glycol, and the like.

Examples of the alicyclic diol are cyclohexane-1,4-dimethanol, hydrogenated bisphenol A, and the like.

Examples of the alkylene oxide adduct of alicyclic diol are alicyclic diol selected from the above-listed alicyclic diols, adducted with alkylene oxide such as ethylene oxide, propylene oxide, butylene oxide, and the like.

Examples of the bisphenol are bisphenol A, bisphenol F, bisphenol S, and the like.

Examples of the alkylene oxide adduct of bisphenol are bisphenol selected from the above-listed bisphenols adducted with alkylene oxide such as ethylene oxide, propylene oxide, butylene oxide, and the like.

Of these examples, alkylene glycol having 2-12 carbon atoms, and alkylene oxide adduct of bisphenol are preferable, and alkylene oxide adduct of bisphenol, and a mixture of alkylene oxide adduct of bisphenol and alkylene glycol having 2-12 carbon atoms are particularly preferable.

The trivalent or more polyhydric alcohol (TO) is preferably polyhydric alcohol having a valency of 3 to 8, and/or a valency of 8 or more. Examples of such trivalent or more polyhydric alcohol (TO) are trivalent or more polyhydric aliphatic alcohol, trivalent or more polyphenol, alkylene oxide adduct of trivalent or more polyphenol, and the like.

Examples of the trivalent or more polyhydric aliphatic alcohol are glycerin, trimethylol ethane, trimethylol propane, pentaerythritol, sorbitol, and the like.

Examples of the trivalent or more polyphenol are trisphenol PA, phenol novolac, cresol novolac, and the like.

Examples of the alkylene oxide adduct of trivalent or more polyphenol are the above-listed trivalent or more polyphenol adducted with alkylene oxide such as ethylene oxide, propylene oxide, butylene oxide, and the like.

In the mixture of the diol (DIO) and the trivalent or more polyhydric alcohol (TO), a mass ratio (DIO:TO) of the diol to the trivalent or more polyhydric alcohol is 100:0.01-10, and preferably 100:0.01-1.

The polycarboxylic acid (PC) is not particularly limited, and can be appropriately selected in accordance with a purpose. Examples of the polycarboxylic acid (PC) are dicarboxylic acid (DIC), trivalent or more polycarboxylic acid (TC), a mixture of dicarboxylic acid (DIC) and trivalent or more polycarboxylic acid (TC), and the like. These can be selected singly, or in combination of two or more. Among these example, dicarboxylic acid (DIC) alone or a mixture of dicarboxylic acid (DIC) and the little amount of trivalent or more polycarboxylic acid (TC) is preferable.

Examples of the dicarboxylic acid are alkylene dicarboxylic acid, alkenylene dicarboxylic acid, aromatic dicarboxylic acid, and the like.

Examples of the alkylene dicarboxylic acid are succinic acid, adipic acid, sebacic acid, and the like.

Examples of the alkenylene dicarboxylic acid are alkenylene dicarboxylic acid having 4-20 carbon atoms, such as maleic acid, fumaric acid, and the like.

Examples of the aromatic dicarboxylic acid are aromatic dicarboxylic acids having 8-20 carbon atoms such as phthalic acid, isophthalic acid, terephthalic acid, naphthalene dicarboxylic acid, and the like.

Among these examples, alkenylene dicarboxylic acid having 4-20 carbon atoms, and aromatic dicarboxylic acid having 8-20 carbon atoms are preferable.

Examples of the trivalent or more polycarboxylic acid (TC) are trivalent or more polycarboxylic acid having 3-8 carbon atoms, and/or trivalent or more polycarboxylic acid having 8 or more carbon atoms, such as aromatic polycarboxylic acid.

Examples of the aromatic polycarboxylic acid are aromatic polycarboxylic acids having 9-20 carbon atoms such as trimellitic acid, pyromellitic acid, and the like.

The polycarboxylic acid (PC) may also be an acid anhydride or lower alkyl ester of one selected from the above-listed dicarboxylic acid (DIC), the above-listed trivalent or more polycarboxylic acid (TC), the above-listed mixture of dicarboxylic acid (DIC) and trivalent or more polycarboxylic acid (TC). Examples of the lower alkyl ester are methyl ester, ethyl ester, isopropyl ester, and the like.

In the mixture of dicarboxylic acid (DIC) and trivalent or more polycarboxylic acid (TC), a mass ratio (DIC:TC) of the dicarboxylic acid (DIC) to the trivalent or more polycarboxylic acid (TC) can be appropriately adjusted in accordance with a purpose without any limitation, and, for example, is preferably 100:0.1-10, preferably 100:0.01-1.

At the time of subjecting the polyol (PO) and the polycarboxylic acid (PC) polymerization condensation reaction, a mixing ratio thereof is not particularly limited, and can be selected in accordance with a purpose.

For example, a mixing ratio of the polyol (PO) to polyvalent carboxylic acid (PC), defined as an equivalent ratio [OH]/[COOH] of a hydroxyl group [OH] to a carboxyl group [COOH], is 2/1 to 1/1, preferably 1.5/1 to 1/1, and more preferably 1.3/1 to 1.02/1.

The polyol (PO) content of the (A) polyester prepolymer having an isocyanate group is not particularly, and can be adjusted in accordance with a purpose. Such content is, for example, 0.5% by mass to 40% by mass, preferably 1% by mass to 30% by mass, and more preferably 2% by mass to 20% by mass.

In the case that the polyol (PO) content is less than 0.5% by mass, offset resistance becomes degraded, thereby being difficult to realize both heat resistance preservation and low-temperature fixing properties. In the case that the polyol (PO) content is more than 40% by mass, low-temperature fixing properties may become degraded.

The aforementioned polyvalent isocyanate (PIC) is not particularly limited, and can be appropriately selected in accordance with a purpose. Examples of the polyvalent isocyanate (PIC) are aliphatic polyvalent isocyanate, alicyclic polyvalent isocyanate, aromatic diisocyanate, aromatic aliphatic diisocyanate, isocyanurate, phenol derivative thereof, blocked products thereof with such as oxime, caprolactam, and the like.

Examples of the aliphatic polyvalent isocyanate are tetramethylen diisocyanate, hexamethylen diisocyanate, 2,6-diisocyanate methyl caproate, octamethylene diisocyanate, decamethylene diisocianate, dodecamethylene diisocyanate, tetradecamethylene diisocyanate, trimethyl hexane diisocyanate, tetramethyl hexane diisocyanate, and the like.

Examples of the alicyclic polyvalent isocyanate are isophorone diisocyanate, cyclohexylmethane diisocyanate, and the like.

Examples of aromatic diisocyanate are tolylene diisocyanate, diphenylmethane diisocyanate, 1,5-naphthylene diisocyanate, diphenylene-4,4'-diisocyanate, 4,4'-diisocyanato-3,3'-dimethyl diphenyl, 3-methyldiphenyl methane-4,4'-diisocyanate, diphenylether-4,4'-diisocyanate, and the like.

Examples of the aromatic aliphatic diisocyanate are $\alpha,\alpha,\alpha',\alpha'$-tetramethyl xylylene diisocyanate, and the like.

Examples of the isocyanurate are tris-isocyanatoalkyl-isocyanurate, triisocyanatocycroalkyl-isocyanurate, and the like.

These can be selected singly or in combination of two or more.

At the time of reacting the polyvalent isocyanate (PIC) and the active hydrogen group-containing polyester such as hydrogen group-containing polyester, a mixing ratio which is defined as an equivalent ratio [NCO]/[OH] of an isocyanate group [NCO] to a hydroxyl group [OH] of the hydroxyl group-containing polyester, is 5/1 to 1/1, preferably 4/1 to 1.2/1, and more preferably 3/1 to 1.5/1. In the case that the molar ratio of [NCO] in the ratio is more than 5, it is liable to degrade low-temperature fixing properties. In the case that the molar ratio of [NCO] is less than 1, it is liable to degrade offset resistance.

The polyvalent isocyanate (PIC) content of the (A) polyester prepolymer having an isocyanate group is 0.5% by mass to 40% by mass, preferably 1% by mass to 30% by mass, and more preferably 2% mass to 20% by mass. In the case that the content is less than 0.5% by mass, it is liable to degrade offset resistance. In the case that the content is more than 40% by mass, it is liable to degrade low-temperature fixing properties.

The average number of isocyanate groups contained in the (A) polyester prepolymer containing an isocyanate group is 1 or more per molecule of the (A) polyester prepolymer, preferably 1.2 to 5 per molecule, and more preferably 1.5 to 4 per molecule. In the case that the average number of isocyanate groups is less than 1 per molecule, the relative molecular mass of the urea modified polyester becomes low which makes hot-offset resistance poor.

The mass average molecular mass of the polymer capable of reacting with the active hydrogen group-containing compound is 1,000 to 30,000, and preferably 1,500 to 15,000, in terms of a relative molecular mass distribution of a tetrahydrofuran (THF) soluble part measured by means of gel permeation chromatography (GPC).

In the case that the mass average molecular mass (Mw) is less than 1,000, it is liable to degrade heat resistance preservation. In the case that mass average molecular mass (Mw) is more than 30,000, it is liable to degrade low-temperature fixing properties.

The measurement of relative molecular mass distribution by means of the gel permeation chromatography (GPC) can be carried out by the following manner.

At first, a column is set and secured in a heat chamber at the interior temperature of 40° C. While maintaining the same interior temperature, tetrahydrofuran (THF) as a column solvent is flown into the column at the flow velocity of 1 ml/min. To this flow, there is introduced 50 μl to 200 μl of a tetrahydrofuran solution of a resin sample wherein the resin sample concentration is adjusted to 0.05% by mass to 0.6% by mass. The resin sample is then measured. In the measurement, the relative molecular mass distribution of the resin sample is calculated from the relationship between the logarithm values of calibration curve prepared from plurality of singly dispersed standard-polystyrene samples, and the counting number. The standard-polyester samples for calibration are, for example, standard polyester samples each respectively having a relative molecular mass of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, all of which are commercially available from Pressure Chemical Co. or Toyo Soda Co. Ltd., and are preferably about 10 standard polyester samples. Note that a refractive index (RI) detector can be used as a detector in the above measurements.

-Aqueous Medium-

The aqueous medium is not particularly limited, and can be appropriately selected in accordance with a purpose. Examples of the aqueous medium are water, a solvent compatible with water, a mixture thereof, and the like.

Examples of the solvent compatible with water are alcohol, dimethyl formamide, tetrahydrofuran, Cellosolve, lower ketone, and the like.

Examples of the alcohol are methanol, isopropanol, ethylene glycol and the like. Examples of the Cellosolve (i.e., 2-ethoxyethanol) are methyl Cellosolve (i.e., 2-methoxyethanol), and the like. Examples of the lower ketone are acetone, methylethylketone, and the like. These can be selected singly or in combination of two or more.

-Binder Resin-

The binder resin is not particularly limited, and can be appropriately selected in accordance with a purpose. Examples of the binder resin are polyester and the like. Of these examples, unmodified polyester (polyester which is not modified) is particularly preferable.

By containing the unmodified polyester in the toner, the toner can realize improved low-temperature fixing properties and glossiness.

Examples of the unmodified polyester are a resin equivalent to the aforementioned polyester resin containing a group capable of generating urea bonding (RMPE), i.e., polycondensation product of polyol (PO) and polycarboxylic acid (PC), and the like. The unmodified polyester is preferably compatible with the polyester resin containing a group capable of generating urea bonding (RMPE) at part thereof, i.e., having a similar polymeric structure which allow to be compatible, in view of low-temperature fixing properties and hot-offset resistance.

The mass average molecular mass (Mw) of the non-polyester is 1,000 to 30,000, and preferably 1,500 to 15,000, in terms of a relative molecular mass distribution of a tetrahydrofuran (THF) soluble part measured by means of gel permeation chromatography (GPC).

In the case that the mass average molecular mass (Mw) is less than 1,000, it is liable to degrade heat resistance preservation. Therefore, the amount of the unmodified polyester having a mass average molecular mass is 8% by mass to 28% by mass. In the case that mass average molecular mass (Mw) is more than 30,000, it is liable to degrade low-temperature fixing properties.

The glass transition temperature of the unmodified polyester is 30° C. to 70° C., preferably 35° C. to 70° C., and more preferably 35° C. to 50° C., and further more preferably 35° C. to 45° C. In the case that the glass transition temperature is lower than 30° C., it is liable to degrade heat resistance preservation of the toner. In the case that the glass transition temperature is higher than 70° C., it is liable to degrade lower-temperature fixing properties.

The hydroxyl value of the unmodified polyester is 5 mg KOH/g or more, preferably 10 mg KOH/g to 120 mg KOH/g, and more preferably 20 mg KOH/g to 120 mg KOH/g. In the case that the hydroxyl value of less than 5 mg KOH/g, it becomes difficult to achieve both heat resistance preservation and low-temperature fixing properties.

The acid value of the unmodified polyester is 1.0 mg KOH/g to 50.0 mg KOH/g, preferably 1.0 mg KOH/g to 30.0 mg KOH/g, and more preferably 5.0 mg KOH/g to 20.0 mg KOH/g. By imparting the acid value to the toner, the toner is generally liable to be negatively chargeable.

When the unmodified polyester is contained in the toner, a mass ratio (RMPE/PE) of the urea-modified polyester (RMPE) to the unmodified polyester (PE) is 5/95 to 25/75, and preferably 10/90 to 25/75.

In the case that the mass ratio of the unmodified polyester (PE) is more than 95, it is liable to degrade offset resistance. In the case that the mass ratio of the unmodified polyester is less than 25, it is liable to degrade glossiness.

The unmodified polyester content of the binder resin is 50% by mass to 100% by mass, preferably 70% by mass to 95% by mass, and more preferably 80% by mass to 90% by mass. In the case that the unmodified polyester content is less than 50% by mass, it is liable to degrade low-temperature fixing properties and glossiness of the image.

-Other Components-

The other components are not particularly limited, and can be appropriately selected in accordance with a purpose. The other components to be contained are, for example, a colorant, a charge controlling agent, fine resin particles, a flowability improver, a cleaning improver, a magnetic material, metal soap, and the like.

The colorant is not particularly limited, and can be appropriately selected in accordance with a purpose.

Examples of the colorant are carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasane yellow BGL, isoindolinon yellow, colcothar, red lead, lead vermilion, cadmium red, cadmium mercury red, antimony vermilion, permanent red 4R, para red, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and the like. Theses can be selected singly or in combination of two or more.

The colorant content of the toner is not particularly limited, and can be appropriately adjusted in accordance with a purpose. The colorant content is preferably 1% by mass to 15% by mass, and more preferably 3% by mass to 10% by mass.

In the case that the colorant content is less than 1% by mass, it is liable to lower tinting strength of the toner. In the case that the colorant content is more than 15% by mass, it is liable to adversely affect the dispersibility of the colorant in the toner particles, which results in lowering tinting strength and charging ability of the toner.

The colorant may be used as a master batch compounded with a resin.

The resin for use is not particularly limited, and can be appropriately selected in accordance with a purpose. Examples of the binder resin in the master batch are styrene or substituted polymer thereof, styrene copolymer, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate, rosin, modified rosin, terpene resin, aliphatic hydrocarbon resin, alicyclic hydrocarbon resin, aromatic petroleum resin, chlorinated paraffin, paraffin, and the like. These can be selected singly, or in combination of two or more.

Examples of the styrene or substituted polymer thereof are polyester, polystyrene, poly-p-chlorostyrene, polyvinyl toluene, and the like. Examples of the styrene copolymer are styrene-p-clorostyrene copolymer, styrene-propylene copolymer, styrene-vinyl toluene copolymer, styrene-vinyl naphthalene copolymer, styrene-methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-methyl-α-chloromethacylate copolymer, styrene-acrylonitril copolymer, styrene-vinylmethylketone copolymer, styrene-butadiene copolymer, styrene-isoprene copolymer, styrene-acrylonitrile-indene copolymer, styrene-maleic acid copolymer, styrene-maleic ester copolymer, and the like.

The master batch is prepared, for example, by mixing or kneading the resin for the master batch and the colorant at high shear force. During this process, it is preferable to add an organic solvent so as to enforce interaction between the colorant and the resin. In addition, flashing method is also preferable for preparing the master batch since the pigment can be employed in the form of wetcake without drying. In the flashing method, an aqueous paste of the pigment and water is mixed or kneaded together with the resin and the organic solvent, the colorant is gradually transferred into the resin, and then the water and organic solvent are removed. For the aforementioned fixing or kneading, high shear force dispersing device, such as three-roller mills and the like are suitably used.

The charge controlling agent is not particularly limited, and can be appropriately selected from conventionally available ones in accordance with a purpose. The charge controlling agent is preferably formed of a material having a color close to transparent and/or white, as a colored charge controlling agent may change or adversely affect on the color toner of the toner.

Examples of the charge controlling agent are triphenylmethane dye, molybdic acid chelate pigment, rhodamine dye, alkoxy amine, quaternary ammonium salt such as fluoride-modified quaternary ammonium salt, alkylamide, phosphoric simple substance or compound thereof, tungsten itself or compound thereof, fluoride activator, salicylic acid metallic salt, salicylic acid derivative metallic salt, and the like. These can be selected singly or in combination of two or more.

The charge controlling agent for use in the present invention is also selected from the commercially available products. Specifically examples thereof are: Bontron P-51 of a quaternary ammonium salt, Bontron E-82 of an oxynaphthoic acid metal complex, Bontron E-84 of a salicylic acid metal complex, and Bontron E-89 of a phenol condensate (by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.), quinacridone, azo pigment, and other high-molecular mass compounds having a functional group, such as sulfonic acid group, carboxyl group, and quaternary ammonium salt, and the like.

The charge controlling agent may be dissolved and/or dispersed in the toner material after kneading with the master batch. The charge controlling agent may also be added at the time of dissolving and dispersing in the organic solvent together with the toner material. In addition, the charge controlling agent may be added onto the surface of the toner particles after preparing the toner particles.

The usage amount of the charge controlling agent is determined depending on the type of a binder resin, presence or absence of an additive to be used as required, and the method for manufacturing a toner including a dispersion process and is not limited uniformly; preferably, to 100 parts by mass of binder resin, 0.1 part by mass to 10 parts by mass of the charge controlling agent is used and more preferably with 0.2 part by mass to 5 part by mass of the charge controlling agent. In the case that the usage amount is less than 0.1 parts by mass, charge may not be appropriately controlled. In the case that the charge controlling agent is more than 10 parts by mass, charge ability of the toner become exceedingly large, which lessens the effect of the charge controlling agent itself and increases in electrostatic attraction force with a developing roller, and causes degradations of developer fluidity and image density.

The fine resin particles are not particularly limited, and the material thereof can be appropriately selected from the conventional resin in accordance with a purpose, provided that the resin capable of forming aqueous dispersion in the aqueous medium. The fine resin particles may be formed of thermoplastic resin or thermosetting resin.

Examples of the material of the fine resin particles are vinyl resin, polyurethane resin, epoxy resin, polyester resin, polyamide resin, polyimide resin, silicone resin, phenol resin, melamine resin, urea resin, anilline resin, ionomer resin, polycarbonate resin, and the like. These may be selected singly or in combination of two or more, for use as the fine resin particles. Among these examples, the fine resin particles are preferably formed of one selected from the vinyl resin, polyurethane resin, epoxy resin, and polyester resin in view of an easy formation of aqueous dispersion of fine and spherical resin particles.

The vinyl resin is a polymer in which vinyl monomer is mono- or co-polymerized. Examples of the vinyl resin are styrene-(meth)acrylic ester resin, styrene-butadiene copolymer, (meth)acrylic acid-acrylic ester copolymer, styrene-acrylonitrile copolymer, styrene-maleic anhydride copolymer, styrene-(meth)acrylic acid copolymer, and the like.

Moreover, the finer resin particles may be formed of copolymer containing a monomer having two or more unsaturated groups. The monomer having two or more unsaturated groups is not particularly limited, and can be selected in accordance with a purpose. Examples of such monomer are sodium salt of sulfuric acid ester of ethylene oxide adduct of methacrylic acid (Eleminol RS-30, by Sanyo Chemical Industries Co.), divinylbenzene, hexane-1,6-diol acrylate, and the like.

The fine resin particles are formed by polymerizing the above-listed monomers in accordance with a method appropriately selected from conventional methods. The fine resin particles are preferably obtained in the form of aqueous dispersion of the fine resin particles. Examples of preparation method of such aqueous dispersion are the following (1)-(8):

(1) a preparation method of aqueous dispersion of the fine resin particles, in which, in the case of the vinyl resin, a vinyl monomer as a starting material is polymerized by suspension-polymerization method, emulsification-polymerization method, seed polymerization method or dispersion-polymerization method;

(2) a preparation method of aqueous dispersion of the fine resin particles, in which, in the case of the polyaddition and/or condensation resin such as the polyester resin, the polyurethane resin, or the epoxy resin, a precursor (monomer, oligomer or the like) or solvent solution thereof is dispersed in an aqueous medium in the presence of a dispersing agent, and sequentially is heated or added with a curing agent so as to be cured, thereby obtaining the aqueous dispersion of the fine resin particles;

(3) a preparation method of aqueous dispersion of the fine resin particles, in which, in the case of the polyaddition and/or condensation resin such as the polyester resin, the polyurethane resin, or the epoxy resin, an arbitrary selected emulsifier is dissolved in a precursor (monomer, oligomer or the like) or solvent solution thereof (preferably being liquid, or being liquidized by heating), and then water is added thereto so that induce phase inversion emulsification is induced, thereby obtaining the aqueous dispersion of the fine resin particles;

(4) a preparation method of aqueous dispersion of the fine resin particles, in which a previously prepared resin by a polymerization method, which is any of addition polymerization, ring-opening polymerization, polyaddition, addition condensation or condensation polymerization, is pulverized by means of a pulverizing mill such as mechanical rotation-type, jet-type or the like, the thus obtained resin powder is classified to thereby obtain fine resin particles, and then the fine resin particles are dispersed in an aqueous medium in the presence of an arbitrary selected dispersing agent, thereby obtaining the aqueous dispersion of the fine resin particles;

(5) a preparation method of aqueous dispersion of the fine resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is sprayed in the form of mist to thereby obtain fine resin particles, and then the thus obtained fine resin particles are dispersed in an aqueous medium in the presence of an arbitrary selected dispersing agent, thereby obtaining the aqueous dispersion of the fine resin particles;

(6) a preparation method of aqueous dispersion of the fine resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is subjected to precipitation by adding with a poor solvent or cooling after heating and dissolving, the solvent is sequentially removed to thereby obtain fine resin particles, and then the thus obtained fine resin particles are dispersed in an aqueous medium in the presence of an arbitrary selected dispersing agent, thereby obtaining the aqueous dispersion of the fine resin particles;

(7) a preparation method of aqueous dispersion of the fine resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is dispersed in an aqueous medium in the presence of an arbitrary selected dispersing agent, and then the solvent is removed by heating or reduced pressure to thereby obtain the aqueous dispersion of the fine resin particles;

(8) a preparation method of aqueous dispersion of the fine resin particles, in which a previously prepared resin by a polymerization method, which is any of addition polymerization, ring-opening polymerization, polyaddition, addition condensation or condensation polymerization, is dissolved in a solvent to thereby obtain a resin solution, an arbitrary selected emulsifier is dissolved in the resin solution, and then water is added to the resin solution so that phase inversion emulsification is induced, thereby obtaining the aqueous dispersion of the fine resin particles.

The fine inorganic particles are not particularly limited, and can be appropriately selected from the conventional fine inorganic particles.

Suitable examples thereof are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, silicon nitride, and the like. These may be selected singly, or in combination of two or more.

The primary particle diameter of the fine inorganic particle is preferably 5 nm to 2 μm, and more preferably 5 nm to 500 nm. The specific surface of the fine inorganic particle is preferably 20 $m^2/g$ to 500 $m^2/g$ according to BET method.

The fine inorganic particle content of the toner is preferably 0.01% by mass to 5.0% by mass, and more preferably 0.01% by mass to 2.0% by mass.

The aforementioned flowability improver is surface treated to have improved hydrophobic properties, and is capable of inhibiting the degradation of flowability or charging ability under high humidity environment.

Suitable examples of the flowability improver are a silane coupling agent, a sililating agent, a silane coupling agent having a fluorinated alkyl group, an organotitanate coupling agent, an aluminum coupling agent, silicone oil, modified silicone oil, and the like.

The aforementioned cleaning improver is added to the toner to remove the residual developer on a latent electrostatic image bearing member or a primary transferring member after transferring.

Suitable example of the cleaning improver are fatty acid metal salt for example metal salt of stearic acid, such as zinc stearate, calcium stearate, and the like, fine polymer particles formed by soap-free emulsion polymerization, such as fine polymethylmethacrylate particles and fine polystyrene particles, and the like. The fine polymer particles have preferably a narrow particle size distribution. It is preferred that the volume average particle diameter thereof is 0.01 μm to 1 μm.

The magnetic material is not particularly limited and can be appropriately selected from the conventional magnetic material in accordance with a purpose. Suitable examples thereof are iron powder, magnetite, ferrite, and the like. Among these, one having a white color is preferable in terms of tone.

As one example of manufacturing method of the toner of the present invention, there is described hereinafter a method for forming the adhesive base material in the form of particles and granulating such particles to manufacture the toner.

In such method, the following steps are carried out, which are: a preparation of an aqueous medium phase, a preparation of toner solution, a preparation of dispersion, a formation of an adhesive base material, a removal of an organic solvent, and others (e.g. a synthesis of a polymer (prepolymer) capable of reacting with the active hydrogen group-containing compound, a synthesis of the active hydrogen group-containing compound, and the like).

The preparation of an aqueous medium phase is carried out, for example, by dispersing the aforementioned fine resin particles in the aforementioned aqueous medium. The amount of the fine resin particles added in the aqueous medium is not particularly limited, and can be appropriately adjusted in accordance with a purpose. It is preferable that the amount is in the range of 0.5% by mass to 10% by mass.

The preparation of a toner solution is carried out, for example, by dissolving and/or dispersing a toner material such as the aforementioned wax, the aforementioned active hydrogen group-containing compound, the aforementioned polymer capable of reacting with the active hydrogen group-containing compound, the aforementioned crystalline polyester, the aforementioned colorant, the aforementioned charge controlling agent, the aforementioned unmodified polyester and the like in the aforementioned organic solvent.

Note that the toner material other than the polymer (prepolymer) capable of reacting with the active hydrogen group-containing compound can be added and mixed in the aqueous medium at the time of dispersing the fine resin particles in the aqueous medium in the preparation of the aqueous medium phase. Alternatively, the polymer is added to the aqueous medium phase together with the toner solution at the time of adding the toner solution to the aqueous medium phase.

The organic solvent is not particularly limited, and can be appropriately selected in accordance with a purpose, provided that the organic solvent allows the toner material to be dissolved and/or dispersed therein. It is preferable that the organic solvent is a volatile organic solvent having a boiling point of less than 150° C. in view of easy removal from the solution or dispersion. Suitable examples thereof are toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, and the like. Among these solvents, ethyl acetate, toluene, xylene, benzene, methylene chloride, 1,2-dichloroethane, chloroform, carbon tetrachloride are preferable. These solvents can be selected singly or in combination. The usage amount of the organic solvent is preferable from 40 to 300 parts by mass, more preferably from 60 to 140 parts by mass, and furthermore preferably from 80 to 120 parts by mass with respect to 100 parts by mass of the toner material.

The preparation of the dispersion can be carried out by emulsifying and/or dispersing the previously prepared the toner solution in the previously prepared aqueous medium phase. At the time of emulsifying and/or dispersing, the active hydrogen group-containing compound and the polymer capable of reacting with the active hydrogen group-containing compound are subjected to elongation and/or crosslinking reaction, thereby forming the adhesive base material.

The adhesive base material (e.g. the aforementioned urea-modified polyester) is formed, for example, by the following method (1)-(3):

(1) the toner solution containing the polymer capable of reacting with the active hydrogen group-containing compound (e.g. (A) polyester prepolymer containing an isocyanate group) is emulsified and/or dispersed in the aqueous medium phase together with the active hydrogen group-containing compound (e.g. (B) amines) so as to form a dispersion, and then the active hydrogen group-containing compound and the polymer capable of reacting with the active hydrogen group-containing compound are subjected to elongation and/or crosslinking reaction in the aqueous medium phase;

(2) the toner solution is emulsified and/or dispersed in the aqueous medium previously added with the active hydrogen group-containing compound to form a dispersion, and then the active hydrogen group-containing compound and the polymer capable of reacting with the active hydrogen group-containing compound are subjected to elongation and/or crosslinking reaction in the aqueous medium phase;

(3) the toner solution is added and mixed in the aqueous medium, the active hydrogen group-containing compound is sequentially added thereto so as to form a dispersion, and then the active hydrogen group-containing compound and the polymer capable of reacting with the active hydrogen group-containing compound are subjected to elongation and/or crosslinking reaction at an interface of dispersed particles in the aqueous medium phase.

In the case of the method (3), it should be noted that modified polyester is initially formed from a surface of the thus obtained toner particles, and thus it is possible to form a contrast of the modified polyester in the toner particles.

Conditions for forming the adhesive base material by the emulsifying and/or dispersing are not particularly limited, and can be appropriately adjusted in accordance with a combination of the active hydrogen group-containing compound and the polymer capable of reacting therewith. A suitable reaction time is preferable 10 minutes to 40 hours, and more preferably 2 hours to 24 hours. A suitable reaction temperature is preferably 0 to 150° C., and more preferably 40° C. to 98° C.

A suitable formation of the dispersion containing the active hydrogen group-containing compound and the polymer capable of reacting with the active hydrogen group-containing compound (e.g. the (A) polyester prepolymer containing an isocyanate group) in the aqueous medium phase is realized by, to the aqueous medium phase, adding the toner solution in which the toner material such as the polymer (e.g. the (A) polyester prepolymer containing an isocyanate group), the colorant, the wax, the charge controlling agent, the unmodified polyester and the like is dissolved and/or dispersed in the organic solvent, and dispersing by a shear force.

The method of dispersing is not particularly limited, and can be appropriately selected from usage of the conventional dispersers. Examples of such dispersers are a low-speed-shear disperser, a high-speed-shear disperser, a friction disperser, a high-pressure-jet disperser, an ultrasonic disperser and the like. Among these, the high-speed-shear disperser is preferable in view of that it is capable of controlling particles of dispersion at 2 μm to 20 μm.

In the case that the high-speed-shear disperser is selected as a disperser, the conditions such as rotation frequency, dispersing time, dispersing temperature and the like are not particularly limited, and can be appropriately adjusted in accordance with a purpose. For example, the rotation frequency is preferably 1,000 rpm to 30,000 rpm, and more preferably 5,000 rpm to 20,000 rpm. In the case of the batch method, the dispersing time is preferably 0.5 minutes to 5 minutes, and the dispersing temperature is preferably 0 to 150° C., and more preferably 40° C. to 98° C. under pressure. Generally speaking, the dispersion is more easily carried out at a high dispersing temperature.

In a course of preparing the dispersion, the usage amount of the aqueous medium is preferably 50 parts by mass to 2,000 parts by mass, and more preferably 100 parts by mass to 1,000 parts by mass with respect to the 100 parts by mass of the toner material.

In the case that the usage amount of less than 50 parts by mass, the toner material is not suitable dispersed, and thus toner particles having a predetermined particle diameter are rarely obtained. In the case that the usage amount is more than 2,000 parts by mass, on the other hand, the production cost is liable to increase.

In a course of preparing the dispersion, a dispersant is preferably used in order to stabilize the dispersed particles (oil droplets formed from the toner solution), to obtain the predetermined shape of the dispersed particles, and to sharpen the particle size distribution of the dispersed particles.

The dispersant is not particularly limited, and can be appropriately selected in accordance with a purpose. Suitable examples of the dispersant are a surfactant, water-insoluble inorganic dispersant, polymeric protective colloid, and the like. These dispersants can be selected singly or in combination of two or more. Among these dispersants, a surfactant is preferable.

Examples of the surfactant are an anionic surfactant, a cationic surfactant, a nonionic surfactant, an ampholytic surfactant.

Examples of the anionic surfactant are alkylbenzene sulfonic acid salts, α-olefin sulfonic acid salts, phosphoric acid salts, and the like. Among these, the anionic surfactant having a fluoroalkyl group is preferable. Examples of the anionic surfactant having a fluoroalkyl group are fluoroalkyl carboxylic acid having 2-10 carbon atoms or a metal salt thereof, disodium perfluorooctanesulfonylglutamate, sodium-3-{omega-fluoroalkyl ($C_6$ to $C_{11}$)oxy}-1-alkyl($C_3$ to $C_4$) sulfonate, sodium-3-{omega-fluoroalkanoyl($C_6$ to $C_8$)-N-ethylamino}-1-propanesulfonate, fluoroalkyl($C_{11}$ to $C_{20}$) carboxylic acid or a metal salt thereof, perfluoroalkyl($C_7$ to $C_{11}$) carboxylic acid or a metal salt thereof, perfluoroalkyl($C_4$ to $C_{12}$) sulfonic acid or a metal salt thereof, perfluorooctanesulfonic acid diethanol amide, N-propyl-N-(2-hydroxyethyl) perfluorooctanesulfone amide, perfluoroalkyl($C_6$ to $C_{10}$)sulfoneamidepropyltrimethylammonium salt, a salt of perfluoroalkyl ($C_6$ to $C_{10}$)-N-ethylsulfonyl glycin, monoperfluoroalkyl($C_6$ to $C_{16}$)ethylphosphate, and the like. Examples of the commercially available surfactant having a fluoroalkyl group are: Surflon S-111, S-112 and S-113 (manufactured by Asahi Glass Co.); Frorard FC-93, FC-95, FC-98 and FC-129 (manufactured by Sumitomo 3M Ltd.); Unidyne DS-101 and DS-102 (manufactured by Daikin Industries, Ltd.); Megafac F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co.); Futargent F-100 and F150 (manufactured by Neos Co.).

Examples of the cationic surfactant are amine salt, quaternary amine salt, and the like. Examples of the amine salt are alkyl amine salt, aminoalcohol fatty acid derivative, polyamine fatty acid derivative, imidazoline, and the like. Examples of the quaternary ammonium salt are alkyltrimethyl ammonium salt, dialkyldimethyl ammonium salt, alkyldimethyl benzyl ammonium salt, pyridinium salt, alkyl isoquinolinium salt, benzethonium chloride, and the like. Among these, preferable examples are primary, secondary or tertiary aliphatic amine having a fluoroalkyl group, aliphatic quaternary ammonium salt such as perfluoroalkyl($C_6$ to $C_{10}$) sulfoneamidepropyltrimethylammonium salt, benzalkonium salt, benzetonium chloride, pyridinium salt, imidazolinium salt, and the like. Specific examples of the commercially available product thereof are Surflon S-121 (manufactured by Asahi Glass Co.), Frorard FC-135 (manufactured by Sumitomo 3M Ltd.), Unidyne DS-202 (manufactured by Daikin Industries, Ltd.), Megaface F-150 and F-824 (manufactured by Dainippon Ink and Chemicals, Inc.), Ectop EF-132 (manufactured by Tohchem Products Co.), and Futargent F-300 (manufactured by Neos Co.).

Examples of the nonionic surfactant are fatty acid amide derivative, polyhydric alcohol derivative, and the like.

Examples of the ampholytic surfactant are alanine, dodecyldi(aminoethyl) glycin, di(octylaminoethyle) glycin, N-alkyl-N,N-dimethylammonium betaine, and the like.

Examples of the water-insoluble inorganic dispersant are tricalcium phosphate, calcium carbonate, titanium oxide, colloidal silica, hydroxyl apatite, and the like.

Examples of the polymeric protective colloid are acid, (meth)acryl monomer having a hydroxyl group, vinyl alcohol or ether thereof, ester of vinyl alcohol and a compound having a carboxyl group, amide compound or methylol compound thereof, chloride, monopolymer or copolymer having a nitrogen atom or heterocyclic ring thereof, polyoxyethylene, cellulose, and the like.

Examples of the acid are acrylic acid, methacrylic acid, α-cycnoacrylic acid, α-cycnomethacrylic acid, itaconic acid, crotonic acid, fumaric acid, maleic acid, maleic anhydride, and the like.

Examples of the (meth)acryl monomer having a hydroxyl group are β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate, glycerin monomethacrylate, N-methylol acrylamido, N-methylol methacrylamide, and the like.

Examples of the vinyl alcohol or ether thereof are vinyl methyl ether, vinyl ethyl ether, vinyl propyl ether, and the like.

Examples of the ester of vinyl alcohol and a compound having a carboxyl group are vinyl acetate, vinyl propionate, vinyl butyrate, and the like.

Examples of the amide compound or methylol compound thereof are acryl amide, methacryl amide, diacetone acrylic amide acid, or methylol thereof, and the like.

Examples of the chloride are acrylic chloride, methacrylic chloride, and the like.

Examples of the monopolymer or copolymer having a nitrogen atom or heterocyclic ring thereof, are vinyl pyridine, vinyl pyrrolidone, vinyl imidazole, ethylene imine, and the like.

Examples of the polyoxyethylene are polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylarylphenyl ester, polyoxyethylene nonylphenyl ester, and the like.

Examples of the cellulose are methyl cellulose, hydroxyethyl cellulose, hydroxypropyl cellulose, and the like.

In the preparation of the dispersion, a dispersing stabilizer is employed, if necessary. The dispersing stabilizer is, for example, acid such as calcium phosphate, alkali-soluble compound, or the like.

In the case that the dispersing stabilizer is employed, the dispersing stabilizer is dissolved by acid such as hydrochloric acid, and then is washed with water or decomposed by a enzyme, thereby being removed from fine particles.

In the preparation of the dispersion, a catalyst for the elongation and/or crosslinking reaction is employed, if necessary. The catalyst is, for example, dibutyltin laurate, dioctyltin laurate, and the like.

The organic solvent is removed from the thus obtained dispersion (emulsified slurry). The removal of the organic solvent is carried out, for example, by the following methods (1)-(2):

(1) the temperature of the dispersion is gradually increased, and the organic solvent in the oil droplets are completely evaporated and removed;

(2) the emulsified dispersion is sprayed in a dry atmosphere, the water-insoluble organic solvent is completely evaporated and removed from the oil droplets to form toner particles, and the aqueous dispersant is evaporated and removed.

Once the organic solvent is removed, toner particles are formed. The toner particles are preceded with washing, drying, and the like. Sequentially, the toner particles are optionally preceded with a classification. The classification is, for example, carried out by cyclone, decanter, or centrifugal separation in the solution. Alternatively, the classification is carried out after the toner particles are obtained as powder by drying.

The thus obtained toner particles are subjected to mixing with particles such as the colorant, the wax, the charge controlling agent, etc., and mechanical impact, thereby preventing the particles such as the wax falling off from the surface of the toner particles.

Examples of the method of imparting mechanical impact are a method in which an impact is imparted by rotating a blade at high speed, and a method in which an impact is imparted by introducing the mixed particles into a high-speed flow and accelerating the speed of the flow so as to make the particles to impact with each other or so as to make the composite particles to impact upon an impact board. Examples of a device employed to such method are an angmill (manufactured by Hosokawamicron Corp.), a modified I-type mill (manufactured by Nippon Pneumatic Mfg. Co., Ltd.) to decrease crushing air pressure, a hybridization system (manufactured by Nara Machinery Co., Ltd.), a kryptron system (manufactured by Kawasaki Heavy Industries, Ltd.), an automatic mortar, and the like.

The toner preferably has the following average circularity, volume average particle diameter (Dv), a ratio (Dv/Dn) of volume average particle diameter (Dv) to number average particle diameter (Dn), penetration, low-temperature fixing properties, offset non-occurring temperature, thermal characteristics, image density, and the like.

The average circularity is an amount which a circumference of an equivalent circle having the same projected area to the toner particle shape minuses a boundary length of the actual toner particle. The average circularity is preferably 0.900 to 0.975, and more preferably 0.950 to 0.975. It is preferable that the amount of the particles having the average circularity of less than 0.940 is 15% or less with respect to the total amount of the toner.

In the case that the average circularity is less than 0.900, it is rarely capable of obtaining a desirable transfer properties, and high quality images without any scattering.

In the case that the average circularity is more than 0.975, it is liable to cause image smears resulted from cleaning failure to a latent electrostatic image bearing member and a transferring belt in an image-forming system utilizing a cleaning blade. Specifically, in the case of a formation of images having large image area such as photographic images, a toner forming an image remains on a latent electrostatic image bearing member due to paper feed failure or the like, and becomes a residual toner. Such residual toner is accumulated on the latent electrostatic image bearing member and the accumulated residual toner causes background smear on the formed image, or pollutes a charging roller which contact-charges the latent electrostatic image bearing member so that the charging roller is unable to exhibits original charging ability.

The average circularity is measured, for example, by an optical detection zone method in which a suspension containing the toner is passed through an image-detection zone disposed on a plate, the particle images of the toner are optically detected by means of a CCD camera, and the obtained particle images are analyzed. For example, Flow-type particle image analyzer FPIA-2100 (manufactured by Sysmex Corp.) is employed for such method.

The volume average particle diameter (Dv) of the toner is preferably 3 μm to 8 μm, more preferably 4 μm to 7 μm, and furthermore preferably 5 μm to 6 μm.

In the case that the volume average particle diameter is less than 3 μm, the toner of two-component developer is liable to fuse onto carrier surfaces as a result of stirring in the developing unit for a long period, and a one-component developer is liable to cause a filming to a developing roller or fusion to a member such as a blade for reducing a thickness of a toner layer formed onto a developing roller.

In the case that the volume average particle diameter is more than 8 μm, an image of high resolution and high quality is rarely obtained, and the mean toner particle diameter is liable to fluctuate when a toner is repeatedly added to the developer to compensate the consumed toner.

The ratio (Dv/Dn) of the volume average particle diameter (Dv) to the number average particle diameter (Dn) is preferably 1.20 or less, more preferably 1.00 to 1.20, and furthermore preferably 1.10 to 1.20, When the ratio is 1.20 or less, the toner is liable to have a sharp particle size distribution and thus the fixing properties thereof improve. In the case that the ratio is less than 1.00, the toner of a two-component developer is liable to fuse onto carrier surfaces due to stirring in a developing unit for a long-term, thereby degrading a charging ability of the carrier or cleaning properties, and a one-component developer is liable to cause a filming to a developing roller or fusion to a member such as a blade for reducing a thickness of a toner layer formed onto a developing roller. In the case that the ratio is more than 1.20, an image of high resolution and high quality is rarely obtained, and the mean toner particle diameter is liable to fluctuate when a toner is repeatedly added to the developer to compensate the consumed toner.

The volume average particle diameter and the ratio (Dv/Dn) are measured, for example, by means of a particle size analyzer, MultiSizer II, manufactured by Beckmann Coulter Inc.

The penetration is 15 mm or more, and preferably 20 mm to 30 mm in accordance with a penetration test (JIS K2235-1991).

In the case that the penetration is less than 15 mm, it is liable to degrade heat resistance preservation.

The penetration is measured in accordance with JIS K2235-1991. Specifically, the penetration is measure by filling a toner into a 50 ml glass container, leaving the glass container filled with the toner in a thermostat of 50° C. for 20 hours, sequentially cooling the toner to an ambient temperature, and then carrying out a penetration test thereto. Note that, the higher the penetration is, more excellent heat resistance preservation the toner has.

As the low-temperature fixing properties of the toner, the lowest fixing temperature is preferably as low as possible, and the offset non-occurring temperature is preferably as high as possible, in view of realizing both lower fixing temperature and prevention of offset. When the lowest fixing temperature is less than 150° C. and the offset non-occurring temperature is 200° C. or more, both the lower fixing temperature and prevention of offset are realized.

The lowest fixing temperature is determined as follow. A transfer sheet is set in an image-forming apparatus, a copy test is carried out, the thus obtained fixed image is scrubbed by pads, and the persistence of the image density is measured. The lowest fixing temperature is determined as a temperature at which the persistence of the image density becomes 70% or more.

The offset non-occurring temperature is measured as follow. A transfer sheet is set in an image-forming apparatus, and the image-forming apparatus is adjusted so as to develop a solid image in each color of yellow, magenta, and cyan, as well as intermediate colors of red, blue, and green, and so as to vary the temperature of a fixing belt. The offset non-occurring temperature is determined as the highest fixing temperature at which offset does not occur.

The thermal characteristics are also referred to flow tester characteristics, and are evaluated by softening temperature (Ts), flow-beginning temperature (Tfb), ½ method softening temperature (T½), and the like.

These thermal characteristics are measured by an appropriately selected method. For example, the thermal characteristics are obtained from a flow curve measured by means of a capillary flow tester CFT500 manufactured by Shimazu Corp.

The softening temperature (Ts) is not particularly limited, and can be appropriately adjusted in accordance with a purpose. It is preferably 30° C. or more, and more preferably 50° C. to 120° C. In the case that the softening temperature (Ts) is less than 30° C., at least one of the heat resistance preservation or low-temperature preservation may be degraded.

The flow-beginning temperature (Tfb) is not particularly limited, and can be appropriately adjusted in accordance with a purpose. It is preferably 50° C. or more, and more preferably 60° C. to 150° C. In the case that the flow-beginning temperature (Tfb) is less than 50° C., at least one of the heat resistance preservation or low-temperature preservation may be degraded.

The ½ method softening temperature (T½) is not particularly limited, and can be appropriately adjusted in accordance with a purpose. It is preferably 60° C. or more, and more preferably 80° C. to 170° C. In the case that the ½ method softening temperature (T½) is less than 60° C., at least one of the heat resistance preservation or low-temperature preservation may be degraded.

The image density is determined as a density value measured by means of a spectrometer (SpectroDensitometer 938, manufactured by X-Rite), and is preferably 1.40 or more, more preferably 1.45 or more, and furthermore preferably 1.50 or more.

In the case that the image density is less than 1.40, the image density is low and thus a high quality image may not be obtained.

The image density is measured as follow. A solid image is formed by using a transfer sheet (Type 6200 manufactured by Ricoh Company, Ltd.), and a color photocopier (PRETAIL™, manufactured by Ricoh Company, Ltd.) The photocopier was adjusted so that 0.4±0.05 mg/cm$^2$ of toner is transferred onto the sheet, and the transferred image is fixed by the fixing roller having a surface temperature of 160±2° C. The thus obtained solid image is subjected to a measurement of glossines by means of a spectrometer (SpectroDensitometer 938. manufactured by X-Rite), and an average value of measurements at arbitrary selected tree points in the solid image is calculated.

The coloration of the toner is not particularly limited, and can be appropriately selected in accordance with a purpose. For example, the coloration is at least one selected from a black toner, a cyan toner, a magenta toner, and a yellow toner. Each color toner is obtained by appropriately selecting the colorant to be contained therein. It is preferred that the toner is a color toner.

In the fixing step, it is preferable to obtain an image having a gloss as follow.

The gloss is determined as a glossiness measured by means of a gloss meter manufactured by GLOSSMETER (manufactured by Nippon Denshoku Industries Co., Ltd.). The glossiness is preferably 3% to 30%, and more preferably 5% to 20%. In the case that the glossiness is less than 3% or more than 30%, a gloss suitable for a color image may not be obtained.

The glossiness is measured as follow. A solid image is formed by using a transfer sheet (Type 6200 manufactured by Ricoh Company, Ltd.), and a color photocopier (PRETAIL™, manufactured by Ricoh Company, Ltd.). The photocopier is adjusted so that 0.4±0.05 mg/cm$^2$ of toner is transferred onto the sheet, and the image is fixed by the fixing roller having a surface temperature of 160±2° C. The thus obtained solid image is subjected to a measurement of glossiness. The measurement is carried out at incident angle of 60° by GLOSSMETER (manufactured by Nippon Denshoku Industries Co., Ltd.), and is taken at arbitrary selected tree points in the solid image so as to calculate an average value thereof. Note that a higher value means more glossy texture of the image.

An example of the image-fixing device of the present invention is described with reference to figures hereinafter. FIG. 1 is a schematic diagram showing an exemplary construction of the image-fixing device (belt-fixing device) according to the present invention.

The belt-fixing device 110 shown in FIG. 1 comprises a heating roller 121, a fixing roller 122 and a fixing belt 123 as the image-contact fixing member, and a pressurizing roller 124 as the non-image-contact fixing member.

The fixing belt 123 is looped around the heating roller 121 and the fixing roller 122 which are rotatably mounted inside thereof, and is heated at a predetermined temperature by the heating roller 121. The heating roller 122 has a heat source 125 therein, and is configured to freely control the temperature thereof by means of a thermal sensor 127 disposed adjacent to the heating roller 121. The fixing roller 122 is rotatably mounted inside of the fixing belt 123 so as to contact with the inner side of the fixing belt 123. The pressurizing roller 124 is rotatably mounted outside of the fixing belt 123 so as to contact with the outer side of the fixing belt 123. Moreover, the surface hardness of the fixing belt 123 as the image-contact fixing member is lower than the surface hardness of the pressurizing roller 124 as the non-image-contact member. In the nip N formed between the fixing roller 122 and the pressurizing roller 124, an intermediate region of the recording medium S introducing edge and the ejecting edge, is located towards the side of the fixing roller 122 compared with the introducing edge and the ejecting edge. Namely, the nip N has a convex shape with respect to the upper side in FIG. 1.

In the belt-fixing device 110 shown in FIG. 1, a toner image T to be fixed is transferred to the heating roller 121. The toner image T on the recording medium S is heated and fused by the heating roller 121 heated at a predetermined temperature by means of the heat source 125, and the fixing belt 123. With this fused condition, the recording medium S is inserted into the nip N formed between the fixing roller 122 and the pressurizing roller 124. The recording medium S inserted in the nip N is contacted with a surface of the fixing belt 123 which rotates along with the rotation of the fixing roller 122 and the pressurizing roller 124, and is pressed at the time passed through the nip N, thereby fixing the toner image T onto the recording medium S. At this point, the wax located in the surface portion of the toner T oozes out. As a result, an excellent fixing releasing-ability is applied.

The recording medium S on which the toner image T is fixed is sequentially passed through between the fixing roller 122 and the pressurizing roller 124, separated from the fixing belt 123, and transferred to a tray (not shown in FIG. 1) via a guide G. In this process, the recording medium S is ejected towards the side of the pressurizing roller 124 as the non-image-contact fixing member, and thus the recording medium is prevented from wrapping around the fixing belt 123. The fixing belt 123 is then cleaned by means of a cleaning roller 126. Note that, the toner T comprises an appropriate amount of the wax in its surface portion, and thus has an excellent releasing ability. Therefore, the toner T from the cleaning roller 126 is prevented from fusing to the fixing belt 123.

Figure 2:
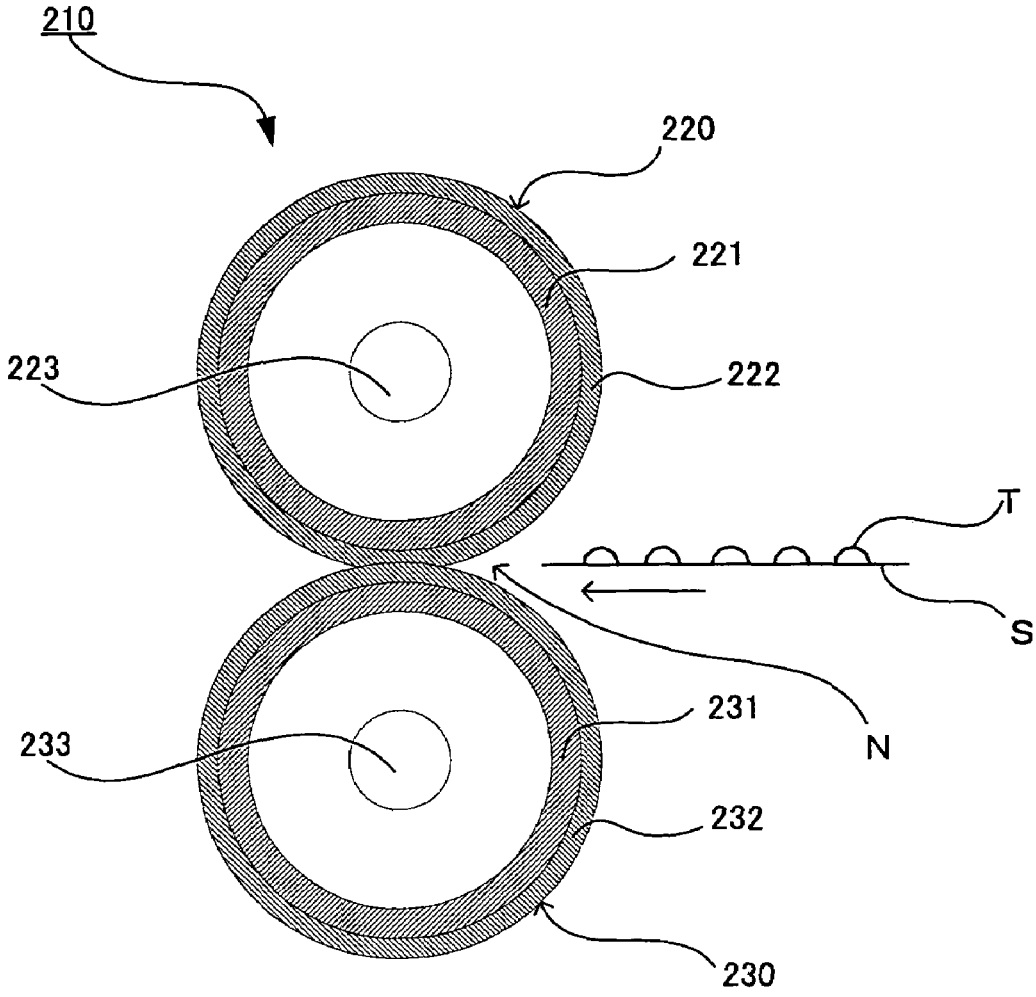
FIG. 2 is a schematic diagram to show an exemplary construction of the image-fixing device according to the present invention.

FIG. 2 is a schematic diagram to show an exemplary construction of the image-fixing device according to the present invention.

The image-fixing device 210 shown in FIG. 2 comprises a heating roller 220 as the fixing member and a pressurizing roller 230 disposed adjacent to the heating roller 220.

The heating roller 220 comprises a hollow metal cylinder 221, an offset inhibition layer 222 coated on the surface of the metal cylinder 221, and a heating lamp 223 disposed in the metal cylinder 221. The pressurizing roller 230 comprises a metal cylinder 231, and an offset inhibition layer 232 coated on the surface of the metal cylinder 231. Alternatively, the metal cylinder 231 of the pressurizing roller 230 is hollow and equipped with a heating lamp 233 therein.

The heating roller 220 and the pressurizing roller 230 are rotatably mounted so as to contact against each other by means of a spring (not shown in FIG. 2) to form a nip N. The offset inhibition layer 222 of the heating roller 220 as the image-contact fixing member has a lower surface hardness than the surface hardness of the offset inhibition layer 232 of the pressurizing roller 230 as the non-image-contact fixing member. In the nip N formed between the heating roller 220 and the pressurizing roller 230, an intermediate region of the recording medium S introducing edge and the ejecting edge, is located towards the heating roller 220 compared with the introducing edge and the ejecting edge. Namely, the nip N has a convex shape with respect to the upper side in FIG. 2.

In the image-fixing device 210 shown in FIG. 2, a toner image T to be fixed is transferred to the nip formed between the heating roller 220 and the pressurizing roller 230. The toner image T on the recording medium S is heated and fused by the heating roller 220 heated at a predetermined temperature by means of the heating lamp 223. At the same time, the recording medium S is passed through the nip N, the recording medium S is pressed by a pressure from the pressurizing roller 230, and thus the toner image T is fixed into the recording medium S. At this point, the wax located in the surface region of the toner T oozes out. As a result, an excellent fixing releasing ability is applied.

The recording medium S on which the toner image T is fixed is sequentially passed through between the heating roller 220 and the pressurizing roller 230, and transferred to a tray (not shown in FIG. 2). In this process, the recording medium S is ejected towards the side of the pressurizing roller 230 as the non-image-contact fixing member, and thus the recording medium S is prevented from wrapping around the pressurizing roller 230. The pressurizing roller 230 is then cleaned by means of a cleaning roller (not shown in FIG. 1). Note that, the toner T comprises an appropriate amount of the wax in its surface portion, and thus has an excellent releasing ability. Therefore, the toner T from the cleaning roller is prevented from fusing to the heating roller 220.

Figure 3:
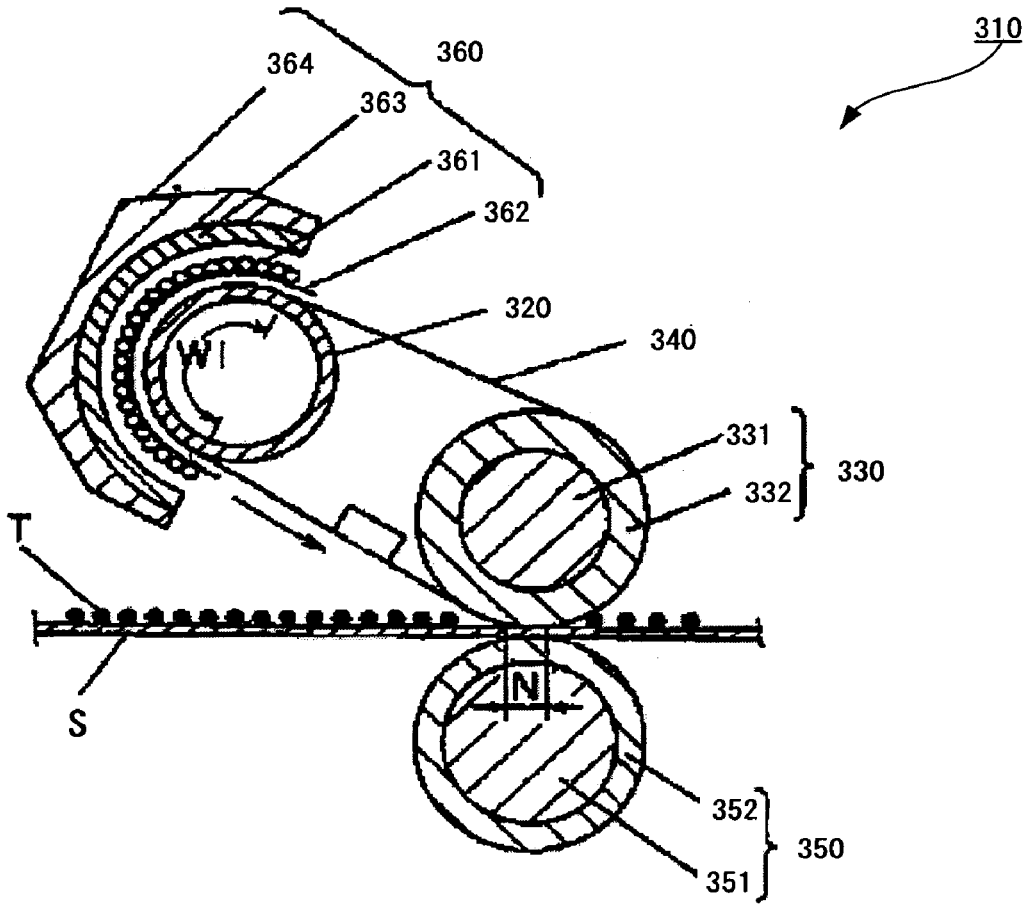
FIG. 3 is a schematic diagram to show an exemplary construction of an image-fixing device (electromagnetic-induced-heat-fixing device) according to the present invention.

FIG. 3 is a schematic diagram to show an exemplary construction of an image-fixing device (electromagnetic-induction-heat fixing device) according to the present invention.

The image-fixing device 310 shown in FIG. 3 comprises a heating roller 320, a fixing roller 330 and a fixing belt 340 as the image-contact fixing member, a pressurizing roller 350 as the non-image-contact fixing member, and an electromagnetic induction heating unit 360, The fixing belt 340 is looped around the heating roller 230 and the fixing roller 330 which are rotatably mounted inside the fixing belt 340, and the fixing belt 340 is heated at a predetermined temperature by the heating roller 230.

The heating roller 320 comprises a magnetic metal member formed of iron, cobalt, nickel, or alloy thereof, in formed of hollow cylinder. For example, the outer diameter is 20 mm to 40 mm, and a thickness is 0.3 mm to 1.0 mm. Accordingly, the heating roller 320 has a configuration of low thermal capacity and rapid thermal conductivity.

The fixing roller 330 comprises a metal core 331 formed of metal such as a stainless steel or the like, and an elastic layer 332 coated on the surface of the metal core 331. The elastic layer is formed of a thermal resistive silicone rubber in the form of solid or foam. The fixing roller 330 is rotatably mounted inside the fixing belt 340 so as to contact against the inner side of the fixing belt 340. In order to form a predetermined width of a nip N between the pressurizing roller 350 and the fixing roller 330 by the pressure from the pressurizing roller 350, the fixing roller 330 is configured to have an outer diameter of 20 mm to 40 mm, which is larger than that of the heating roller 320. The elastic layer 332 has a thickness of 4 mm to 6 mm so that the thermal capacity of the heating roller 320 becomes smaller than the thermal capacity of the fixing roller 330, thereby shortening the time required for warming up the heating roller 320.

The pressurizing roller 350 comprises a metal core 351 formed of a metal having a high thermal conductivity such as cupper, aluminum, or the like, and an elastic layer 352 coated on the surface of the metal core 351. The elastic layer 352 has thermal resistance and high toner releasing-ability. The pressurizing roller 350 is rotatably mounted outside the fixing belt 350 so as to contact against the fixing roller 320 via the fixing belt 350. Apart from the above-listed metals, SUS may be used to form the metal core 351.

The electromagnetic induction heating unit 360 is disposed adjacent to the heating roller 320 and along the axis direction of the heating roller 320. The electromagnetic induction heating unit 360 comprises an exciting coil 361 as a magnetic field generating unit; and a coil guide plate 362 to which the exciting coil 361 is rolled up. The coil guide place 362 is disposed adjacent to the outer circumferential surface of the heat roller 320, and has a half cylinder shape. The exciting coil 361 is the one that a long exciting coil wire rod is alternately rolled up along the coil guide plate 362 in the axial direction of the heat roller 320. It is noted that the oscillation circuit of the exciting coil 361 is connected to a frequency-variable driving power source (not shown in FIG. 3). At the outside of the exciting coil 361, an exciting coil core 363 which is made from a ferromagnetic element such as ferrite and is in a half cylinder shape is fixed to an exciting coil core supporting member 364 and closely disposed to the exciting coil 361.

In the image-fixing device 310 shown in FIG. 3, once the exciting coil 361 of the electromagnetic induction heating unit 360 is electrified, alternating magnetic field is formed around the electromagnetic-induction heating unit 360, thereby uniformly and efficiently preheating the heating roller 320 is adjacent to and surrounded by the exciting coil 361 by the excitation of overcurrent. A recording medium S formed a toner image S to be fixed thereon is transferred to a nip N formed between the fixing roller 330 and the pressurizing roller 350. The heating roller 320 is heated at a predetermined temperature by means of the electromagnetic induction heating unit 320. The fixing belt 340 is heated at the contact region W1 with the heating roller 320 by means of the heating roller 320. The toner image T on the recording medium S is heated and fused by the heated fixing belt 340. In this fused condition of the toner image T, the recording medium S is inserted into the nip N formed between the fixing roller 330 and the pressurizing roller 350. The recording medium S inserted in the nip N is contacted against the surface of the fixing belt 340 which rotates along the rotation of the fixing roller 330 and the pressurizing roller 350. At the time of passing though the nip N, the recording medium S is pressed and toner image T is fixed onto the recording medium S. At this point, the wax located in the surface portion of the toner T oozes out. As a result, an excellent fixing releasing-ability is applied.

The recording medium S on which the toner image T is fixed is sequentially passed through between the fixing roller 330 and the pressurizing roller 350, separated from the fixing belt 340, and transferred to a tray (not shown in FIG. 3). In this process, the recording medium S is ejected towards the side of the pressurizing roller 350 as the non-image-contact fixing member, and thus the recording medium S is prevented from wrapping around the fixing belt 340. The fixing belt 340 is then cleaned by means of a cleaning roller (not shown in FIG. 3). Note that, the toner T comprises an appropriate amount of the wax in its surface portion, and thus has an excellent releasing ability. Therefore, the toner T from the cleaning roller is prevented from fusing to the fixing belt 340.

In the present invention, a toner in use is the toner which comprises the wax having an aliphatic hydrocarbon chain and the polyester resin containing an aromatic ring, wherein the total amount of the wax in the toner particle is 1% by mass to 20% by mass, an amount of the wax located in a region of the toner particle including from the surface to 0.3 μm depth from the surface is 0.05 to 0.40, which is an intensity ratio ($P_{2850}/P_{828}$) of a peak 2850 $cm^{-1}$ derived from the wax to a peak 828 $cm^{-1}$ derived from the polyester resin, and at least a part of the wax is encapsulated in the toner particle in the form of dispersed particles. Moreover, a toner image formed of the above-described toner is fixed on a recording medium at a nip formed between the non-image-contact fixing member and the image-contact fixing member having lower surface hardness than the surface hardness of the non-image-contact fixing member, and the recording medium is then ejected to the side of the non-image-contact fixing member. Accordingly, the present invention prevents the recording medium from wrapping around the fixing member, has an excellent offset properties and glossiness, and obtains a high quality image. The image-fixing device of the present invention is suitably applicable for the image-fixing method of the present invention.

(Image-Forming Method and Image-Forming Apparatus)

The image-forming method of the present invention comprises the steps of: developing the latent electrostatic image with a toner so as to form a toner image; transferring the toner image onto a recording medium; passing the recording medium bearing the toner image thereon through a nip formed between two or more fixing members so as to fix the toner image onto the recording medium. The image-forming method of the present invention optionally comprises other steps, if necessary.

The image-forming apparatus of the present invention comprises an image-forming unit, a transferring unit, and two or more fixing members which are disposed so as to form a nip therebetween which allows a recording medium bearing a toner image to pass through, thereby fixing the toner image on the recording medium. The image-forming apparatus of the present invention optionally comprises other units or members, if necessary.

In the present invention, the aforementioned toner comprises a wax having an aliphatic hydrocarbon chain, and a polyester resin containing an aromatic ring, wherein a total amount of the wax in the toner particle is 1% by mass to 20% by mass, which is determined as a value mass-converted from an endothermic value in accordance with DSC, an amount of the wax located in a region of the toner particle including from the surface to 0.3 μm depth from the surface is 0.05 to 0.40, which is an intensity ratio ($P_{2850}/P_{828}$) of a peak 2850 $cm^{-1}$ derived from the wax to a peak 828 $cm^{-1}$ derived from the polyester resin, in accordance with FTIR-ATR, and at least a part of the wax is encapsulated in the toner particle in the form of dispersed particles.

Among the aforementioned two or more fixing members, the fixing member which contacts with an image-bearing surface of the recording medium has a lower surface hardness than a surface hardness of the fixing member which contacts with the non-image-bearing surface of the recording medium. In addition, after passing the recording medium through the nip, the recording medium is ejected to the side of the fixing member which contacts with a non-image-bearing surface of the recording medium.

The image-forming method of the present invention is suitably carried out by means of the image-forming apparatus of the present invention. Note that the image-forming apparatus of the present invention is simultaneously used when the image-forming method of the present invention is performed. Accordingly, the details of the image-forming apparatus are also explained in the descriptions of the image-forming method.

In the image-forming method of the present invention, details of a step of fixing the toner image onto the recording medium, the fixing members, the toner, and the like are the same as previously explained in the image-fixing method and the image-fixing device of the present invention.

The image-forming method of the present invention further comprises the steps of: charging a latent electrostatic image bearing member entirely; and exposing the charged latent electrostatic image bearing member to imagewise light so as to form a latent electrostatic image thereon.

The image-forming method of the present invention optionally comprises other steps, if necessary. Examples of the steps are a charge removing step, a cleaning step, a recycling step, a controlling step, and the like.

The image-forming apparatus of the present invention further comprises a latent electrostatic image bearing member and a latent-electrostatic-image-forming unit, and optionally comprises other units or members. Examples of the other units or members are a charge removing unit, a cleaning unit, recycling unit, a controlling unit, and the like.

<Latent Electrostatic Image Formation and Latent Electrostatic Image Forming Unit>

The latent electrostatic image formation is a step for forming a latent electrostatic image on a latent electrostatic image bearing member (also referred to a photoconductive insulator, a photoconductor, and the like).

The latent electrostatic image bearing member is not particularly limited in terms of material, shape, configuration, and size thereof, and can be appropriately selected in accordance with a purpose. A suitable example of the shape thereof is a drum shape. Examples of the material thereof are an inorganic photoconductor such as amorphous silicon, or selenium, an organic photoconductor such as polysilane, or phthalopolymethine, and the like. Among these examples, the amorphous silicone is preferable in view of long lifetime.

The latent electrostatic image formation is carried out, for example, by exposing the latent electrostatic image bearing member to imagewise light after uniformly charging the entire surface of the latent electrostatic image bearing member. This is performed by means of the latent electrostatic image forming unit.

The latent electrostatic image forming unit comprises a charging unit which is configured to uniformly charge the surface of the photoconductor, and an exposing unit which is configured to expose the surface of the latent electrostatic image bearing member to imagewise light. The latent electrostatic image forming unit optionally comprises other units or members.

The charging is carried out, for example, by applying voltage to the surface of the photoconductor by means of the charging unit.

The charging unit is not particularly limited, and can be appropriately selected in accordance with a purpose. Examples of the charging unit are the conventional contact-charging unit equipped with a conductive or semiconductive roller, blush, film, or rubber blade, the conventional non-contact-charging unit utilizing corona discharge such as corotron, or scorotoron, and the like.

The exposure is carried out, for example, by exposing the surface of the photoconductor to imagewise light by means of the exposing unit.

The exposing unit is not particularly limited, provided that a predetermined exposure is performed imagewise on the surface of the charged latent electrostatic image bearing member by the charging unit, and can be appropriately selected in accordance with a purpose. Examples of the irradiating unit are various irradiating units such as an optical copy unit, a rod-lens-array unit, an optical laser unit, an optical liquid crystal shatter unit, and the like In the present invention, a backlight system may be applied for the exposure, in which exposure is carried out imagewie from the back side of the photoconductor.

<Toner-Image Formation and Toner-Image Forming Unit>

The toner-image formation is a step of developing the latent electrostatic image with the toner to form a visible image (toner image).

The toner image has a maximum toner deposition amount of 0.4 $mg/cm^2$ to 1.5 $mg/m^2$, and preferably 0.8 $mg/cm^2$ to 1.5 $mg/m^2$ at least at part thereof. The image-fixing method of the present invention realizes desirable releasing ability and high quality image formation even when the fixing is performed to a full-color image which has a large toner deposition amount resulted from superimposing color images.

The toner-image formation is performed, for example, by developing the latent electrostatic image with the toner by means of the toner-image forming unit.

The toner-image forming unit is not particularly limited, provided that developing is carried out with the toner, and can be appropriately selected in accordance with a purpose. A suitable example of the toner-image forming unit is a developing unit which contains a toner therein and capable of directly or indirectly applying the toner to the latent electrostatic image.

The developing unit may be of dry developing or wet developing, and a developing unit for mono-color or a developing unit for multi-color. A suitable example of the developing unit is a developing unit comprising a stirring unit which stirs the toner to impart frictional electrification, and a magnet roller which is rotatebly mounted.

Within the developing unit, the toner and carrier are mixed and stirred, and the toner is charged at the time of friction with the carrier, the rotatable magnetic roller bears the charged toner on the surface thereof to form a magnetic blush. Since the magnet roller is disposed adjacent to the photoconductor, a part of the toner consisting of the magnetic blush, which is formed on the surface of the magnetic roller, is electrically attracted and transferred to the surface of the photoconductor. As a result, the latent electrostatic image is developed by the toner, and the visible image (toner image) of the toner is formed on the photoconductor.

The developer contained in the developing unit is a developer comprising the aforementioned toner. The developer is either one-component developer or two-component developer.

<Transferring and Transferring Unit>

The transferring is a step of transferring the toner image onto a recording medium. The preferably embodiment of the transfer is such that a toner image is primary transferred to an intermediate transferring member, the toner image transferred on the intermediate transferring member is secondary transferred to a recording medium. The more preferably embodiment of the transfer is such that the toner is of two or more color, or preferably full-color toner, and the transfer contains a primary transfer wherein a toner image is transferred to the intermediate transferring member to form a composite transferred image, and a secondary transfer wherein the composite transferred image is transferred onto a recording medium.

The transfer is carried out, for example, by charging the toner image on the photoconductor by means of a transfer charging unit. This transfer is performed by means of the transferring unit. The preferable embodiment of the transferring unit is such that a transferring unit comprises a primary transferring unit which is configured to transfer a toner image onto an intermediate transferring member to form a composite transferred image, and a secondary transferring unit which is configured to transfer the composite transferred image onto a recording medium.

The intermediate transferring member is not particularly limited, and can be selected from the conventional transferring members in accordance with a purpose. Examples thereof are a transferring belt, and the like.

The transferring unit (the primary transferring unit and the secondary transferring unit) preferably comprises a transferring element which is configured to charge so as to separate the toner image from the photoconductor and to transfer onto a recording medium. In the image-forming apparatus of the present invention, either one, or plurality of transferring units are disposed.

Examples of the transferring element are a corona transferring element utilizing corona discharge, a transferring belt, a transferring roller, a pressure-transferring roller, an adhesion-transferring element, and the like.

The recording medium is not particularly limited, and can be appropriately selected from the conventional recording mediums (recording papers or sheets) in accordance with a purpose.

The charge removing is a step of applying a bias to the charged photoconductor so as to remove the charge. This is suitably performed by the charge removing unit.

The charge removing unit is not particularly limited, provided that bias is applied to the charged photoconductor to thereby remove the charge, and can be appropriately selected from the conventional charge removing units in accordance with a purpose. A suitable example thereof is a charge removing lamp.

The cleaning is a step of removing the residual toner on the photoconductor. This is suitably performed by means of the cleaning unit.

The cleaning unit is not particularly limited, provided that the residual electrophotographic toner on the photoconductor is removed, and can be appropriately selected from the conventional cleaners in accordance with a purpose. Examples thereof are a magnetic blush cleaner, a electrostatic brush cleaner, a magnetic roller cleaner, a blade cleaner, a blush cleaner, a wave cleaner, and the like.

The recycling is a step of recycling or recovering the color toner collected by the cleaning to the developing unit. This is suitably performed by means of the recycling unit.

The recycling unit is not particularly limited, and can be appropriately selected from the conventional conveyance systems.

The controlling is a step of controlling each of the aforementioned steps. This is suitably performed by means of the controlling unit.

The controlling unit is not particularly limited, provided that each of the aforementioned units or members is controlled, and can be appropriately selected in accordance with a purpose. Examples thereof are devices such a sequencer, a computer, and the like.

One embodiment of the image-forming method of the present invention by means of the image-forming apparatus of the present invention is explained with reference to FIG. 4.

The image-forming apparatus 100 shown in FIG. 4 comprises a photoconductor drum 10 (referred to a photoconductor 10 hereinafter) as the latent electrostatic image bearing member, a charging roller 20 as the charging unit, an exposure device 30 as the exposing unit, a developing device 40 as the developing unit, an intermediate transferring member 50, a cleaning device 60 as the cleaning unit having a cleaning blade, and a charge removing lamp 70 as the charge removing unit.

The intermediate transferring member 50 is an endless belt, and looped around three rollers 51 which are disposed inside thereof. The intermediate transferring member 50 is configured to rotate in the direction shown with the arrow by means of the rollers 51. One or more of the three rollers 51 also functions as a transfer bias roller which is capable of applying a certain transfer bias (primary bias) to the intermediate transferring member 50. Adjacent to the intermediate transferring member 50, there are disposed a cleaning device 90 having a cleaning blade, and a transferring roller 80 as the transferring unit which is capable of applying a transfer bias so as to transfer (secondary transfer) a developed image (toner image) to a transfer sheet 95 as the recording medium. Moreover, there is disposed a corona charger 58 for applying a charge to the toner image transferred on the intermediate transferring medium 50, beside the intermediate transferring medium 50, and in between the contact region of the photoconductor 10 and the intermediate transferring medium 50 and the contact region of the intermediate transferring medium 50 and the transfer sheet 95 in the rotational direction of the intermediate transferring medium 50.

The developing device 40 comprises a developing belt 41, a black developing unit 45K, yellow developing unit 45Y, magenta developing unit 45M, and cyan developing unit 45C, in which the developing units positioned around the developing belt 41. The black developing unit 45K comprises a developer container 42K, a developer supplying roller 43K, and a developing roller 44K; the yellow developing unit 45Y comprises a developer container 42Y, a developer supplying roller 43Y, and a developing roller 44Y; the magenta developing unit 45M comprises a developer container 42M, a developer supplying roller 43M, and a developing roller 44M; the cyan developing unit 45C comprises a developer container 42C, a developer supplying roller 43C, and a developing roller 44C. In addition, the developing belt 41 is an endless belt which is looped around a plurality of belt rollers so as to rotate. Moreover, the developing belt 41 is configured to contact with the photoconductor 10 at a part thereof.

Figure 4:
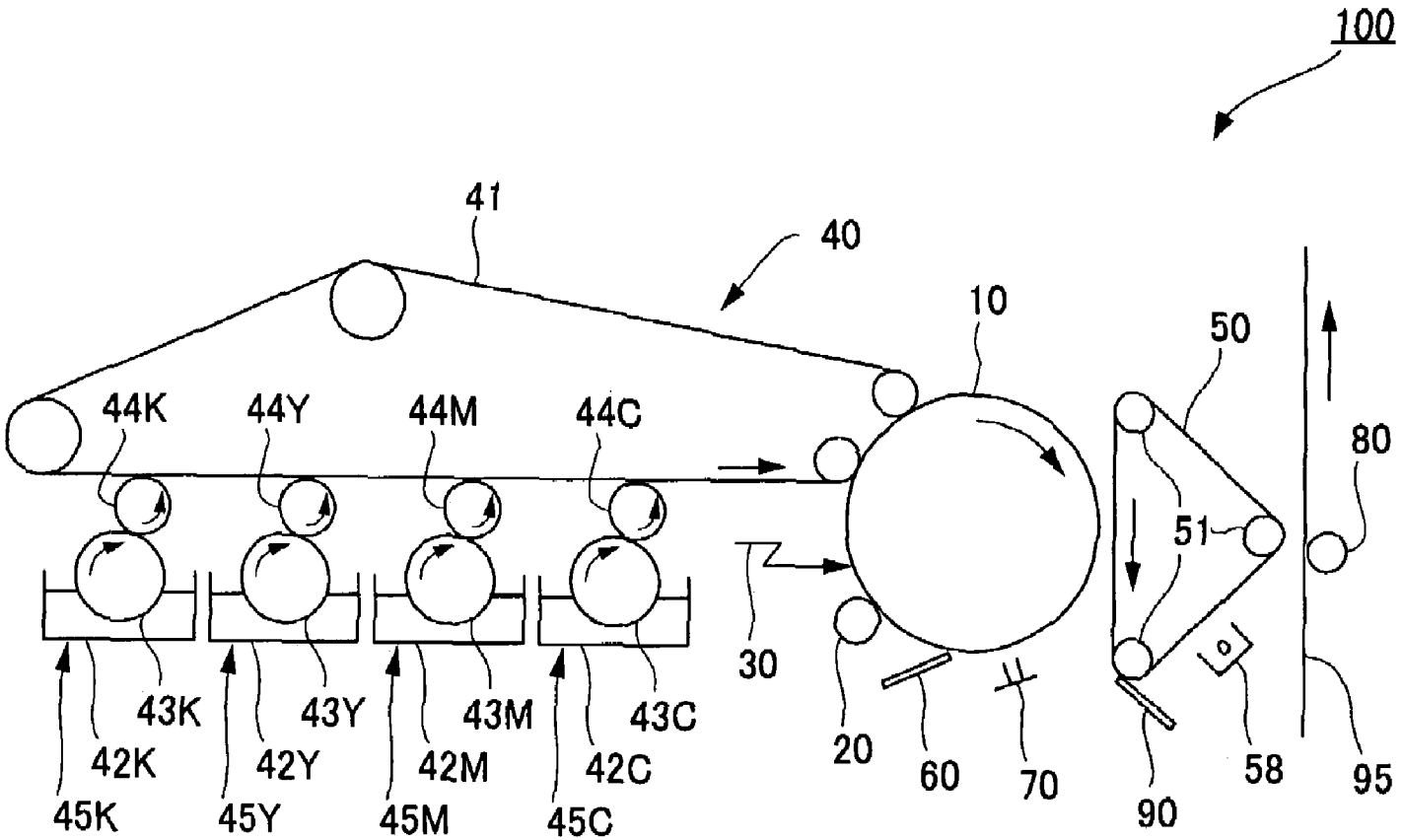
FIG. 4 is a schematic diagram to show an exemplary embodiment of an image-forming method according to the present invention with assistance of an image-forming apparatus according to the present invention.

In the image-forming apparatus 100 shown in FIG. 4, the photoconductor 10 is uniformly charged by the charging roller 20. The exposure device 30 sequentially exposes the photoconductor 10 to imagewise light so as to form a latent electrostatic image. The latent electrostatic image formed on the photoconductor 10 is supplied with a toner from the developing device 40 so as to form a toner image. The roller 51 applies a bias to the toner image so as to transfer (primary transfer) the toner image onto the intermediate transferring medium 50, and further applies a bias to transfer (secondary transfer) the toner image from the intermediate transferring medium 50 to the transfer sheet 95. In this way, the transferred image is formed on the transfer sheet 95. Thereafter, the residual toner on the photoconductor 10 is removed by the cleaning device 60, and the charged photoconductor 10 is diselectrified by the charge removing lamp 70.

Another embodiment of the image-forming method of the present invention by means of the image-forming apparatus of the present invention is explained with reference to FIG. 5.

Figure 5:
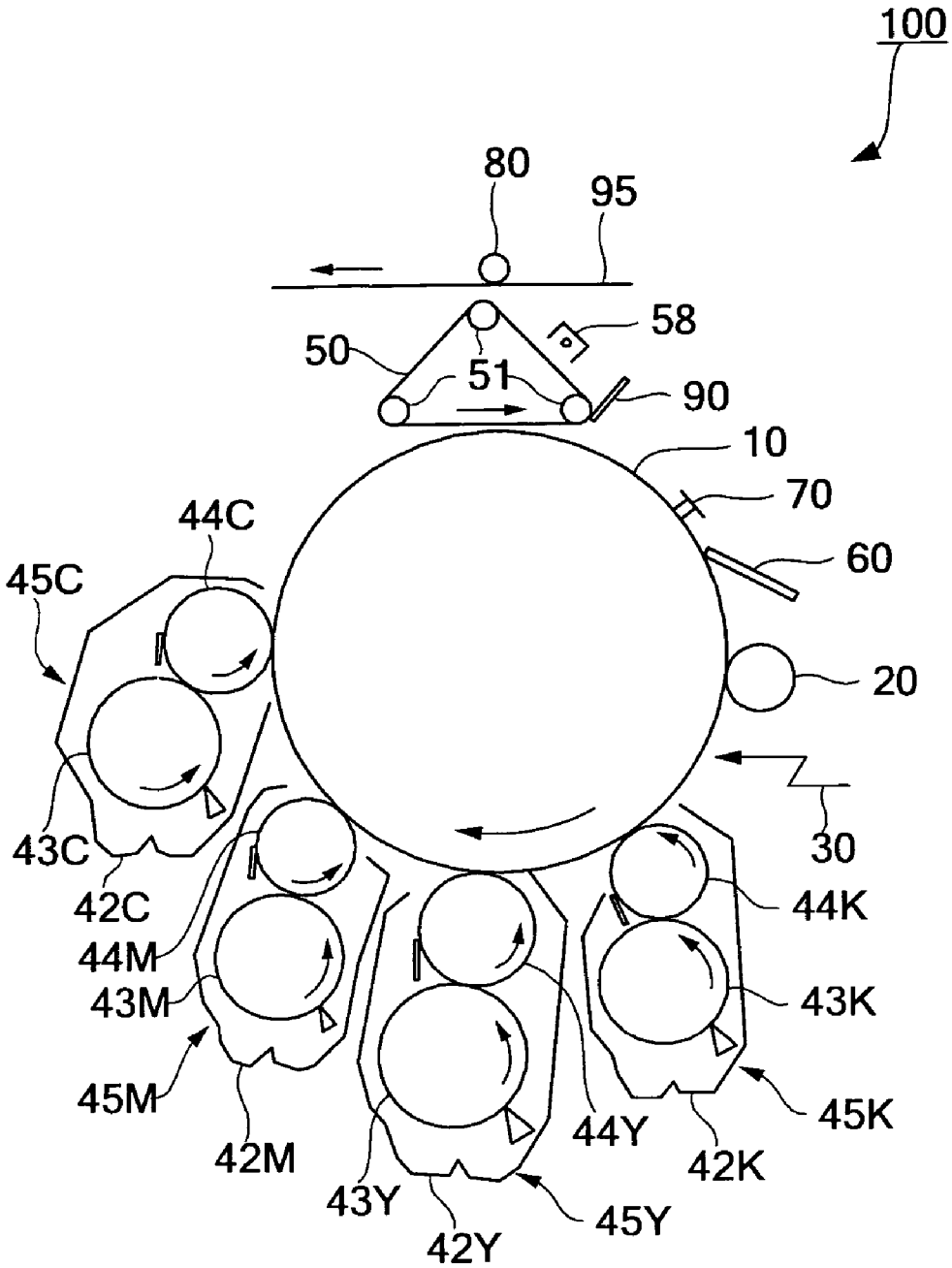
FIG. 5 is a schematic diagram to show another exemplary embodiment of an image-forming method according to the present invention with assistance of an image-forming apparatus according to the present invention.

The image-forming apparatus 100 shown in FIG. 5 has the identical configurations and functions to the image-forming apparatus 100 shown in FIG. 4, provided that the image-forming apparatus 100 does not comprise a developing belt 41, and the black developing unit 45K, the yellow developing unit 45Y, the magenta developing unit 45M, and the cyan developing unit 45C are disposed around the photoconductor 10 so as to face to each other. Note that, the reference numbers of FIG. 5 denote the same members or units to the ones in FIG. 4, if the numbers are identical.

Another embodiment of the image-forming method of the present invention by means of the image-forming apparatus of the present invention is explained with reference to FIG. 6.

Figure 6:
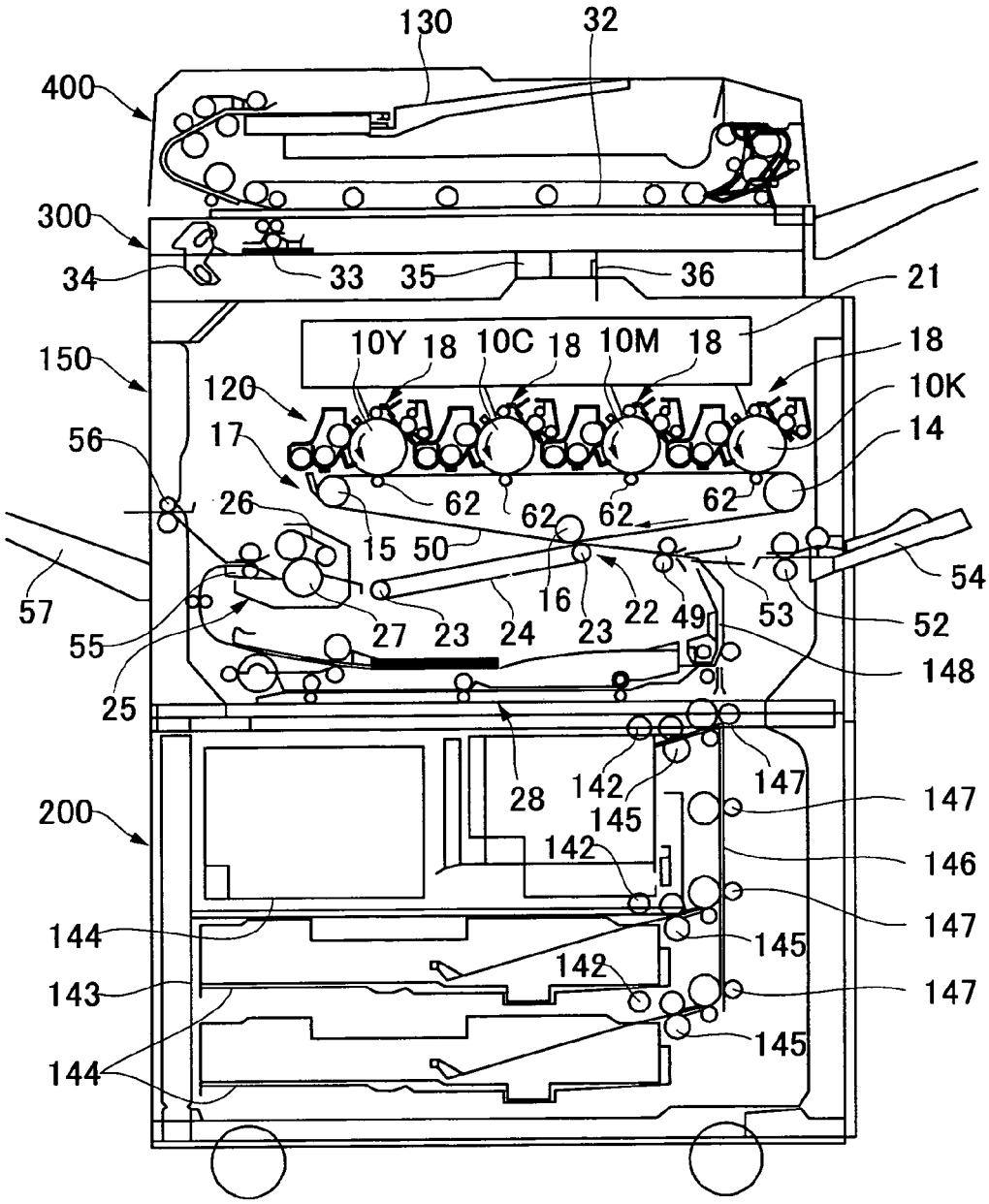
FIG. 6 is a schematic diagram to show an exemplary embodiment of an image-forming method according to the present invention with assistance of an image-forming apparatus (tandem-type color-image-forming apparatus) according to the present invention.

The image-forming apparatus 100 shown in FIG. 6 is a tandem color-image-forming apparatus. The tandem image-forming apparatus 100 comprises a copying machine main body 150, a feeder table 200, a scanner 300, and an automatic document feeder (ADF) 400. The copying machine main body 150 contains an endless-belt intermediate transferring member 50 in the middle part.

The intermediate transferring member 50 shown in FIG. 6 is looped around support rollers 514, 515 and 516 and is configured to rotate in a clockwise direction in FIG. 6.

There is disposed a cleaning device 17 for the intermediate transferring member adjacent to the support roller 15. The cleaning device 17 for the intermediate transferring member is capable of removing a residual toner on the intermediate transferring member 50 after transferring a toner image.

Above the intermediate transferring member 50 looped around the support rollers 514 and 515, four image-forming devices 18 of yellow, cyan, magenta, and black are arrayed in parallel in a conveyance direction of the intermediate transferring member 50 to thereby constitute a tandem developing unit 120.

There is also disposed an exposing unit 21 adjacent to the tandem developing unit 120. A secondary transferring unit 22 is disposed the opposite side of the intermediate transferring member 50 to where the tandem developing unit 120 is disposed. The secondary transferring unit 22 comprises a secondary transferring belt 24 of an endless belt, which is looped around a pair of rollers 23. The secondary transferring unit 22 is configured so that the transfer sheet conveyed on the secondary transferring belt 24 contacts with the intermediate transferring member 50. Adjacent to the secondary transferring unit 22, there is disposed an image-fixing device 25. The image-fixing device 25 has the same configurations to the configurations of the belt-fixing device shown in FIG. 1. The image-fixing device 25 comprises a fixing belt 26 which is an endless belt, and a pressurizing roller 27 which is disposed so as to contact against the fixing belt 26.

In the tandem image-forming apparatus 100, a sheet reverser 28 is disposed adjacent to the secondary transferring unit 22 and the image-fixing device 25. The sheet reverser 28 is configured to reverse a transfer sheet in order to form images on the both sides of the transfer sheet.

Next, full-color image-formation (color copy) is formed by means of the tandem developing unit 120 in the following manner.

Initially, a document is placed on a document platen 130 of the automatic document feeder 400. Alternatively, the automatic document feeder 400 is opened, the document is placed on a contact glass 32 of the scanner 300, and the automatic document feeder 400 is closed to press the document.

At the time of pushing a start switch (not shown), the document placed on the automatic document feeder 400 is transported onto the contact glass 32. In the case that the document is initially placed on the contact glass 32, the scanner 300 is immediately driven to operate a first carriage 33 and a second carriage 34. Light is applied from a light source to the document, and reflected light from the document is further reflected toward the second carriage 34 at the first carriage 33. The reflected light is further reflected by a mirror of the second carriage 34 and passes through an image-forming lens 35 into a read sensor 36 to thereby read the color document (color image). The read color image is interrupted to image information of black, yellow, magenta and cyan.

Figure 7:
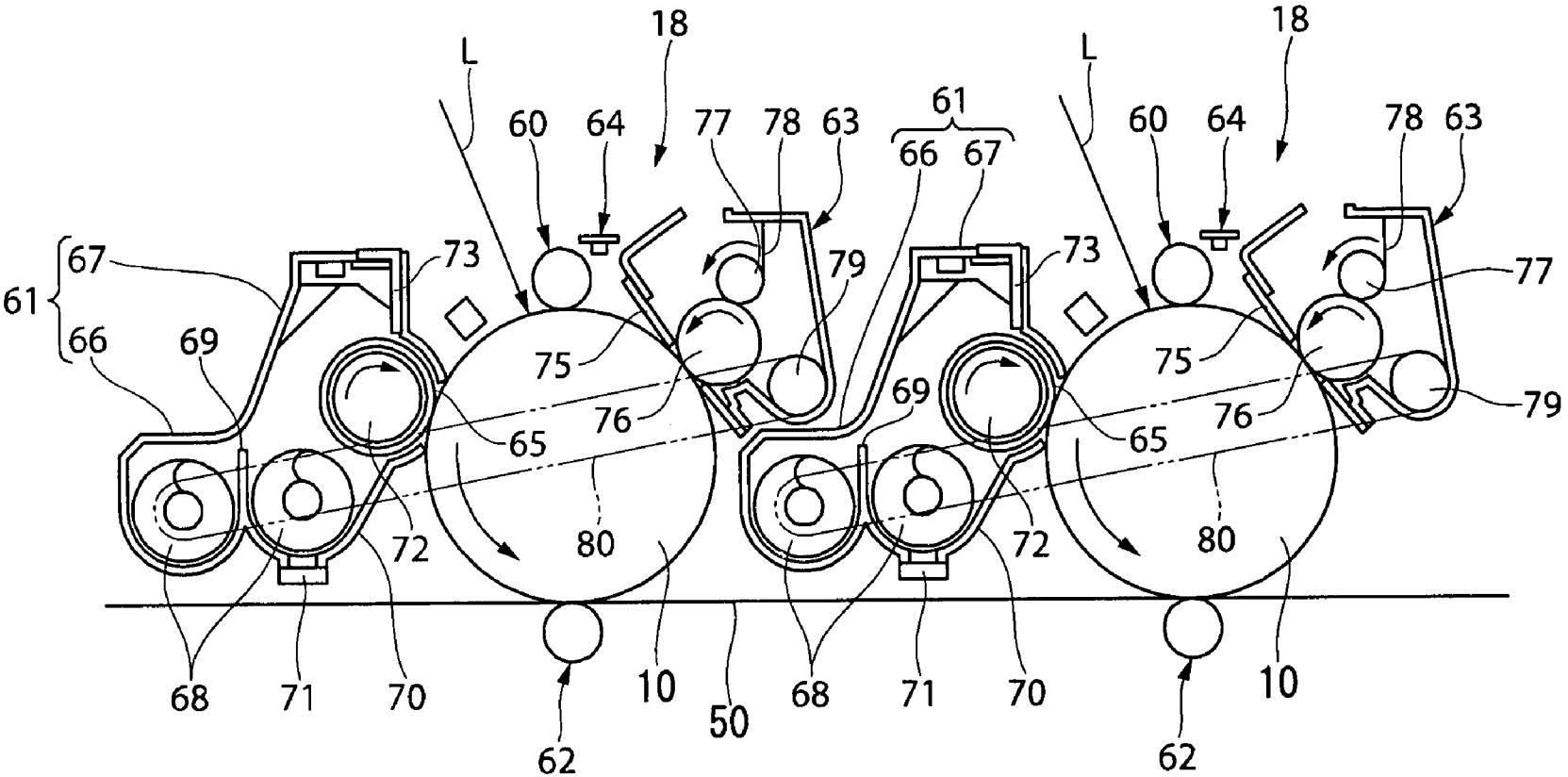
FIG. 7 is a schematic diagram to show an enlarged view of a part of the image-forming apparatus illustrated in FIG. 6.

Each of black, yellow, magenta, and cyan image information is transmitted to respective image-forming units 18 (black image-forming unit, yellow image-forming unit, magenta image-forming unit, and cyan image-forming unit) of the tandem developing device 120, and then toner images of black, yellow, magenta, and cyan are separately formed in each image-forming unit 18. With respect to each of the image-forming units 18 (black image-forming unit, yellow image-forming unit, magenta image-forming unit, and cyan image-forming unit) of the tandem developing device 120, as shown in FIG. 7, there are disposed a photoconductor 10 (a photoconductor for black 10K, a photoconductor for yellow 10Y, a photoconductor for magenta 10M, or a photoconductor for cyan 10C), a charger 60 which uniformly charge the photoconductor, an exposure unit (L) which form a latent electrostatic image corresponding to each color image on the photoconductor, an developing unit 61 which develops the latent electrostatic image with the corresponding color toner (a black toner, a yellow toner, a magenta toner, or a cyan toner) to form a toner image of each color, a transfer charger 62 for transferring the toner image to the intermediate transferring member 50, a photoconductor cleaning device 63, and a charge removing unit 64. Accordingly, each mono-color images (a black image, a yellow image, a magenta image, and a cyan image) are formed based on the corresponding color-image information. The thus obtained black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred (primary transfer) onto the intermediate transferring member 50 which rotate by means of support rollers 14, 15 and 16. These toner images are superimposed on the intermediate transferring member 50 to form a composite color image (color transferred image).

One of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copying machine main body 100 and are bumped against a resist roller 49. Note that, the resist roller 49 is generally earthed, but it may be biased for removing paper dust of the sheets.

The resist roller 49 is rotated synchronously with the movement of the composite color image on the intermediate transferring member 50 to transport the sheet (recording medium) into between the intermediate transferring member 50 and the secondary transferring unit 22, and the composite color image is transferred onto the sheet by action of the secondary transferring unit 22. After transferring the toner image, the residual toner on the intermediate transferring member 50 is cleaned by means of the intermediate cleaning device 17.

The sheet bearing the transferred image is transported by the secondary transferring unit 22 into the image-fixing device 25, is applied with heat and pressure in the image-fixing device 25 to fix the composite color image (transferred image) to the sheet (recording medium). At this point, the wax located in the surface portion of the toner particle oozes out, and imparts releasing ability.

The sheet (recording medium) is ejected to the side of the pressurizing roller 27. Thereafter, the sheet changes its direction by action of a switch blade 55, is ejected by an ejecting roller 56 and is stacked on an output tray 57. Alternatively, the sheet changes its direction by action of the switch blade 55 into the sheet reverser 28, turns the direction, is transported again to the transfer section, subjected to an image formation on the back surface thereof. The sheet bearing images on both sides thereof is then ejected with assistance of the ejecting roller 56, and is stacked on the output tray 57.

In the image-forming method and image-forming apparatus of the present invention, the toner having an excellent releasing ability is employed, and an image is fixed by means of the fixing members having a certain surface hardness. Accordingly, the present invention realizes the technical features such as prevention of the recording medium from wrapping around the fixing member, excellent offset resistance, excellent glossiness, and efficient formation of high quality images.

(Toner)

The toner of the present invention is suitably applicable for the image-fixing device and the image-forming apparatus of the present invention.

The toner of the present invention comprises toner particles, each of the toner particles comprises a wax having an aliphatic hydrocarbon chain, and a polyester resin containing an aromatic ring. The total amount of the wax in the toner particle is 1% by mass to 20% by mass, which is determined as a value mass-converted from an endothermic value of the wax in accordance with DSC. An amount of the wax located in a region of the toner particle including from the surface to 0.3 μm depth from the surface is 0.05 to 0.40, which is an intensity ratio ($P_{2850}/P_{828}$) of a peak 2850 $cm^{-1}$ derived from the wax to a peak 828 $cm^{-1}$ derived from the polyester resin, in accordance with FTIR-ATR.

A ratio of the amount of the wax in the surface region of the toner particle to the total amount of the wax in the toner particle is 0.1 or more and less than 1.0. The amount of the wax in the surface region of the toner particle is the amount of the wax in the aforementioned region, i.e., a region of the toner particle including from the surface to 0.3 μm depth from the surface, and the amount is derived from the an intensity ratio ($P_{2850}/P_{828}$) of a peak 2850 $cm^{-1}$ derived from the wax to a peak 828 $cm^{-1}$ derived from the polyester resin, in accordance with FTIR-ATR. In addition, the total amount of the wax is the aforementioned total amount of the wax which is determined as a value mass-converted from an endothermic value of the wax in accordance with DSC.

The wax is partially or entirely encapsulated in the toner particle in the form of dispersed particles.

The details of the toner of the present invention are as explained in the descriptions of the image-fixing device.

The toner of the present invention is obtainable the technical features such as excellent releasing ability, desirable offset resistance, excellent glossiness, a formation of high quality images having high image density and high resolution. Accordingly, the toner of the present invention is suitable applied for the image-fixing device and image-forming apparatus of the present invention.

The present invention will be illustrated in more detailed with reference to examples given below, but these are not to be construed as limiting the present invention. All percentages and parts are by mass unless indicated otherwise.

PRODUCTION EXAMPLE 1

<Step for Forming Adhesive Base Material>

A toner was prepared in a manner as described hereinafter.

-Preparation of Toner Solution-

-Preparation of Unmodified (Lower Molecular Mass) Polyester-

Into a reactor equipped with a condenser, a stirrer, and a nitrogen gas feed tube were poured 220 parts of ethylene oxide (2 mole) adduct of bisphenol A, 561 parts of propylene oxide (3 mole) adduct of bisphenol A, 218 parts of terephthalic acid, 46 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. Thereafter, the reaction mixture was further reacted with 45 parts of trimellitic anhydride at 180° C. at normal atmospheric pressure for 2 hours, thereby yielded unmodified polyester. The unmodified polyester had a number-average molecular mass (Mn) of 2,500, a mass-average molecular mass (Mw) of 6,700, a glass transition temperature (Tg) of 43° C., and an acid value of 25 mg KOH/g.

-Preparation of Master Batch- 30 parts of water, 40 parts of carbon black (REGAL 400R manufactured by Cabot Corp.) as a colorant, and 60 parts of a polyester resin (RS801 manufactured by Sanyo Chemical Industries Co.; acid value of 10; Mw of 20,000; Tg of 64° C.) were mixed in Henschel Mixer (manufactured by Mitsui Mining Co.). The mixture was kneaded at 130° C. for 45 minutes by a two-roller mill, cold-rolled, and milled into powder having a diameter of 1 mm by a pulverizer (manufactured by Hosokawamicron Corp.), thereby yielded a master batch.

-Preparation of Vinyl-Modified Polyester-

Into an autoclave reactor equipped with a stirrer and a thermometer were poured 450 parts of xylene, 150 parts of low-molecular mass polyethylene as a wax (San Wax LEL-400, manufactured by Sanyo Chemical Industries, Ltd.; the melting point: 128° C.), and the mixture was sufficiently dissolved. After replacing the inner atmosphere to nitrogen gas, into the mixture was dropped a mixing solution of 594 parts of styrene, 255 parts of methyl methacrylate, 34.3 parts of di-t-butylperoxyhexahydroterephthalate, and 120 parts of xylene at 155° C. for 2 hours, the mixture was allowed to react, and the temperature was maintained for 1 hour. Thereafter, the solvent was removed from the reactant to thereby yield a vinyl-modified wax having an average ester group concentration of 13.2%, number average molecular mass of 3,300, mass average molecular mass of 12,000, and glass transition temperature of 65.2° C.

-Preparation of Organic Solvent Phase-

Into a reactor equipped with a stirring rod and a thermometer were poured 378 parts of the previously-obtained unmodified polyester, 110 parts of carnauba wax, 110 parts of the previously obtained vinyl-modified polymer, 22 parts of CCA (a salicylic acid metal complex manufactured by Orient Chemical Industries, Ltd.), and 947 parts of ethylacetate as an organic solvent. The mixture was heated at 80° C. for 5 hours with stirring and was then cooled to 30° C. over 1 hour. The mixture was further treated with 500 parts of the previously-obtained master batch and 500 parts of ethylacetate with stirring for 1 hour, thereby yielded a material solution.

Thereafter, 1324 parts of the material solution was poured into a vessel, and the carbon black and the carnauba wax therein were dispersed using a bead mill (Ultravisco-Mill, by Aimex Co.) at a liquid feeding speed of 1 kg/hr, a disc rotation velocity of 6 m/sec, using zirconia beads 0.5 mm in diameter filled 80% by volume. The dispersing procedure was repeated three times. The dispersion was further treated with 1324 parts of 65% ethylacetate solution of the unmodified polyester, and the mixture was dispersed under the above conditions except that the dispersion procedure was repeated two times to yield an organic solvent phase. The thus obtained organic solvent phase had a solid content of 50% as determined by heating to 130° C. for 30 minutes.

-Synthesis of Polyester-

Into a reactor equipped with a condenser, a stirrer, and a nitrogen gas feed tube were poured 682 parts of ethylene oxide (2 mole) adduct of bisphenol A, 81 parts of a propylene oxide (2 mole) adduct of bisphenol A, 283 parts of terephthalic acid, 22 parts of trimellitic anhydride, and 2 parts of dibutyltin oxide. The mixture was reacted at 230° C. at normal atmospheric pressure for 8 hours, was further reacted under a reduced pressure of 10 mmHg to 15 mmHg for 5 hours, and thereby yielded an intermediate product of polyester. The thus obtained intermediate product had a number-average molecular mass (Mn) of 2,100, a mass-average molecular mass (Mw) of 9,500, a glass transition temperature (Tg) of 55° C., an acid value of 0.5 mg KOH/g, and a hydroxyl value of 52 mg KOH/g.

Then, into a reactor equipped with a condenser, a stirrer, and a nitrogen gas feed tube were poured 411 parts of the previously-obtained intermediate product, 89 parts of isophorone diisocyanate, and 500 parts of ethylacetate, followed by reaction at 100° C. for 5 hours to yield a prepolymer (polymer capable of reacting with the active hydrogen group-containing compound). The thus obtained prepolymer had a free isocyanate content of 1.53%.

-Synthesis of Ketimine (the Active Hydrogen Group-Containing Compound)-

Into a reactor equipped with a stirring rod and a thermometer were poured 170 parts of isophoronediamine and 75 parts of methylethylketone, followed by reaction at 50° C. for 5 hours to yield a ketimine compound (the active hydrogen group-containing compound). The thus obtained ketimine compound (the active hydrogen group-containing compound) had an amine value of 417 mg KOH/g.

Into a reactor were poured 648 parts of the organic solvent phase, 154 parts of the prepolymer, 0.05 parts of organosilica, and 6.6 parts of the ketimine compound. The mixture was mixed at 5,000 rpm for 1 minute using a TK Homo Mixer (by Tokushu Kika Kogyo Co.), thereby yielded a toner solution.

-Preparation of Dispersion-

-Preparation of Fine-Particle Dispersion-

Into a reactor equipped with a stirring rod and a thermometer were poured 683 parts of water, 11 parts of sodium salt of sulfuric acid ester of ethylene oxide adduct of methacrylic acid (Eleminol RS-30 manufactured by Sanyo Chemical Industries Co.), 83 parts of styrene, 83 parts of methacrylic acid, 110 parts of butyl acrylate, and 1 part of ammonium persulfate, and the mixture was then stirred at 400 rpm for 15 minutes to yield a white emulsion. The emulsion was heated to 75° C. and was allowed to react for 4 hours. The reaction mixture was further treated with 30 parts of a 1% aqueous solution of ammonium persulfate, was aged at 75° C. for 5 hours, thereby yielded an aqueous dispersion of vinyl resin (a copolymer of methacrylic acid-butyl acrylate-sodium salt of sulfate of methacrylic acid-ethylene oxide adduct), i.e. a fine-particle dispersion. The dispersed particles in the thus obtained fine-particle dispersion had a volume-average particle diameter of 105 nm by the laser scattering particle size distribution analyzer (LA-920 manufactured by Horiba, Ltd.). A part of fine-particle dispersion was dried to isolate the resin component. The resin component had a glass transition temperature (Tg) of 59° C. and a mass-average molecular mass (Mw) of 150,000.

-Preparation of Aqueous Medium-

An opaque liquid (aqueous medium) was prepared by blending and stirring 990 parts of water, 83 parts of the previously-obtained fine-particle dispersion, 37 parts of 48.3% aqueous solution of sodium dodecyldiphenylether disulfonate (Eleminol MON-7 manufactured by Sanyo Chemical Industries, Ltd.), and 90 parts of ethylacetate.

-Emulsification and Dispersion-

Into a vessel were poured 1,200 parts of the aqueous medium, and 809 parts of the toner solution, and the mixture was mixed at 5,000 rpm for 2 minutes using TK Homo Mixer (by Tokushu Kika Kogyo Co.), thereby yielded a dispersion (emulsified slurry).

-Solvent Removal-

Into a vessel equipped with a stirrer and a thermometer was poured the previously-obtained emulsified slurry, and was heated at 30° C. for 8 hours to remove the solvents. The slurry was then aged at 45° C. for 7 hours, thereby yielded dispersed slurry.

The thus obtained dispersed slurry had the volume average particle diameter of 5.7 μm, and number average particle diameter of 5.0 μm by the measurements of MultiSizer II, manufactured by Beckmann Coulter Inc.

-Washing and Drying-

A total of 100 parts of the previously-obtained dispersed slurry was filtered under a reduced pressure. Thereafter, the filtered cake was mixed with 300 parts of deionized water at 12,000 rpm for 10 minutes using TK Homo Mixer, and then filtered. This procedure was repeated twice, thereby yielded a final filtered cake.

The thus obtained filtered cake was dried at 45° C. for 48 hours in a circulating air dryer. Thereafter, the dried cake was screened through a mesh of 75 μm opening, thereby yielded toner-base particles of Production Example 1.

-External-Additive Mixing-

Figure 8:
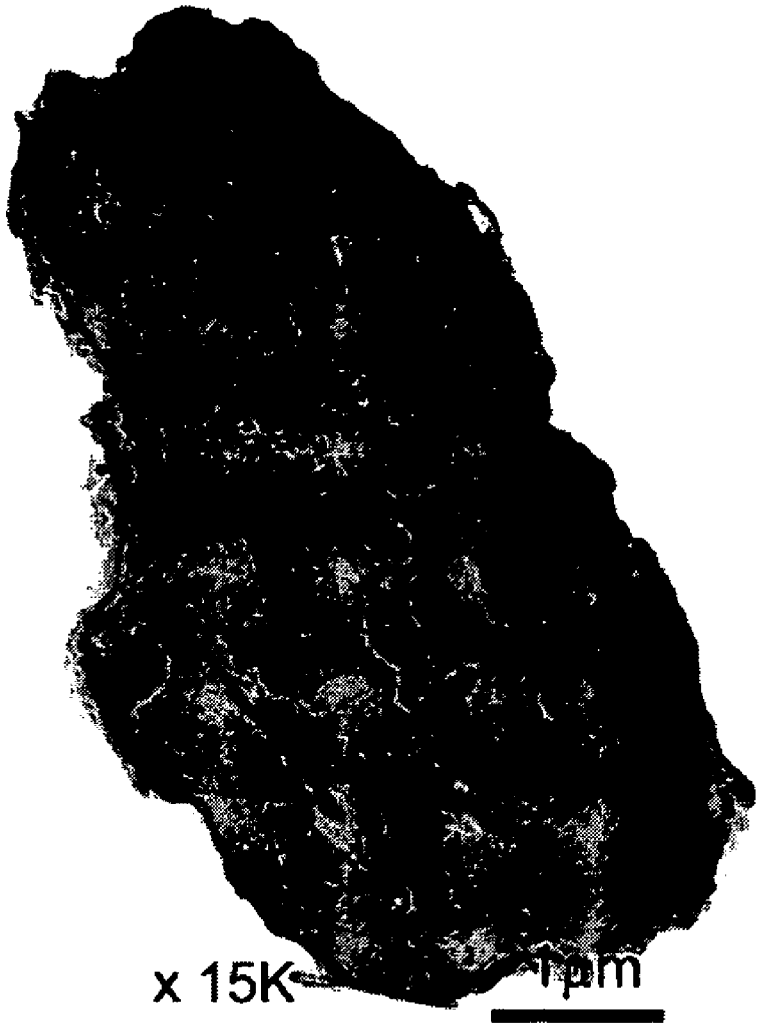
FIG. 8 is a TEM picture to show a surface texture of the toner obtained in Production Example 1.

To 100 parts of the previously obtained toner-base particles of Production Example 1 were added and mixed, as external additives, 0.7 parts of hydrophobic silica and 0.3 parts of hydrophobic titanium oxide using HENSCHEL MIXER (manufactured by Mitsui Mining Co.), thereby yielded a toner (toner particles) of Production Example 1. The surface textures of the toner particles were examined under a transmission electron microscope (TEM) (H-9000 manufactured by Hitachi Ltd.). The TEM picture from this examination is shown in FIG. 8. From this TEM picture, it was confirmed that the thus obtained toner particle contains the wax as dispersed particles and a part of the dispersed particles were encapsulated therein. It was also confirmed that the dispersed particles were uniformly dispersed within the toner particle.

The total amount of the wax (wax content) in the toner particle, the intensity ratio of the wax, and the ratio (wax amount in the surface region/total wax amount) of the amount of the toner located in the surface region of the toner particle to the total amount of the wax in the toner particle were also measured in a manner as described below. The results are shown in Table 1.

<Total Amount of Wax>

The total amount of the wax in the toner particle was measured by means of a differential scanning calorimeter (DSC 60 manufactured by Shimadzu Corp.) in accordance with differential scanning calorimetry (DSC).

About 5 mg of a toner sample was charged in an aluminum sample container; the sample container was placed on a holder unit; the holder unit was set in an electric oven. The temperature therein was increased from an ambient temperature to 150° C. at 10° C./min.; the temperature was kept at 150° C. for 10 minutes; the sample toner was then cooled down to an ambient temperature and left to stand for 10 minutes. The sample toner was then heated up to 150° C. at 10° C./min under $N_2$ atmosphere; a DSC spectrum of the sample toner was measured by the differential scanning calorimeter; endothermic value of the wax in the toner sample was calculated from the DSC spectrum. Thereafter, the total amount of the wax was calculated from the obtained endothermic values in accordance with the following Formula (1):

Total amount of the wax (% by mass)=(endothermic value of wax in the toner sample (J/g))/(endothermic value of wax itself (J/g))×100

It was found that the total amount of the wax in the toner was 35%.

<Intensity Ratio of Wax>

The wax located in a surface region of the toner particle was measured as a relative amount of the wax located in the region of the toner particle including from the surface to 0.3 μm depth from the surface in accordance with Fourier transform infrared spectroscopy by attenuated total reflectance (FTIR-ATR).

3 g of the toner sample was formed into a pellet (diameter: 40 mm, thickness: about 2 mm) by pressing with a weight of 6 t for one minute using an automatic briquetting press device (Type M, No. 50 BRP-E manufactured by MAEKAWA TESTING MACHINE MFG. CO, LTD). The surface of this toner pellet was subjected to a measurement in accordance with FTIR-ART. As a FTIR-ART microscopic device, there was prepared Spectrum One (manufactured by PERKIN ELMER) equipped with a MultiScope FTIR unit. A measurement was carried out by a micro attributed total reflectance of germanium (Ge) crystal having a diameter of 100 μm. The conditions for the measurement were as follow: instance angle of infrared ray was 41.5°; resolution was 4 $cm^{-1}$; and estimation was of twenty times. An intensity ratio ($P_{2850}/P_{828}$) of a peak 2850 $cm^{-1}$ derived from the wax to a peak 828 $cm^{-1}$ derived from the polyester resin was determined as a relative amount of the wax located in a surface region of the toner particle. The amount of the wax was determined as an average value of four measurements performed at mutually different portions.

It was fount that the intensity ratio ($P_{2850}/P_{828}$) was 0.07.

<Ratio of Wax Amount in Surface Region to Total Wax Amount>

The ratio of the amount of the wax in the surface region of the toner particle to the total amount of the wax in the toner particle was obtained as follow.

With polyester resin (the adhesive base material) were respectively mixed 1%, 3%, 5%, 8%, and 10% of the wax by means of an agate mortar. Each of the mixtures was uniformly dispersed and formed into a pellet.

In a manner as described in the measurement of the intensity ratio, the pellets were subjected to the measurement of the intensity ratio ($P_{2850}/P_{828}$) of a peak derived from the wax (2850 $cm^{-1}$) to a peak derived from the polyester resin (828 $cm^{-1}$). The four measurements were performed at mutually different portion, and an average value of the measurements was calculated, thereby obtaining a calibration curve expressed by the following Formula (2). The thus obtained ratio of the wax from the calibration curve was converted into mass, and the amount of the wax located in the surface region of the toner particle was calculated. It was found that the amount of the wax in the surface region was 2.0%.

Amount of wax in the surface region (% by mass) =27.064×(intensity ratio of wax)+0.112 Formula (2)

Sequentially, it was calculated a ratio of the thus obtained wax amount in the surface region of the toner particle to the total amount of the wax (wax content) mass-converted from the endothermic value of the wax in accordance with DSC. It was fount that the ratio was 0.57.

TABLE 1

| No. | Carnauba wax content (part) | Vinyl-modified polymer content (part) | Wax content (mass %) | Wax intensity ratio ($P_{2850}/P_{828}$) | Mass-converted wax amount in the surface (mass %) | Wax in the surface/total wax |
|---|---|---|---|---|---|---|
| 1 | 110 | 110 | 3.5 | 0.07 | 2.0 | 0.57 |
| 2 | 170 | 140 | 5.2 | 0.16 | 4.4 | 0.85 |
| 3 | 230 | 180 | 7.2 | 0.21 | 5.8 | 0.80 |
| 4 | 480 | 430 | 15 | 0.37 | 10.1 | 0.68 |
| 5 | 130 | 130 | 4.2 | 0.08 | 2.3 | 0.54 |
| 6 | 30 | Nil | 0.9 | 0.03 | 0.9 | 1.03 |
| 7 | 660 | 660 | 21 | 0.45 | 12.3 | 0.59 |

The toner was also subjected to the measurements of average circularity, volume average particle diameter (Dv), number average particle diameter (Dn), and particle size distribution (Dv/Dn) in a manner as described below.

The average circularity of the toner was measured by means of a flow-type particle image analyzer (FPIA-2100 manufactured by Sysmex Corp.).

Specifically, into a container was poured 100 ml to 150 ml of purified water from which the solid impurities were previously removed, 0.1 ml to 0.5 ml of a surfactant, i.e. alkylbenzene sulfonate, as a dispersant, and 0.1 g to 0.5 g of the toner. The mixture was then mixed to yield dispersion. The thus obtained dispersion was further dispersed for about 1 to 3 minutes by means of a ultrasonic disperser (manufactured by Honda Electrics Co., Ltd.) to adjust the concentration of the dispersant to 3,000 to 10,000 per micro liter. The shape and distribution of the toner were measured from the thus obtained dispersion, and the average circularity was obtained from the results of the toner shape and distribution.

It was found that the average circularity was 0.963. The result is shown in Table 2.

<Toner Particle Diameter>

The volume average particle diameter (Dv) and number average particle diameter (Dn) of the toner were measured by means of a particle size analyzer (MultiSizer II, manufactured by Beckmann Coulter Inc.) with an aperture of 100 μm. The particle size distribution (Dv/Dn) of the toner was calculated therefrom.

It was found that the volume average particle diameter was 5.5 μm, the number average particle diameter was 4.9 μm, and the particle size distribution (Dv/Dn) was 1.13. The results are shown in Table 2.

PRODUCTION EXAMPLES 2-7

-Preparation of Toner-Base Particles-

The toner-base particles of Production Examples 2-7 were obtained in a manner as described in Production Example 1, provided that the amount of the carnauba wax, the amount of the vinyl-modified polymer, the wax content and the intensity ratio ($P_{2850}/P_{828}$) of the wax were changed as shown in Table 1.

-External-Additive Mixing-

The thus obtained toner-base particles of Production Examples 2-7 were added with the external additives in a manner as described in Production Example 1, thereby yielded a toner of Examples 2-7. The thus obtained toner of Examples 2-7 was evaluated in a manner as described in Production Example 1. The results are shown in Tables 1 and 2.

TABLE 2

| Toner No. | Average circularity | Volume average diameter Dv (μm) | Number average diameter Dn (μm) | Size distribution Dv/Dn |
|---|---|---|---|---|
| 1 | 0.963 | 5.5 | 4.9 | 1.13 |
| 2 | 0.957 | 5.8 | 5.2 | 1.12 |
| 3 | 0.962 | 5.7 | 5.0 | 1.14 |
| 4 | 0.964 | 5.6 | 5.1 | 1.10 |
| 5 | 0.955 | 5.4 | 5.0 | 1.08 |
| 6 | 0.961 | 5.3 | 4.8 | 1.10 |
| 7 | 0.956 | 5.7 | 5.2 | 1.12 |

The present invention is illustrated in details hereinafter, but does not intend to limit thereto.

EXAMPLE 1

A toner image was formed, and fixed onto a recording medium as follow, by using the developer obtained by Preparation Example 1. The obtained image was then evaluated in terms of: (a) fixing properties (lowest fixing temperature, and highest fixing temperature for inhibiting offset), (b) glossiness, (c) image density, and (d) a presence of a recording medium wrapping around the fixing members.

The results summarized in Table 2.

Toner image were formed so as that the maximum toner deposition amounts are respectively to be 0.4 mg/cm$^2$, 1.0 mg/cm$^2$, 1.5 mg/cm$^2$, and fixed onto recording mediums by means of an image forming apparatus equipped with the belt-fixing device 110 illustrated in FIG. 1.

In the belt-fixing device 110, fixing was carried out by means of a fixing roller 122 and a fixing belt 123 which function as the image-contact fixing member, a pressurizing roller 124 which functions as the no-image-contact fixing member, and a heating roller 121, at conditions of: 1.5 kg/piece of belt tension, 170 mm/sec of belt conveyance velocity, and 10 mm of nip width.

The fixing roller 122 was a roller formed of silicone foam, having a diameter of 38 mm. The pressurizing roller 124 was comprised of a metal core (material: iron, thickness: 1 mm) having a diameter of 48 mm, coated with a PFA tube wherein the surface of PFA was applied with a silicone rubber layer having a thickness of 1 mm. The pressurizing roller 124 had a diameter of 50 mm, and surface hardness of about 60 degrees in terms of Asker C. The heating roller 121 was a roller formed of aluminum, having a thickness of 2 mm and a diameter of 30 mm. The fixing belt 123 was comprised of a nickel belt substrate having a thickness of about 40 μm and a releasing layer formed of silicone rubber, having a thickness of about 150 μm. The fixing belt 123 had a diameter of 60 mm, and a belt width of 310 mm, and was disposed so as to loop around the heating roller 121 and the fixing roller 122 with some tension. The fixing belt 123 had a surface hardness of about 50 degrees in terms of Asker C, at the condition that the fixing roller 122 was disposed underneath. In the nip N, an intermediate region of the edge where the recording medium S was introduced and the edge the recording medium S was ejected was located towards the fixing roller 12 more than the edges of introducing and ejecting, thereby ejecting the recording medium S to the side of the pressurizing roller 124 rather than the side of the fixing roller 121 after being pass through the nip N.

(a) Fixing Properties

<Highest Fixing Temperature for Inhibiting Offset>

The highest fixing temperature for inhibiting offset was measured by means of the image-forming apparatus equipped with the belt-fixing device illustrated in FIG. 1.

Namely, an image formed on a transfer sheet (Type 6200 manufactured by Ricoh Company, Ltd.) by means of a color photocopier (PRETAIL™, manufactured by Ricoh Company, Ltd.). The photocopier was adjusted so that 0.4±0.05 mg/cm$^2$ of toner would develop a solid image in each of yellow, magenta, and cyan, as well as intermediate colors of red, blue, and green. The thus obtained toner image was fixed onto the sheet by means of the belt-fixing device of FIG. 1, by varying the temperature of the fixing belt (heating roller). In this way, the highest fixing temperature at which offset does not occur was determined.

<Lowest Fixing Temperature>

A copying test was carried out by using a transfer sheet (Type 6200 manufactured by Ricoh Company, Ltd.), a color photocopier (PRETAIL™, manufactured by Ricoh Company, Ltd.), and the image-forming apparatus equipped with the belt-fixing device illustrated in FIG. 1.

The lowest fixing temperature was determined as a temperature of the fixing roller at which the obtained image maintained an image density of 70% or more after being rubbed by an eraser for ink (GAZA™, manufactured by LION Office Products Corp.).

(b) Glossiness

A solid image was formed by using a transfer sheet (Type 6200 manufactured by Ricoh Company, Ltd.), a color photocopier (PRETAIL™, manufactured by Ricoh Company, Ltd.), and the image-forming apparatus equipped with the belt-fixing device illustrated in FIG. 1. The photocopier was adjusted so that 0.4±0.05 mg/cm$^2$ of toner would be transferred onto the sheet, and the image would be fixed by the fixing roller having a surface temperature of 160±2° C.

The thus obtained solid image was subjected to a measurement of glossiness. The measurement was carried out at incident angle of 60° by GLOSSMETER (manufactured by Nippon Denshoku Industries Co., Ltd.), and was taken at arbitrary selected tree points in the solid image so as to calculate an average value thereof. Note that a higher value means more glossy texture of the image.

(c) Image Density

A solid image was formed by using a transfer sheet (Type 6200 manufactured by Ricoh Company, Ltd.), a color photocopier (PRETAIL™, manufactured by Ricoh Company, Ltd.), and the image-forming apparatus equipped with the belt-fixing device illustrated in FIG. 1. The photocopier was adjusted so that 0.4±0.05 mg/cm$^2$ of toner would be transferred onto the sheet, and the image would be fixed by the fixing roller having a surface temperature of 160±2° C.

The thus obtained solid image was subjected to a measurement of glossiness. The measurement was carried out at by means of a spectrometer (SpectroDensitometer 938. manufactured by X-Rite), and was taken at arbitrary selected tree points in the solid image. The image density was determined as an average value of the measurements from the aforementioned three points. Note that a higher value means higher image density, and capability of formation of high density images.

(d) Presence of Recording Medium Wrapping Around the Fixing Members

A copying test was carried out by using a transfer sheet (Type 6200 manufactured by Ricoh Company, Ltd.), a color photocopier (PRETAIL™, manufactured by Ricoh Company, Ltd.), and the image-forming apparatus equipped with the belt-fixing device illustrated in FIG. 1. It was visually observed that whether or not the sheet having the fixed image wrapped around the fixing belt 123 (fixing roller 122).

EXAMPLES 2-4

Examples 2-4 were carried out and evaluated in the same manner as Example 1, provided that the toner obtained by Preparation Example 1 was replaced by the toners listed in Table 3.

The results are summarized in Table 3.

EXAMPLE 5

Example 5 was carried out and evaluated in the same manner as Example 1, provided that the toner obtained by Preparation Example 1 was replaced by the toner obtained by Preparation Example 5, and the image-fixing device illustrated in FIG. 1 was replaced by the electromagnetic-induction-heat fixing apparatus illustrated in FIG. 3.

A toner image was formed and fixed onto a recording medium by means of an image-forming apparatus equipped with the electromagnetic-induction-heat fixing apparatus 310 illustrated in FIG. 3.

In the electromagnetic-induction-heat fixing apparatus illustrated in FIG. 3, fixing was carried out by means of a fixing roller 330 and a fixing belt 340 which function as the image-contact fixing member, a pressurizing roller 350, a heating roller 320, and a electromagnetic-induction heating unit 360 which function as the no-image-contact fixing member.

The fixing roller 330 was a roller formed of silicone foam, having a diameter of 38 mm. The pressurizing roller 350 was comprised of a metal core (material: iron, thickness: 1 mm) having a diameter of 40 mm, coated with a PFA tube wherein the surface of PFA was applied thereon a silicone rubber layer having a thickness of 1 mm. The pressurizing roller 350 had a diameter of 42 mm, and surface hardness of about 55 degrees in terms of Asker C. The heating roller 320 was a roller formed of aluminum, having a thickness of 0.8 mm and a diameter of 30 mm. Once the excitation coil 361 of the electromagnetic-induction heating unit was electrified, alternating magnetic field was formed around the electromagnetic-induction heating unit, thereby efficiently preheating the heating roller 320 by means of excitation of overcurrent. The fixing belt 340 was comprised of a nickel belt substrate having a thickness of about 40 μm and a releasing layer formed of silicone rubber, having a thickness of about 150 μm. The fixing belt 123 had a diameter of 60 mm, and a belt width of 310 mm, and was disposed so as to loop around the heating roller 320 and the fixing roller 330 with some tension. The fixing belt 340 had a surface hardness of about 50 degrees in terms of Asker C, at the condition that the fixing roller 330 was disposed underneath. In the nip N, an intermediate region of the edge where the recording medium S was introduced and the edge the recording medium S was ejected was located towards the fixing roller 330 more than the edges of introducing and ejecting, thereby ejecting the recording medium S to the side of the pressurizing roller 350 rather than the side of the fixing roller 330 after being pass through the nip N.

COMPARATIVE EXAMPLE 1

Comparative Example 1 was carried out and evaluated in the same manner as Example 1, provided that the toner obtained by Preparation Example 1 was replaced by the toner obtained by Preparation Example 6.

The results are summarized in Table 3.

COMPARATIVE EXAMPLE 2

Figure 9:
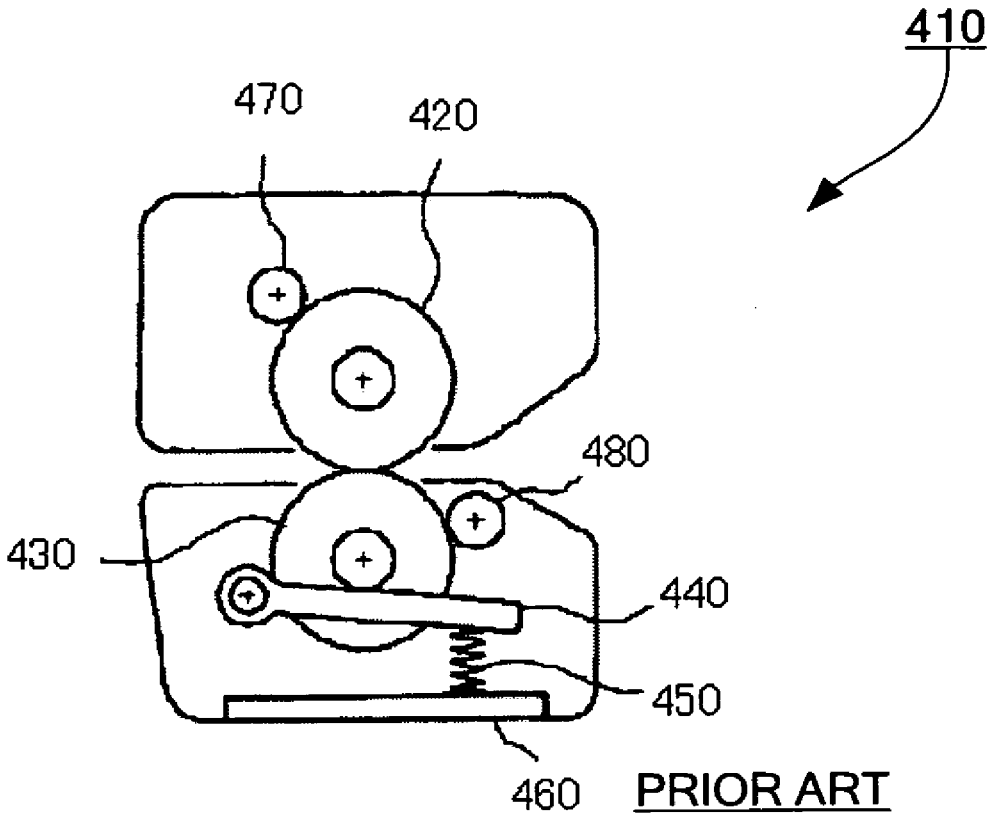
FIG. 9 is a schematic diagram to show an image-fixing device for use in Comparative Example 2.

Comparative Example 2 was carried out and evaluated in the same manner as Example 1, provided that the toner obtained by Preparation Example 1 was replaced by Preparation Example 7, and the belt-fixing device illustrated in FIG. 1 was replaced by the image-fixing device illustrated in FIG. 9.

The results are summarized in Table 3.

A toner image was formed and fixed onto a recording medium by means of an image-forming apparatus equipped with the image-fixing device 410 illustrated in FIG. 9.

In the image-fixing device 410, there were equipped with a fixing roller 420 and a pressurizing roller 430. The surface of the fixing roller 420 was formed of a metal, and had hardness of about 80 degrees in terms of Asker C. The surface of the pressurizing roller 430 was formed of a rubber, and had hardness of about 70 degrees in terms of about 70 degrees.

The pressurizing roller 430 was disposed so as to be able to rotate while contacting against the fixing roller 420 with some pressure. Adjacent to the pressurizing roller 430, there were disposed a compression lever which rotated based on one end thereof, and a fixing substrate. The compression lever 440 was attached to the fixing substrate 450 by means of a compression spring 460 so that pressure was applied in a counterclockwise direction. By means of this compression lever 440, the pressurizing roller 430 and the fixing roller 420 were disposed adjusted to each other.

Moreover, the fixing roller 420 and the pressurizing roller 430 were respectively equipped with a cleaning roller 470 and 480, which was formed of heat resistive metals or materials having a high surface hardness, and had a small diameter.

COMPARATIVE EXAMPLE 3

Comparative Example 3 was carried out and evaluated in the same manner of the Example 1, provided that the belt-fixing device illustrated in FIG. 1 was replaced by the image-fixing device illustrated in FIG. 9.

The results are summarized in Table 3.

TABLE 3

| | Toner No. | Toner deposition (mg/cm$^2$). | Surface hardness of fixing member Asker C hardness (°) Above: Endless belt (fixing roller) Below: Presser roller | Fixing properties: Lower fixing temperature (° C.) | Fixing properties: Highest fixing temperature (° C.) | Fixing properties: Glossiness (%) | Fixing properties: Image density | Fixing properties: Wrapping around by a recording medium |
|---|---|---|---|---|---|---|---|---|
| Ex. 1 | 1 | 0.4 | 50 | 145 | 190 | 6.6 | 1.46 | None |
| | | 1.0 | 60 | | | | | |
| | | 1.5 | | | | | | |
| Ex. 2 | 2 | 0.4 | 50 | 145 | 195 | 7.8 | 1.45 | None |
| | | 1.0 | 60 | | | | | |
| | | 1.5 | | | | | | |
| Ex. 3 | 3 | 0.4 | 50 | 150 | 200 | 8.5 | 1.47 | None |
| | | 1.0 | 60 | | | | | |
| | | 1.5 | | | | | | |
| Ex. 4 | 4 | 0.4 | 50 | 150 | 205 | 9.2 | 1.51 | None |
| | | 1.0 | 60 | | | | | |
| | | 1.5 | | | | | | |
| Ex. 5 | 5 | 0.4 | 45 | 145 | 195 | 6.9 | 1.43 | None |
| | | 1.0 | 55 | | | | | |
| | | 1.5 | | | | | | |
| Com. 1 | 6 | 0.4 | 50 | 160 | 170 | 4.5 | 1.41 | None |
| | | 1.0 | 60 | | | | | |
| | | 1.5 | | | | | | |
| Com. 2 | 7 | 0.4 | 80 | 145 | 190 | 8.8 | 1.32 | None |
| | | 1.0 | 70 | | | | | |
| | | 1.5 | | | | | | |
| Com. 3 | 1 | 0.4 | 80 | 145 | 180 | 7.5 | 1.42 | Occurred |
| | | 1.0 | 70 | | | | | |
| | | 1.5 | | | | | | |

The results summarized in Table 3 gave us the following teachings.

Namely, excellent glossiness, desirable image density, and high quality were obtained in Examples 1-5 which used toners having a certain amount of the wax in a surface region, which is smaller than the amount of the wax in a inner region (wax in surface/total wax<1), and the fixing belt disposed adjacent to the fixing roller as the image-contact fixing member had a lower surface hardness than that of the pressurizing roller as the no-image-contact fixing member. Moreover, the toners used in Examples 1-5 had sufficient releasing properties, and thus the fixing properties were of desirable even if the toner deposition amount was large, and the recording medium did not wrap abound the fixing members. On the other hand, even though Comparative Example 3 used the same toner obtained by Preparation Example 1 as in Example 1, the recording medium wrapped around the fixing members since the fixing roller (image-contact side) had a higher surface hardness than that of the pressurizing roller (no-image-contact side).

The image-fixing method and image-fixing device of the present invention are capable of preventing the recording medium from wrapping about the fixing members, realizing desirable offset properties, and obtaining excellent glossiness and high quality image. Therefore, the image-fixing method and image-fixing device of the present invention are suitably applicable for formations of high quality images.

Moreover, the formations of high quality images can be achieved by suitably applying the image-forming method and image-forming apparatus of the present invention which utilize the image-fixing method and image-fixing device of the present invention.

Furthermore, the toner of the present invention has excellent releasing properties, and thus the toner of the present invention is suitably applicable for the image-fixing method, image-fixing device, image-forming method and image-forming apparatus of the present invention.

What is claimed are:

1. An image-fixing method, comprising:

passing a recording medium bearing a toner image thereon through a nip formed between two or more fixing members so as to fix the toner image onto the recording medium, and ejecting the recording medium to beside of one of the two or more fixing members which contacts with a non-image-bearing surface of the recording medium, wherein one of the two or more fixing members which contacts with an image-bearing surface of the recording medium has a lower surface hardness than a surface hardness of the fixing member which contacts with the non-image-bearing surface of the recording medium, wherein a toner image has a maximum toner deposition amount of 0.4 mg/cm$^2$ to 1.5 mg/cm$^2$ at least a part thereof and wherein the toner image is comprised of a toner, the toner comprises toner particles, each toner particle comprises a wax having an aliphatic hydrocarbon chain in a polymeric structure thereof, a vinyl-modified polymer, and a polyester resin having an aromatic ring in a polymeric structure thereof, wherein the vinyl-modified polymer is a wax which is modified with a vinyl monomer having an average ester-group concentration of 8% by mass to 30% by mass at least at a part thereof, a total amount of the wax in the toner particle is 1% by mass to 20% by mass, the total amount of the wax is determined as a value which is mass-converted from an endothermic value of the wax in accordance with DSC, an amount of the wax located in a region of the toner particle including from the surface to 0.3 μm depth from the surface is 0.05 to 0.40, the amount of the wax located in the region is determined as an intensity ratio $P_{2850}/P_{828}$ of a peak 2850 cm$^{-1}$ derived from the wax to a peak 828 cm$^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 cm$^{-1}$ derived from the wax to a peak 828 cm$^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

2. The image-fixing method according to claim 1, wherein a center of the nip is located towards the fixing member which contacts with the image-bearing surface of the recording medium compared with an edge of the nip where the recording medium is introduced and an edge of the nip where the recording medium is ejected, in which the center of the nip is in between the edges of the nip.

3. The image-fixing method according to claim 1, wherein the fixing member which contacts with the image-bearing surface of the recording medium comprises an endless belt and a roller disposed so as to contact with the recording medium via the endless belt.

4. The image-fixing method according to claim 1, wherein the surface hardness of the fixing member which contacts with the image-bearing surface of the recording medium is in the range of from 30 degrees to 90 degrees in terms of Asker C.

5. The image-fixing method according to claim 1, wherein the fixing member which contacts with the non-image-bearing surface of the recording medium is a roller.

6. The image-fixing method according to claim 1, wherein the surface hardness of the fixing member which contacts with the non-image-bearing surface of the recording medium is in the range of from 40 degrees to 99 degrees in terms of Asker C.

7. The image-fixing method according to claim 1, wherein a surface of at least one of the fixing members is partially or entirely heated by a heating unit.

8. The image-fixing method according to claim 1, wherein the toner is a color toner.

9. The image-fixing method according to claim 1, wherein the toner is formed by a process comprising:

dissolving and dispersing, in an organic solvent, an active hydrogen group-containing compound and a polymer capable of reacting with the active hydrogen group-containing compound so as to form a toner solution;

dispersing the toner solution in an aqueous medium so as to form a dispersion;

allowing the active hydrogen group-containing compound and the polymer to react so as to form an adhesive base material in the form of particles; and removing the organic solvent.

10. The image-fixing method according to claim 1, wherein the dispersed particles are uniformly dispersed in the toner particle.

11. The image-fixing method according to claim 1, wherein an average circularity of the toner particles is in the range of from 0.900 to 0.975.

12. The image-fixing method according to claim 1, wherein a volume average particle diameter of the toner is in the range of from 3 μm to 8 μm.

13. The image-fixing method according to claim 1, wherein a ratio Dv/Dn of the volume average particle diameter Dv of the toner to a number average particle diameter Dn of the toner is 1.20 or less.

14. An image-forming method, comprising:

developing the latent electrostatic image with a toner so as to form a toner image having a maximum toner deposition amount of 0.4 mg/cm$^2$ to 1.5 mg/cm$^2$ at least at part thereof;

transferring the toner image onto a recording medium;

passing the recording medium bearing the toner image thereon through a nip formed between two or more fixing members so as to fix the toner image onto the recording medium, and ejecting the recording medium along with one of the two or more fixing members which contacts with a non-image-bearing surface of the recording medium, wherein one of the two or more fixing members which contacts with an image-bearing surface of the recording medium has a lower surface hardness than a surface hardness of the fixing member which contacts with the non-image-bearing surface of the recording medium, and wherein the toner comprises toner particles, each toner particle comprises a wax having an aliphatic hydrocarbon chain in a polymeric structure thereof, a vinyl-modified polymer, and a polyester resin having an aromatic ring in a polymeric structure thereof, wherein the vinyl-modified polymer is a wax which is modified with a vinyl monomer having an average ester-group concentration of 8% by mass to 30% by mass at least at a part thereof, a total amount of the wax in the toner particle is 1% by mass to 20% by mass, which is determined as a value mass-converted from an endothermic value in accordance with DSC, an amount of the wax located in a region of the toner particle including from the surface to 0.3 μm depth from the surface is 0.05 to 0.40, which is an intensity ratio $P_{2850}/P_{828}$ of a peak 2850 cm$^{-1}$ derived from the wax to a peak 828 cm$^{-1}$ derived from the polyester resin, in accordance with FTIR-ATR, a ratio of the amount of the wax located in the region to the total amount of the wax in the toner particle is 0.1 or more and less than 1.0, in which the amount of the wax located in the region is determined as a value which is mass-converted from an intensity ratio $P_{2850}/P_{828}$ of a peak 2850 $cm^{-1}$ derived from the wax to a peak 828 $cm^{-1}$ derived from the polyester resin in accordance with FTIR-ATR, and the total amount of the wax is determined as a value which is mass-converted from an endothermic value of the wax in accordance with DSC, and at least a part of the wax is encapsulated in the toner particle in the form of dispersed particles.

* * * * *